US009840082B2

(12) United States Patent
Nanjo et al.

(10) Patent No.: US 9,840,082 B2
(45) Date of Patent: Dec. 12, 2017

(54) INK CARTRIDGE AND INK JET PRINTER

(71) Applicant: CANON KABUSHIKI KAISHA, Tokyo (JP)

(72) Inventors: Tatsuo Nanjo, Kawasaki (JP); Yasuo Kotaki, Yokohama (JP); Kenta Udagawa, Tokyo (JP); Hiroshi Koshikawa, Yokohama (JP); Wataru Takahashi, Yokohama (JP); Koichi Kubo, Yokohama (JP); Shigeki Fukui, Kawasaki (JP); Naozumi Nabeshima, Tokyo (JP); Soji Kondo, Yokohama (JP); Masafumi Seki, Kawasaki (JP); Kazuya Yoshii, Yokohama (JP); Satoshi Kimura, Kawasaki (JP); Kyosuke Toda, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/063,087

(22) Filed: Mar. 7, 2016

(65) Prior Publication Data

US 2016/0200114 A1 Jul. 14, 2016

Related U.S. Application Data

(63) Continuation of application No. PCT/JP2014/075336, filed on Sep. 17, 2014.

(30) Foreign Application Priority Data

Sep. 18, 2013 (JP) ..... 2013-193043
Aug. 25, 2014 (JP) ..... 2014-171029

(51) Int. Cl.
*B41J 2/175* (2006.01)

(52) U.S. Cl.
CPC ..... *B41J 2/17526* (2013.01); *B41J 2/175* (2013.01); *B41J 2/1752* (2013.01); *B41J 2/1753* (2013.01);
(Continued)

(58) Field of Classification Search
CPC ..... B41J 2/1752; B41J 2/17526
See application file for complete search history.

(56) References Cited

U.S. PATENT DOCUMENTS 6,145,972 A 11/2000 Udagawa et al. ..... 347/86
6,234,618 B1 5/2001 Yamamoto et al. ..... 347/86
(Continued)

FOREIGN PATENT DOCUMENTS

CN 101121333 A 2/2008 ..... B41J 2/175
CN 203697707 U 7/2014 ..... B41J 2/175
(Continued)

OTHER PUBLICATIONS

U.S. Appl. No. 15/061,729, filed Mar. 4, 2016.
(Continued)

*Primary Examiner* — Stephen Meier
*Assistant Examiner* — John P Zimmermann
(74) *Attorney, Agent, or Firm* — Fitzpatrick, Cella, Harper & Scinto

(57) ABSTRACT

To provide an ink cartridge capable of accomplishing satisfactory electrical connection relative to a printer main assembly.

An ink cartridge 1 detachably mountable to a cartridge mounting portion 33 provided with an ink receiving tube 52 and a plurality of electrical connecting portions 55, the ink cartridge 1 including a tube inserting portion 8 into which the receiving tube 52 is insertable, a substrate 3 provided on a front side 2*c* in a position above the tube inserting portion 8, a plurality of electrical contacts 4 electrically connectable
(Continued)

with the plurality of electrical connecting portions 55, the electrical contacts 4 being arranged on the substrate 3 in a direction crossing with a direction from a bottom surface 2*b* toward an upper surface 2*a*

16 Claims, 43 Drawing Sheets

(52) U.S. Cl.
CPC ..... *B41J 2/17513* (2013.01); *B41J 2/17553* (2013.01); *B41J 2002/17516* (2013.01)

(56) References Cited

U.S. PATENT DOCUMENTS 6,244,695 B1 6/2001 Udagawa ..... 347/86
6,247,598 B1 * 6/2001 Hosaka ..... B41J 2/17503 206/576
6,293,663 B1 9/2001 Koshikawa et al. ..... 347/86
6,350,025 B1 2/2002 Morita et al. ..... 347/86
6,382,783 B1 5/2002 Hayashi et al. ..... 347/85
6,382,786 B2 5/2002 Iwanaga et al. ..... 347/86
6,390,601 B1 5/2002 Morita et al. ..... 347/49
6,402,298 B1 6/2002 Nanjo et al. ..... 347/49
6,416,173 B2 7/2002 Kishida et al. ..... 347/86
6,419,349 B1 7/2002 Iwanaga et al. ..... 347/86
6,443,567 B1 9/2002 Hayashi et al. ..... 347/85
6,450,631 B1 9/2002 Hayashi et al. ..... 347/86
6,454,400 B1 9/2002 Morita et al. ..... 347/86
6,471,343 B1 10/2002 Shimizu et al. ..... 347/85
6,505,923 B1 1/2003 Yamamoto et al. ..... 347/85
6,511,167 B1 1/2003 Kitabatake et al. ..... 347/86
6,527,381 B1 3/2003 Udagawa et al. ..... 347/86
6,530,654 B2 3/2003 Kitabatake et al. ..... 347/86
6,540,342 B2 4/2003 Koshikawa et al. ..... 347/86
6,543,886 B1 4/2003 Hattori et al. ..... 347/85
6,550,898 B2 4/2003 Hayashi et al. ..... 347/85
6,598,963 B1 7/2003 Yamamoto et al. ..... 347/85
6,652,949 B2 11/2003 Iwanaga et al. ..... 428/65.9
6,655,542 B2 12/2003 Koshikawa et al. ..... 220/661
6,702,427 B2 3/2004 Shimizu et al. ..... 347/50
6,705,715 B2 3/2004 Morita et al. ..... 347/87
6,709,092 B2 3/2004 Hayashi et al. ..... 347/86
6,712,458 B2 3/2004 Hatasa et al. ..... 347/86
6,719,415 B1 4/2004 Hattori et al. ..... 347/86
6,742,857 B2 6/2004 Koshikawa et al. ..... 347/19
6,742,881 B2 6/2004 Kotaki et al. ..... 347/86
6,796,645 B2 9/2004 Koshikawa et al. ..... 347/86
6,805,434 B2 10/2004 Hayashi et al. ..... 347/85
6,824,258 B2 11/2004 Yamamoto et al. ..... 347/86
6,827,431 B2 12/2004 Kitabatake et al. ..... 347/86
6,851,798 B2 2/2005 Koshikawa et al. ..... 347/85
6,863,762 B2 3/2005 Sanada et al. ..... 156/180
6,877,848 B2 4/2005 Shimizu et al. ..... 347/86
6,921,161 B2 7/2005 Morita et al. ..... 347/86
6,942,325 B2 9/2005 Nanjo ..... 347/86
6,971,741 B2 12/2005 Nanjo et al. ..... 347/85
7,077,514 B2 7/2006 Inoue et al. ..... 347/86
7,104,640 B2 9/2006 Ogura et al. ..... 347/86
7,125,109 B2 10/2006 Watanabe et al. ..... 347/86
7,207,159 B2 4/2007 Nanjo et al. ..... 53/492
7,303,090 B2 12/2007 Nanjo et al. ..... 220/360
7,350,910 B2 4/2008 Amma et al. ..... 347/86
7,384,116 B2 6/2008 Kotaki et al. ..... 347/19
7,396,118 B2 7/2008 Ogawa et al. ..... 347/87
7,425,059 B2 * 9/2008 Kudo ..... B41J 2/17509 347/22
7,434,921 B2 10/2008 Udagawa ..... 347/85
7,552,837 B2 6/2009 Nanjo et al. ..... 220/360
7,735,984 B2 6/2010 Iijima et al. ..... 347/86
7,854,499 B2 12/2010 Udagawa ..... 347/86
7,926,927 B2 4/2011 Kotaki et al. ..... 347/86
7,950,789 B2 5/2011 Matsumoto et al. ..... 347/86
7,950,790 B2 5/2011 Kubo et al. ..... 347/86
7,954,931 B2 6/2011 Shimizu et al. ..... 347/85
8,002,397 B2 8/2011 Udagawa et al. ..... 347/86
8,020,978 B2 9/2011 Ogawa et al. ..... 347/86
8,047,641 B2 11/2011 Nanjo et al. ..... 347/86
8,087,762 B2 * 1/2012 Takemura ..... B41J 2/17509 347/85
8,109,617 B2 2/2012 Kotaki et al. ..... 347/86
8,136,930 B2 3/2012 Anma et al. ..... 347/86
8,205,974 B2 6/2012 Ogura et al. ..... 347/86
8,313,185 B2 11/2012 Hatasa et al. ..... 347/92
8,322,807 B2 12/2012 Seki et al. ..... 347/6
8,434,859 B2 * 5/2013 Karasawa ..... B41J 2/1752 347/49
8,469,498 B2 6/2013 Ohashi et al. ..... 347/86
8,474,960 B1 7/2013 Harvey et al. ..... 347/86
8,485,642 B2 7/2013 Hayashi et al. ..... 347/49
8,529,037 B2 9/2013 Miyashita et al. ..... 347/86
8,550,607 B2 10/2013 Inoue et al. ..... 347/86
8,646,884 B2 * 2/2014 Ishibe ..... B41J 2/1752 347/50
8,646,889 B2 2/2014 Aoki et al. ..... 347/86
8,770,730 B2 * 7/2014 Nanjo ..... B41J 2/17509 347/85
8,770,731 B2 7/2014 Miyashita et al. ..... 347/86
8,960,869 B2 2/2015 Takada et al. ..... B41J 2/1752
9,016,842 B2 4/2015 Miyashita et al. ... B41J 2/17596
9,079,411 B2 7/2015 Takagi et al. ..... B41J 2/1753
9,132,653 B2 9/2015 Takagi et al. ..... B41J 2/1753
9,278,540 B2 3/2016 Seki et al. ..... B41J 2/17523
2002/0113853 A1 8/2002 Hattori et al. ..... 347/86
2003/0038867 A1 2/2003 Yamamoto et al. ..... 347/86
2003/0043241 A1 3/2003 Hattori et al. ..... 347/86
2004/0246304 A1 12/2004 Takahashi et al. ..... 347/49
2005/0007420 A1 1/2005 Ogawa et al. ..... 347/50
2007/0120901 A1 * 5/2007 Sugiyama ..... B41J 2/1752 347/85
2009/0278900 A1 11/2009 Kondo et al. ..... 347/85
2012/0050423 A1 * 3/2012 Ishikawa ..... B41J 2/175 347/86
2012/0056954 A1 * 3/2012 Asauchi ..... B41J 2/17513 347/86
2013/0050310 A1 2/2013 Seki et al. ..... 347/6
2013/0182051 A1 7/2013 Aoki et al. ..... 347/86
2014/0176650 A1 6/2014 Maruyama et al. ... B41J 2/1752
2015/0343791 A1 12/2015 Takagi et al. ..... B41J 2/17526
2015/0343793 A1 12/2015 Takada et al. ..... B41J 2/19
2015/0352851 A1 12/2015 Shiba et al. ..... B41J 2/17506
2015/0375512 A1 12/2015 Kondo et al. ..... B41J 2/1752
2015/0375514 A1 12/2015 Koshikawa et al. . B41J 2/17523
2016/0052290 A1 2/2016 Takahashi et al. .. B41J 2/17566

FOREIGN PATENT DOCUMENTS

EP 1886819 2/2008
EP 3047976 7/2016
JP 2004-291246 10/2004
JP 2007-136980 6/2007
JP 2008-036984 2/2008
JP 2010-000671 1/2010
JP 2010-228380 10/2010
JP 2013-049170 3/2013
JP WO2013/105504 7/2013
JP 2014-043016 3/2014
JP 2014-043017 3/2014
JP 2014-124804 7/2014
KR 10-2009-0085598 8/2009
WO 2012-054050 4/2012

OTHER PUBLICATIONS

Chinese Office Action dated Nov. 4, 2016, in counterpart Chinese Patent Application No. 201480061601.1, with English language translation.
Extended European Search Report dated Apr. 18, 2017, in counterpart European Application No. 14845276.6.

(56) References Cited

OTHER PUBLICATIONS

Notification of Reason for Refusal dated Aug. 31, 2017 in counterpart Korean Patent Application No. 10-2016-7005109, with English translation.
Russian Office Action dated Oct. 3, 2017 in counterpart Russia Application No. 2016114544, with English translation.

* cited by examiner

INK CARTRIDGE AND INK JET PRINTER

This application is a continuation of Application No. PCT/JP2014/075336 filed Sep. 17, 2014, now pending, and claims benefit of Japan Application No. 2013-193043 filed Sep. 18, 2013 and Japan Application No. 2014-171029 filed Aug. 25, 2014; the contents of all of which are incorporated herein by reference as if set forth in full.

The present invention relates to an ink cartridge and an ink jet printer capable of printing on a print medium using ink supplied from the ink cartridge.

BACKGROUND ART

The ink cartridge detachably mountable to a receiver (cartridge mounting portion) of a main assembly of the ink jet printer is provided with a cartridge side interface portion connectable with an interface portion provided in a main assembly side of the printer (International Publication No. 2012-054050). In International Publication No. 2012-054050, there are provided an electrical contact, an ink supply opening (ink discharge opening, tube inserting opening), a cartridge side locking portion as the cartridge side interface portion. As for the interface portion of the main assembly side of the printer, a receiver is provided with an electrical connecting portion electrically connectable with the electrical contact, an ink receiving tube to be inserted into the ink supply port, a locking mechanism of the main assembly side of the printer for engaging with the cartridge side locking portion. When the ink cartridge is inserted into the receiver, the electrical contact of the ink cartridge is connected with the electrical connecting portion of the receiver, and the ink receiving tube of the receiver is inserted into the supply opening of the ink cartridge. In addition, the cartridge side locking portion is engaged with the locking portion of the main assembly side of the printer, by which the ink cartridge is locked with the receiver. By this, the connection between the ink cartridge and the main assembly of the printer is completed.

As will be understood from FIGS. 6-9 of International Publication No. 2012-054050, the electrical contact is provided adjacent to a right-hand surface of a cartridge parallel with a cartridge mounting direction (Y axis direction). The cartridge side locking portion for fixing the cartridge to the receiver is provided on a cartridge bottom surface far from the electrical contact.

SUMMARY OF THE INVENTION

The Problem to be Solved by the Invention

The cartridge side interface portion disclosed in International Publication No. 2012-054050 involves a point which can be improved. For example, in International Publication No. 2012-054050, an electrical contact is provided on a surface parallel with a cartridge mounting direction, and therefore, an electrical connecting portion of the main assembly of the printer significantly rubs the electrical contact of the ink cartridge when the ink cartridges mounted to or dismounted. For this reason, by the repeated mounting and dismounting operations, the electrical connecting portion of the main assembly is worn with the result of adverse affect to the electrical connection. Thus, in the prior art, the structures and arrangements of the parts in the cartridge side interface portion involves a point which can be improved.

Means for Solving the Problem

The present invention provides *

Advantageous Effect of the Invention

An improved ink cartridge is provided. In addition, a novel ink jet printer with which a satisfactory connection is accomplished between the ink cartridge and the cartridge mounting portion is provided.

DESCRIPTION OF THE EMBODIMENTS

An ink cartridge and an ink jet printer according to embodiments of the present invention will be described in detail in conjunction with accompanying drawings. The embodiments are preferable ones that implement the present invention which is not limited to these embodiments.

[First Embodiment]

<Ink Jet Printer>

Figure 1:
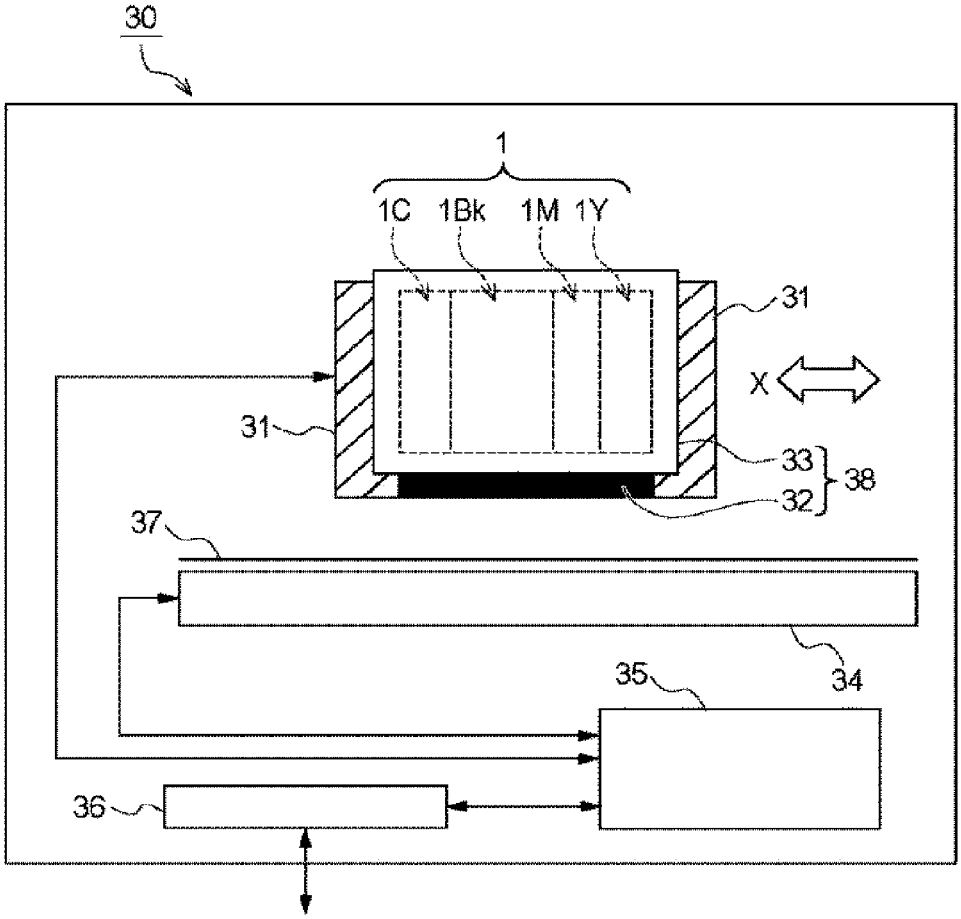
FIG. 1 illustrates a schematic structure of an ink jet printer.

FIG. 1 illustrates a schematic structure of the ink jet printer as an image forming apparatus. FIG. 1 shows a state in which an ink cartridge 1 as an ink reservoir is mounted on a main assembly of the printer (main assembly A) 30.

The printer main assembly 30 comprises a carriage 31, an ink jet head 32, a mounting portion 33, a feeding means 34, a controller 35 and an input/output portion 36, and in addition, an opening and closing outer cover, a feeding means, a feeding cassette, a discharging tray, an operating portion and so on which are unshown. The printer main assembly 30 is connectable with an external device (unshown) such as a computer, a digital camera, a memory card or the like, through the input/output portion 36.

The controller 35 carries out overall control, control of information communication with the ink cartridge 1, analysis and processing of the information inputted from the external device through the input/output portion 36, and outputting of information to the input/output portion 36. For example, the controller 35 produces instructions for actuating devices such as the carriage 31, the ink jet head 32, the feeding means 34 and the feeding means and for controlling the devices. In addition, the controller 35 can control the devices for reading ink colors, initial ink filling amounts, ink consumption amounts and other individuality information of the cartridges out of a storing element provided in the ink cartridge 1, and for writing the information of the ink consumption amounts in the storing element provided in the ink cartridge 1. Furthermore, the controller 35 can analyze and process print instructions and/or image data inputted through the input/output portion 36 from the external device, and can output the information such as the remaining ink amount to the input/output portion 36.

Figure 6:
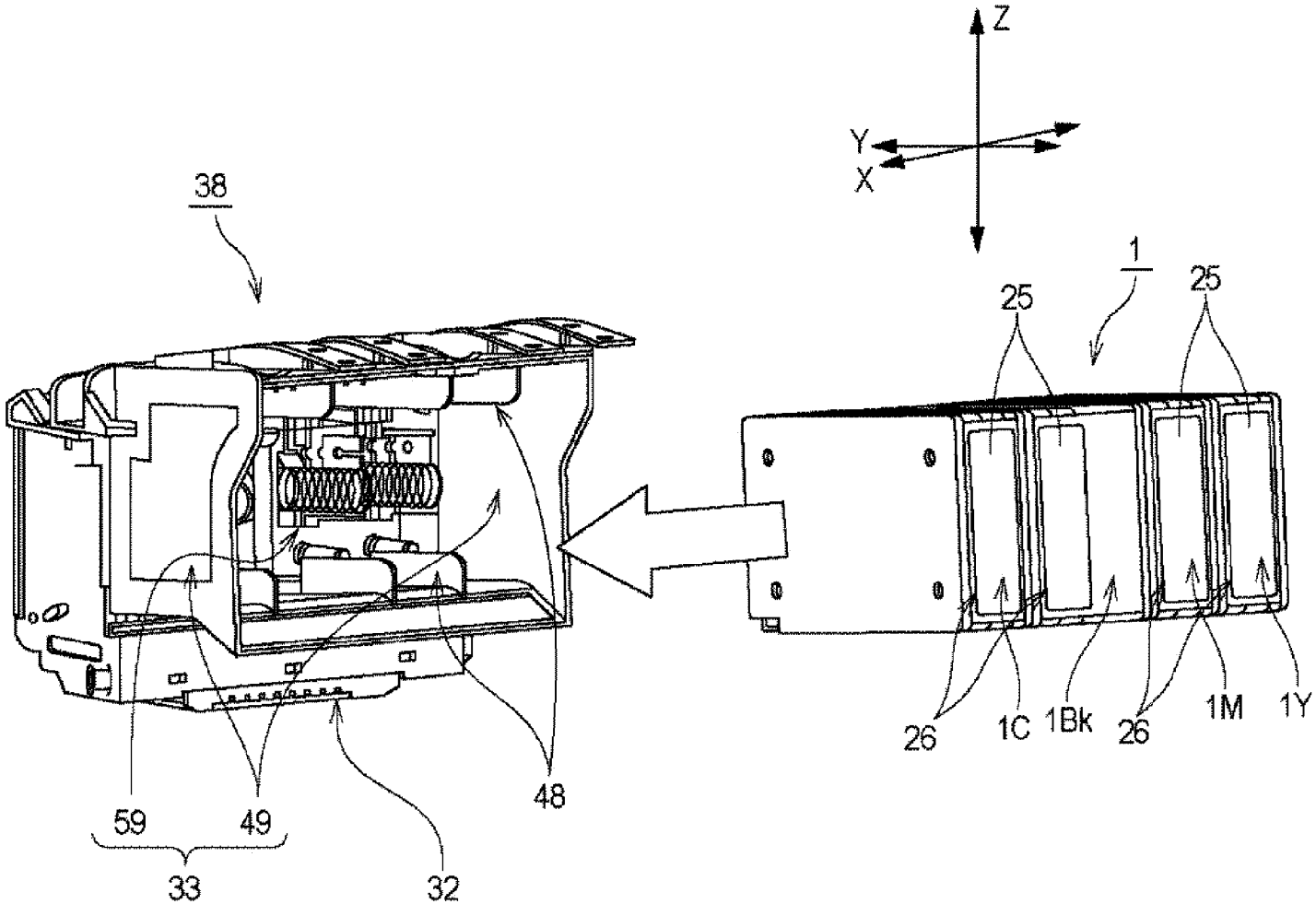
FIG. 6 is a perspective view illustrating a state before the ink cartridge is mounted to the mounting portion of a cartridge mounting unit.
Figure 8:
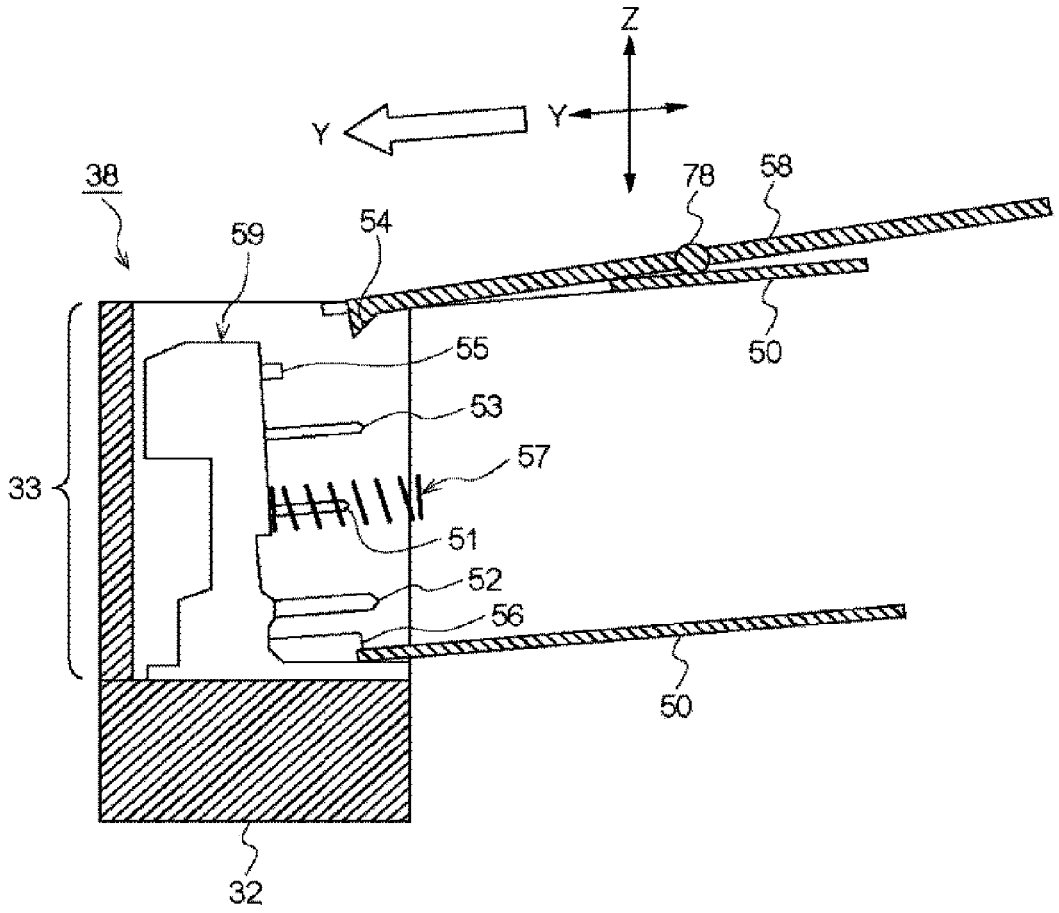
FIG. 8 is a sectional view of the cartridge mounting unit.

The carriage 31 is provided with a mounting portion (cartridge mounting portion or cartridge holder) 33 to which the ink jet head 32 and ink cartridge 1 are detachably mountable. In this embodiment, a head unit (cartridge mounting unit) 38 integrally including the ink jet head 32 and the mounting portion 33 is detachably mounted to the carriage 31, as shown in FIG. 6 and FIG. 8 which will be described hereinafter. The carriage 31 is movable along an X axis direction which is perpendicular to a feeding direction of a print medium 37.

On the mounting portion 33 of the carriage 31, ink cartridges 1C, 1Bk, 1M, 1Y containing cyan (C) ink, black (Bk) ink, magenta (M) ink and yellow (Y) ink, respectively can be detachably mounted. The ink cartridge 1Bk has a larger capacity than those of the other three ink cartridges 1C, 1M, 1Y. In addition, the ink jet head 32 is provided with respective color head portions for ejecting the cyan (C), black (Bk), magenta (M) and yellow (Y) inks supplied from the ink cartridges 1.

When a user mounts and dismounts or exchanges the ink cartridge 1 relative to such a carriage 31, the user opens the outer cover (unshown) covering the carriage 31 and the feeding means 34. When the printer main assembly detects the opening state of the outer cover, the carriage 31 moves to a cartridge exchange position (unshown). The user can insert the ink cartridge 1 into the carriage 31 placed in the cartridge exchange position, and can take the ink cartridge 1 out of the carriage 31 placed in the cartridge exchange position.

After the mounting and dismounting or the exchange of the ink cartridge 1, the user closes the outer cover, and then the closed state of the outer casing is detected. When the closed state is detected, the controller 35 of the printer main assembly reads the ink color information from the storing element of the ink cartridge 1 mounted to the carriage 31. The controller 35 discriminates whether or not the ink cartridges for all colors (four colors in this example) to be mounted to the carriage 31 are mounted, on the basis of the read ink color information. If the result of the discrimination indicates that an ink cartridge for a particular color is not mounted to the carriage 31, the controller 35 produces error display instructions to the operating portion and/or the external device to display an error message on the display panel of the operating portion (unshown) and/or the display portion of the external device (unshown). On the other hand, if the result of discrimination indicates that all the color ink cartridges to be mounted are mounted to the carriage 31, the ink jet printer becomes operable for printing.

When the print instructions is inputted to the controller 35 from the external device (unshown) or the operating portion (unshown), the controller 35 discriminates whether or not the printer is in the operable state. If it is in the operable state, the feeding means (unshown) picks up the print medium 37 stacked in the feeding cassette (unshown) and feeds the picked-up print medium 37 toward the feeding means 34. The feeding means 34 is provided with a platen for supporting the print medium at the bottom surface thereof, a feeding roller capable of intermittently feeding the print medium, driving means for rotating the feeding roller and so on, and feeds the print medium 37 toward the discharging tray (unshown). In the period between adjacent the feeding operations for the print medium 37, the carriage 31 moves above the print medium along the X axis direction perpendicular to the feeding direction of the print medium 37. During the movement of the carriage 31, the inks are ejected toward the print medium 37 from the ink jet head 32, so that an image is formed on the print medium. In this manner, an image is formed on the print medium by the repetition of the carriage movement and the print medium feeding.

In this embodiment, the head unit (cartridge mounting unit) 38 is detachably mounted to the carriage 31, but the present invention is not limited to such a structure. The ink jet head 32 and the mounting portion 33 may be detachably mounted to the carriage 31, individually. In addition, the mounting portion 33 may be integral with the carriage 31, and only the ink jet head 32 may be detachably mounted to the carriage 31. Furthermore, both of the ink jet head 32 and the mounting portion 33 may be integral with the carriage 31. It will suffice if the carriage 31 is capable of mounting the ink jet head 32, and the ink cartridge 1 is mountable and dismountable thereto.

<Ink Cartridge>

Referring to FIGS. 2-5, an example of the ink cartridge usable with the ink jet printer of FIG. 1 will be described. The four ink cartridges 1C, 1Bk, 1M, 1Y of this embodiment have the same fundamental structures with the exception that the kinds of the inks therein, the cartridge widths (the cartridge for the black color is wider than the other color cartridges) and the discrimination portions 9 which will be described hereinafter are different. Therefore, an ink cartridge 1M will be taken as a representative ink cartridge in the following description.

Figure 2:
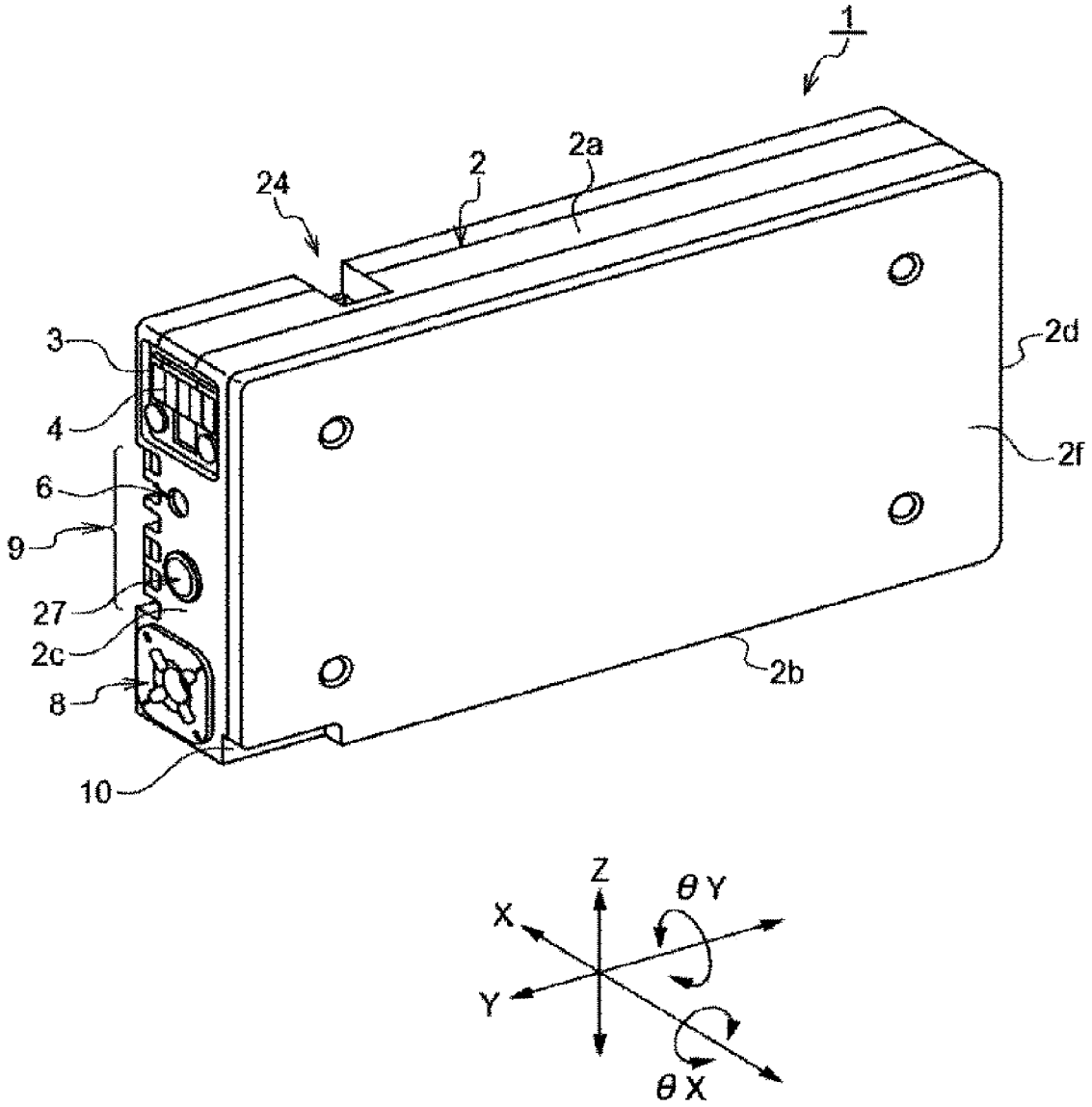
FIG. 2 is a perspective view of an outer appearance of the ink cartridge.
Figure 3:
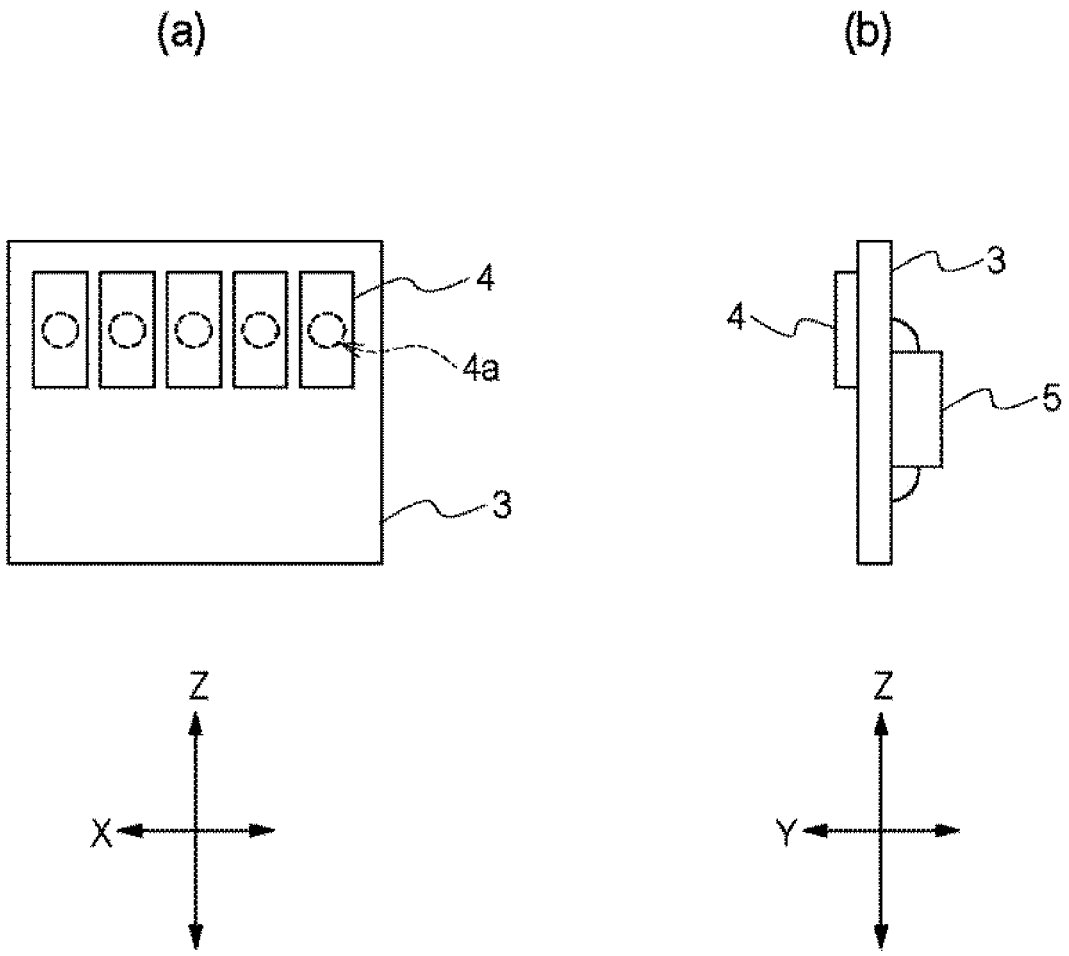
FIG. 3 illustrates an outer appearance of a substrate of the ink cartridge.
Figure 4:
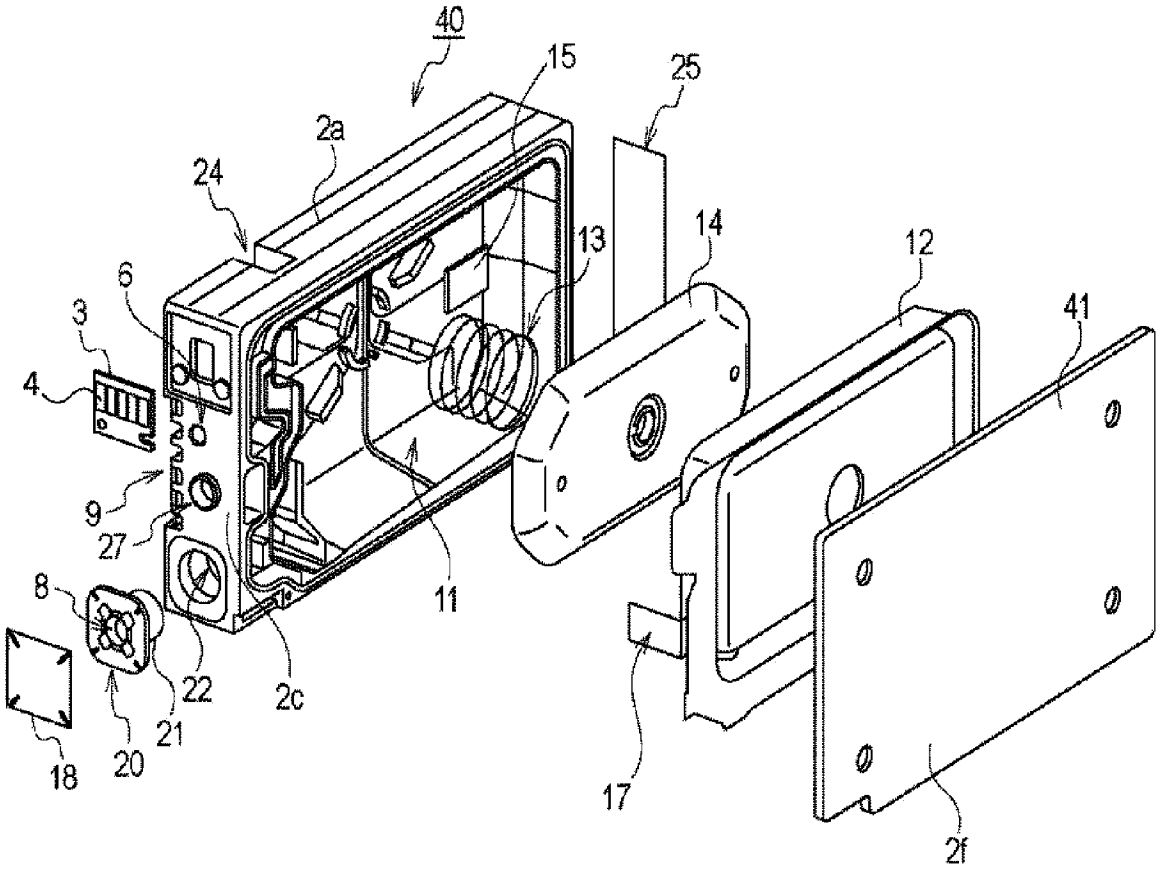
FIG. 4 is an exploded view of the ink cartridge.
Figure 5:
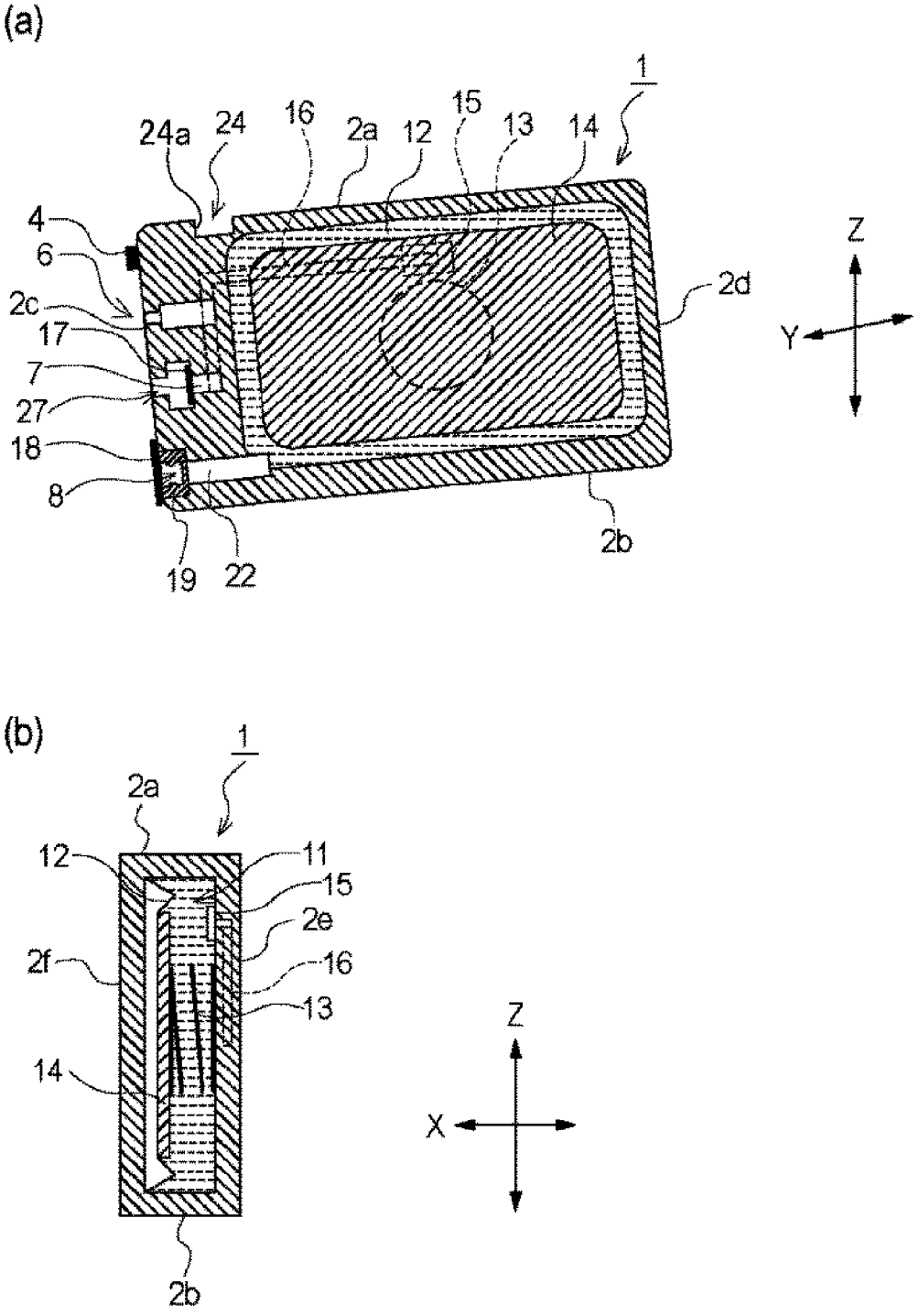
FIG. 5 illustrates a internal structure of the ink cartridge, in which a part (a) is a view of the ink cartridge as seen from a right-hand surface side along a X axis direction, and part (b) is a view of the ink cartridge as seen from a rear side along the Y axis direction.

FIG. 2 is a perspective view illustrating an outer appearance of the ink cartridge 1M according to a first embodiment. FIG. 3 illustrates an outer appearance of a substrate provided on the ink cartridge of FIG. 2, in which part (a) is a front view, and part (b) is a side view. FIG. 4 is an exploded view of the ink cartridge of FIG. 2. FIG. 5 illustrates an internal structure of the ink cartridge of FIG. 2, in which part (a) is a view of the ink cartridge as seen from a right-hand surface side along the X axis direction, and part (b) is a view of the ink cartridge as seen from the rear side along the Y axis direction.

(Casing)

As shown in FIGS. 2, 4 and 5, the ink cartridge 1 as the ink reservoir includes a casing (main assembly of the cartridge or container body) 2 of rectangular parallelepiped shape having an inside ink accommodating chamber 11.

The casing 2 comprises an upper surface 2*a* which is an outer wall surface of an upper wall thereof, a lower surface (bottom surface) 2*b* which is an outer wall surface of a lower wall (bottom wall) thereof, a plurality of side surfaces 2*c*-2*f* which are outer wall surfaces of side walls connecting the upper wall and the lower wall with each other. These upper wall, the upper surface, the bottom wall, the bottom surface, the plurality of side walls and the plurality of side surfaces are defined on the basis of the orientation (attitude) of the ink cartridge at the time when the ink cartridge is mounted to the mounting portion, that is, on the basis of the state in use.

The plurality of the side surfaces include a front surface (front side) 2*c* which is a first side surface, a rear surface (rear side) 2*d* which is a second side surface, a left surface 2*e* which is a third side surface connecting the first side surface and the second side surface with each other, and a right-hand surface 2*f* which is a fourth side surface connecting the first side surface and the second side surface with each other. The front surface 2*c* is on the leading side with respect to the mounting direction of the ink cartridge. The rear surface (rear side) 2*d* is on the trailing side with respect to the mounting direction of the ink cartridge and is at the opposite side of the front surface 2*c* across the ink accommodating chamber 11. The left surface 2*e* is on the left side as the ink cartridge is seen from a front side. The right-hand surface 2*f* is on the right side as the ink cartridge is seen from the front side and is at the opposite side of the left surface 2*e* across the ink accommodating chamber 11.

In this embodiment, the casing 2 is substantially in the form of a rectangular parallelepiped including six major surfaces or sides. The left surface 2*e* and the right-hand surface 2*f* of the six surfaces have the maximum area, and the front surface (front side) 2*c* and the rear surface 2*d* have the minimum area. The size relationships are the front surface 2*c* and the rear surface 2*d*<the upper surface 2*a*; and the lower surface (bottom surface) 2*b*<the left surface 2*e* and the right-hand surface 2*f*.

In this embodiment, the sizes of the casing 2 are approx. 4.7 cm in height (measured in the Z axis direction), approx. 8.4 cm in the depth (measured in the Y axis direction), and approx. 1.6 mm in the width (measured in the X axis direction). Therefore, an area of the left surface 2*e* (and the right-hand surface 2*f*) is approx. 39.48 (=4.7×8.4) cm^2. The area of the upper surface 2*a* (and the lower surface 2*b*) is approx. 13.44 (=1.6×8.4) cm^2. The area of the front surface (front side) 2*c* (and the rear surface (rear side)) is approx. 7.52 (=1.6×4.7) cm^2. The specific sizes of the height, the depth and the width are merely examples, and the sizes of the casing 2 of this embodiment are not limited to these examples.

Here, the first side wall having the first side surface which is the front surface 2*c* is called "front wall", the second side wall having the second side surface which is the rear surface 2*d* is called "rear wall", the third side wall having the third side surface which is the left surface 2*e* is called "left-hand wall" or "left wall", and the fourth side wall having the fourth side surface which is the right-hand surface 2*f* is called "right-hand wall". The front wall and the rear wall are opposed to each other across the ink accommodating chamber 11, and the left-hand wall and the right-hand wall are opposed to each other across the ink accommodating chamber 11.

In FIG. 2, the X axis direction is a widthwise direction of the ink cartridge 1, and is a moving direction of the ink cartridge 1 (moving direction of the carriage) in the state that the ink cartridge 1 is mounted on the carriage. The widthwise direction is in the direction from the right-hand surface 2*f* of the casing 2 toward the left surface 2*e* thereof. The Y axis direction is the depth direction of the ink cartridge, and is the mounting direction (inserting direction) and a dismounting direction (removing direction) of the cartridge. The depth direction is the direction from the front surface 2*c* of the casing 2 toward the rear surface 2*d* thereof. The Z axis direction is the height direction of the ink cartridge, and is the direction perpendicular to the X axis direction and to the Y axis direction. The height direction is the direction from the lower surface 2*b* of the casing 2 toward the upper surface 2*a* thereof. A θx direction is a rotational moving direction about the X axis, a θy direction is a rotational moving direction about the Y axis, and a θz direction is a rotational moving direction about the Z axis.

In this embodiment, the casing has the rectangular parallelepiped shape, and therefore, the X axis direction is perpendicular to the left surface 2*e* and the right-hand surface 2*f*, and the Y axis direction is perpendicular to the front surface (front side) and to the rear surface 2*d*, and the Z axis direction is perpendicular to the upper surface 2*a* and to the lower surface (bottom surface) 2*b*.

However, as will be described hereinafter, the configuration of the casing usable with this embodiment is not limited to the rectangular parallelepiped shape, and all or a part of the surfaces constituting the casing may be curved surface or inclined surface, for example. When the all or a part of the surface is a curved surface or an inclined surface, the X axis, the Y axis and the Z axis are not necessarily perpendicular to one another.

(Cartridge Side Interface Portion)

As shown in FIGS. 2, 4 and 5, the front surface 2*c* of the casing is provided thereon with a substrate 3 having electrical contacts 4, a positioning hole 6 as a positioning portion, a through-opening 27 as a penetrated portion, a tube inserting opening 8 as a tube inserting portion, and a discrimination portion 9. The electrical contact 4, the positioning hole 6, the through-opening 27, the tube inserting opening 8 and the discrimination portion 9 function as the cartridge side interface portion which are connected with or engaged with a printer main assembly side interface portion provided in the mounting portion 33.

The electrical contact 4, the positioning hole 6, the through-opening 27, the tube inserting opening 8 and the discrimination portion 9 are connected with or engaged with an electrical connecting portion 55, a positioning pin 53, an unsealing pin 51, an ink receiving tube 52 and a discrimination member 60 of the printer main assembly side interface portion, respectively. The details of the structures of the printer main assembly side interface portion will be described hereinafter in conjunction with FIG. 8, FIG. 9 and so on.

The structure of the ink cartridge, particularly the cartridge side interface portion will be described.

As shown in FIGS. 2, 4 and 5, the tube inserting opening 8 is disposed adjacent to the bottom side which is a lower portion (a portion closer to the bottom surface 2*b* than to the upper surface 2*a*) of the front surface 2*c* of the casing 2. The tube inserting opening 8 is disposed at one end portion of a tube insertion path 22, and the other end portion of the tube insertion path 22 is connected to the ink accommodating chamber 11. The tube insertion path 22 extends from one end portion to the other end portion along a cartridge depth direction (direction parallel with a normal line of a surface defining the tube inserting opening 8 or Y axis direction). In the example shown in FIG. 5, the entire portion of the hollow path from the one end portion to the other end portion extends along the cartridge depth direction (direction parallel with a normal line of a surface defining the tube inserting opening 8 or Y axis direction), but this embodiment is not limited to such an example. It will suffice if the tube insertion path 22 is capable of receiving the ink receiving tube 52 extending along the Y axis direction. For example, a hollow extending portion extending along the cartridge depth direction from the one end portion having the tube inserting opening 8 is provided only in a part of the tube insertion path 22.

As shown in FIGS. 4 and 5, the tube insertion path 22 is provided with a sealing member 19 as an elastic member. At a rear side end portion of the sealing member 19 (the side closer to the ink accommodating chamber 11 than the tube inserting opening 8), an opening and closing slit is provided, and the slit is closed when the ink receiving tube 52 is not inserted. In the state that the slit is closed, the tube inserting opening 8 and the ink accommodating chamber 11 are in non-fluid-communication state relative to each other. When the ink reception tube 52 is inserted into the tube insertion path 22, the slit is expanded to open, so that a fluid communication state is established between the ink reception tube 52 and the ink accommodating chamber 11, and an inner surface of the sealing member 19 elastically contacts to an outer peripheral surface of the ink receiving tube 52 to prevent leakage of the ink. By the insertion of the ink receiving tube 52 into the tube insertion path 22, the ink in the ink accommodating chamber 11 can be supplied into the ink receiving tube 52.

In the ink cartridge mounted state, the ink reception tube 52 is in the tube inserting opening 8, and therefore, the movement of the casing 2 is limited in the direction perpendicular to the cartridge mounting direction (X axis direction and Z axis direction, for example, which are along the front surface 2*c*). That is, the tube inserting opening 8 as the tube inserting portion functions also to suppress a positional deviation in a plane of the front surface 2*c*.

In this embodiment, a tube inserting opening (opening) is employed as the tube inserting portion, but the tube inserting portion is not limited to an opening. It will suffice if the tube inserting portion 8 permits the insertion of the ink receiving tube 52, and therefore, it is not necessarily open in the state prior to the insertion of the ink receiving tube 52. For example, the tube inserting portion 8 may be closed when the ink receiving tube 52 is not inserted, but is open only when the ink receiving tube 52 is inserted.

From the standpoint of the functions, the tube insertion path, the tube inserting opening and the tube inserting portion can be called as follows. For example, the tube insertion path 22 is a portion for receiving the ink receiving tube 52, and therefore, it can be called "tube receiving path". The tube inserting opening 8 is positioned at one end portion of the tube receiving path and functions to receive the ink receiving tube 52, and therefore, it can be called "tube receiving opening". The tube inserting portion 8 is positioned at one end portion of the tube receiving path and functions to receives the ink receiving tube 52, and therefore, it can be called "tube receiving portion".

From the standpoint of the functions, the tube insertion path, the tube inserting opening and the tube inserting portion can be called as follows. For example, the tube insertion path 22 functions to supply the ink from the inside of the ink accommodating chamber 11 to an outside (ink receiving tube 52) of the cartridge, and therefore, it can be called "ink supply path". The tube inserting opening 8 is positioned at one end portion of the ink supply passage and functions to supply the ink from the inside of the ink accommodating chamber 11 to an outside (ink receiving tube 52), and therefore, it can be called "ink supply opening". The tube inserting portion 8 is positioned at one end portion of the ink supply passage and functions to supply the ink from the inside of the ink accommodating chamber 11 to an outside of the cartridge (ink receiving tube 52), and therefore, it can be called "ink supplying portion".

From the standpoint of the functions, the tube insertion path, the tube inserting opening and the tube inserting portion can be called as follows. For example, the tube insertion path 22 is a discharging path capable of discharging the ink from the inside of the ink accommodating chamber 11 to an outside of the cartridge, and therefore, it can be called "ink discharging path". The tube inserting opening 8 is positioned at one end portion of the ink discharging path and is an opening capable of discharging the ink from the inside of the ink accommodating chamber 11 to an outside of the cartridge, and therefore, it can be called "ink discharge opening". The tube inserting portion 8 is positioned at the one end portion of the ink discharging path and is a portion capable of discharging the ink from the inside of the ink accommodating chamber 11 to a outside of the cartridge, and therefore, it can be called "ink discharging portion".

As shown in part (a) of FIG. 5, in the state before the ink cartridge 1 is mounted to the mounting portion 33, that is, in the unused state of the ink cartridge 1, a sealing film 18 as a sealing member is mounted on the portion around the tube inserting opening 8 to cover the tube inserting opening 8. The sealing film 18 (tube inserting opening sealing film, supply opening sealing film or tube reception opening sealing film) functions as ink leakage preventing means for preventing ink leakage before the start of use of the cartridge, that is, during transportation or the like. The sealing film 18 is pierced by the ink receiving tube 52 when the ink cartridge 1 is mounted.

The substrate 3 provided with an electrode pad as an electrical contact (cartridge side electrical contact) 4 is provided in a position above the supply opening 8 on the front surface 2*c* of the casing 2, more particularly, in the neighborhood of the upper surface 2*a*. As shown in FIG. 3, the substrate 3 is provided on the front surface thereof with a plurality of electrical contacts 4 and is provided on the back side thereof with a storing element 5. The electrical contact 4 and the storing element 5 are connected with electrical lines through a through hole of the substrate. Here, the back side of the substrate 3 means a surface facing toward the inside of the casing, and the front surface of the substrate 3 means a surface facing toward the outside of the casing. The configuration and the structure of the substrate 3 is not limited to particular ones, but it will suffice if they can properly support the electrical contact and the storing element 5. The substrate 3 may be a so-called glass-epoxy substrate in the form of a plate comprising a mixture of glass fibers and epoxy resin material on which wiring patterns are formed, or a so-called flexible substrate of a film on which the wiring patterns are formed.

The storing element 5 is an IC chip provided with an information storing portion (memory portion) and a control circuit. The information storing portion stores cartridge individuality information. The cartridge individuality information is information relating to a color of the ink accommodated in the ink accommodating chamber, information relating to an initial filling amount of the ink, information relating to an ink consumption amount supplied to the outside from the ink accommodating chamber, information relating to the date of manufacturing of the cartridge, and so on, for example. The structure of the information storing portion (memory portion) is not limited to a particular one, and it may be EEPROM, FeRAM or another element. On the other hand, the control circuit can analyze the information supplied from the controller 35 of the printer main assembly 30, can write information in the information storing portion, can read the information out of the information storing portion, and can output information to the controller 35. For example, the control circuit can analyze the ink consumption amount information and the ink color information supplied from the controller 35 and can write the ink consumption amount information and the ink color information in the information storing portion. In addition, the control circuit can read the ink color information and the ink consumption amount information out of the information storing portion and output the read information to the controller 35.

The electrode pad as the cartridge side electrical contact 4 is electrically connectable with an electrical terminal as a main assembly side electrical contact 55 (electrical connecting portion), and as shown in part (a) of FIG. 3, a part of the electrode pad 4 provides a contact position 4*a* relative to the electrical terminal 55. On the surface of the substrate 3, a plurality of electrical contacts (electrode pads) are provided. The plurality of electrical contacts 4 include a contact to which a clock signal is inputted from the printer main assembly, a contact at which the data of the ink consumption amount or the like are inputted and outputted, a contact to which electric power for operating the storing element is supplied from the printer main assembly, a contact connected with the ground, for example. In the example of FIG. 3, the number of the electrical contact is five, but the number is not limiting, and it can be increased or decreased depending on the necessity.

Figure 9:
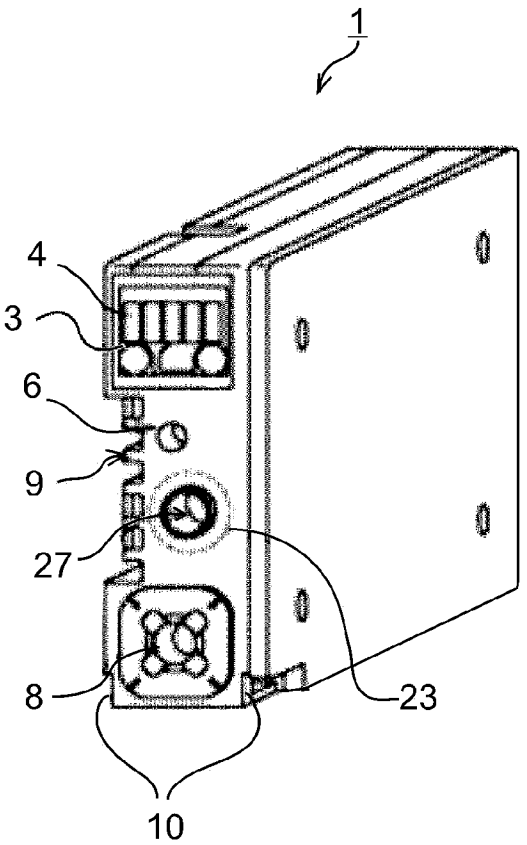
FIG. 9 is a perspective view illustrating a connection relation between the ink cartridge and a joint unit taken out of the cartridge mounting unit.
Figure 9:
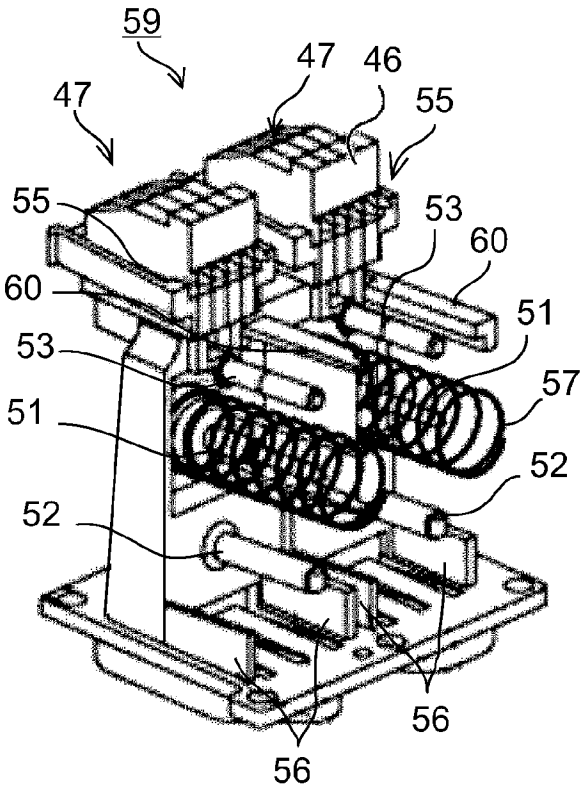

In this embodiment, it will suffice if the electrode pads 4 are disposed at the positions at which they are connectable with the electrical terminals 55 provided in the mounting portion 33 as indicated in FIG. 8 and FIG. 9 which will be described hereinafter. For this reason, it is preferable that the electrode pad 4 is provided on the surface (on the area of the substrate 3 crossing with the cartridge mounting direction, for example) crossing with the cartridge mounting direction (Y axis direction).

It is particularly preferable that the plurality of electrode pads 4 are arranged in a direction crossing with the height direction (Z axis direction) of the cartridge on the surface crossing with the above-described cartridge mounting direction. Furthermore, it is further preferable that the plurality of electrode pads 4 are arranged in the widthwise direction (horizontal direction) of the cartridge which is an example of the direction crossing with the height direction (Z axis direction) of the cartridge.

In the example of part (a) of FIG. 3, the plurality of electrode pads 4 are arranged along the cartridge widthwise direction (X axis direction) on the front surface 2*c* which is a XZ surface perpendicular to the cartridge mounting direction (Y axis direction), but this is merely an example of the preferable example. For example, the plurality of electrode pads 4 are arranged on a surface inclined relative to the XZ surface.

The arrangement of the electrode pad shown in part (a) of FIG. 3 can be expressed in various ways. For example, it can be said that the plurality of electrode pads 4 are arranged in the direction (horizontal direction, for example) crossing with the cartridge height direction (Z axis direction) in an area crossing with the cartridge depth direction (Y axis direction). In addition, it can be said plurality of electrode pads 4 are arranged in the direction (horizontal direction, for example) crossing with the cartridge height direction (Z axis direction) in an area crossing with a direction in which the tube insertion path 22 having the tube inserting opening 8 extends. In addition, the plurality of electrode pads 4 can be said are arranged in an area crossing with a direction parallel with a normal line of the formation surface/formation area of the tube inserting opening 8, along a direction (horizontal direction, for example) crossing with the cartridge height direction (Z axis direction). Furthermore, the polarity of the electrode pads 4 can be said are arranged in a area crossing with the direction parallel with a center line of the tube inserting opening 8, along the direction (horizontal direction, for example) crossing with the cartridge height direction (Z axis direction).

As described, the electrode pad 4 preferably includes (1) the area crossing with the cartridge mounting direction, (2) the area crossing with the Y axis direction, (3) the area crossing with the cartridge depth direction, (4) the area crossing with the direction parallel with the normal line of the formation surface of the tube inserting opening (ink discharge opening) 8, (5) the area crossing with the direction parallel with the direction in which the tube insertion path (ink discharging path) 22 extends, or (6) the area crossing with the direction parallel with the center line of the tube inserting opening (ink discharge opening).

By the connection between the electrode pad 4 and the electrical terminal 55, the storing element 5 of the ink cartridge 1 is electrically connected with the controller 35 of the printer main assembly 30. By this, the controller 35 becomes capable of reading out the information (the cartridge individuality information) stored in the storing element 5 by a known method. Similarly, the controller 35 becomes capable of writing the information (information relating to the ink consumption amount, for example) in the storing element 5.

As shown in FIGS. 2, 4 and 5, a positioning portion 6 is provided between the tube inserting opening 8 and the electrical contact 4 in the longitudinal direction (height direction) of the front surface 2*c* of the casing 2, more particularly in a position closer to the electrical contact 4 than to the tube inserting opening 8. That is, the positioning portion 6 is disposed at the position closer to the electrical contact 4 than to the tube inserting opening 8 above the tube inserting opening 8 and below the electrical contact 4. The positioning portion 6 is a portion into which a tapered columnar positioning pin 53 is inserted and is engageable with the positioning pin 53, so that the movement of the casing 2 in the direction (X axis direction and/or Z axis direction which are along the front surface 2*c*, for example) perpendicular to the cartridge mounting direction is limited. In this embodiment, the positioning portion 6 may have any structure if it can limit the movement of the cartridge in the direction (along the front surface 2*c*, for example) perpendicular to the cartridge mounting direction by the engagement with the positioning pin 53. For example, the positioning portion 6 may be a through hole portion penetrating the front wall, and a recess formed in the front wall on the like, and a positioning opening for receiving the positioning pin 53 is one of preferable examples. By the insertion of the ink reception tube 52 into the tube inserting opening 8, the movement of the cartridge is limited to a certain extent, but in this embodiment, the function of the high precision positioning of the ink cartridge to the mounting portion is effected by the positioning portion 6 and a position regulation surface 10 which will be described hereinafter.

As shown in FIGS. 4 and 5, an air vent 7 and the through-opening 27 are between the tube inserting opening 8 and the positioning portion 6 in the cartridge height direction. That is, the air vent 7 and the through-opening 27 are disposed above the tube inserting opening 8 and below the positioning portion 6.

Into the air vent 7 and the through-opening 27, the unsealing pin 51 is inserted. The through-opening 27 is a through hole provided in the front wall, and the unsealing pin can penetrate it. On the other hand, the air vent 7 is an opening provided at one end portion of an air vent path 16 in a rear side beyond the through-opening 27, more particularly, it is provided in an air vent formation wall which is an inner wall provided between the front wall and the ink accommodating chamber 11 in the cartridge depth direction. As will be described hereinafter, when the ink cartridge 1 is mounted to the mounting portion 33, the unsealing pin 51 is inserted through the through-opening 27 and is then inserted into the air vent 7 after penetrating the through-opening 27.

As shown in part (a) of FIG. 5, the one end portion of the air vent path 16 is the air vent 7 which is the opening formed in the air vent formation wall, and the other end portion of the air vent path 16 is connected with the ink accommodating chamber 11. In the connecting portion between the air vent path 16 and the ink accommodating chamber 11, a filter 15 having a meniscus force is provided. When a negative pressure in the ink accommodating chamber reaches a level exceeding the meniscus force of the filter by the consumption of the ink, the ambient air in the air vent path side breaks the meniscus of the filter 15 to flow into the ink accommodating chamber, thus establishing the fluid-communication state. In the fluid-communication state, the ambient air is taken into the ink accommodating chamber 11 through the air vent path 16 by the amount corresponding to the consumption of the ink out of the ink accommodating chamber 11, and therefore, the negative pressure in the ink accommodating chamber 11 is prevented from becoming too high. Therefore, it can be avoided that the ink supply from the ink accommodating chamber 11 to the outside is not impeded as a result of the too high negative pressure inside the ink accommodating chamber 11, and therefore, most of the ink can be used up out of the ink accommodating chamber.

As shown in part (a) of FIG. 5, in the state before the start of use of the ink cartridge 1, a sealing film 17 as a sealing member covers the air vent 7. The sealing film 17 will be called also "air vent sealing film". As shown in FIG. 4, the air vent sealing film 17 is bent by approx. 90° relative to the major surface of the flexible member 12 and is closely contacted to the air vent formation wall (the inner wall of the first casing member 40) so as to cover the air vent 7 provided in a first casing member 40. When the ink cartridge 1 is mounted, the air vent sealing film 17 is unsealed by the unsealing pin 51 inserted into the air vent 7 through the through-opening 27. In this embodiment, the air vent sealing film 17 is formed integrally with the flexible member 12, but the present invention is not limited to such a example, but the air vent sealing film 17 and the flexible member 12 may be separate members.

The air vent sealing film 17 functions as means for suppressing ink evaporation and/or ink leakage before the start of the use of the cartridge such as during transportation thereof. Therefore, it is preferable that the timing of the unsealing of the air vent sealing film 17 is immediately before the start of use of the ink cartridge. To assure this, in this embodiment, the air vent sealing film 17 is unsealed by the unsealing pin 51 of the printer main assembly, so that the air vent sealing film 17 is unsealed at the time of the mounting of the ink cartridge 1 to the printer main assembly.

In addition, in this embodiment, as shown in part (a) of FIG. 5, the air vent sealing film 17 is disposed in a rear side of the front surface 2*c*, more particularly in the position between the front surface and the ink accommodating chamber, which cannot be accessed by the user. Therefore, it can be avoided that the air vent sealing film 17 is removed by the user before the start of use of the cartridge.

The discrimination portion 9 mechanically functions to prevent the ink cartridge 1 from being mounted to a wrong mounting position (the position to which the cartridge of another ink color is to be mounted) and has unique configurations peculiar to the respective ink colors. As shown in FIG. 2 and FIG. 4, the discrimination portion 9 is provided with a recess at the position which is different if the color of the ink cartridge is different. Corresponding to the discrimination portion 9, a cartridge mounting portion 33 is provided with a projection as the discrimination member 60 (FIG. 9). The mounting portions have the projections at different positions so as to prevent mounting of wrong color ink cartridges. As shown in FIG. 2 and FIG. 4, the discrimination portion 9 is between the tube inserting opening 8 and the electrical contact 4 in the longitudinal direction (height direction) of the front surface 2*c* of the casing 2. More particularly, the discrimination portion 9 is provided along the longitudinal direction, and the arranging range thereof is wider than the distance between the positioning portion 6 and the through-opening 27.

As shown in FIG. 2 and FIG. 4, a circumference of the through-opening 27 in the front surface 2*c* of the casing 2 is projected into a cylindrical shape. The projected portion and the neighborhood thereof function as an ejection spring contact portion 23 which can be contacted by an ejection spring 57 provided in the mounting portion 33, as will be described hereinafter (FIG. 9). The ejection spring contact portion 23 depicted by a broken line in FIG. 9 is urged in a cartridge dismounting direction by the ejection spring 57 in the state that the ink cartridge is mounted to the mounting portion. That is, the ejection spring contact portion 23 functions as a force receiving portion for receiving from the ejection spring 57 an urging force for urging the ink cartridge 1 in the dismounting direction or a force (external force) for moving the ink cartridge 1 in the dismounting direction. The position of the ejection spring contact portion 23 is between the electrical contact 4 and the tube inserting opening 8 in the cartridge height direction, more particularly, below the positioning portion 6 and above the tube inserting opening 8.

As described in the foregoing, the front surface 2*c* of the casing 2 is provided concentrically with cartridge side interface portions including the electrical contact 4, the positioning portion (positioning opening) 6, the through-opening 27, the tube inserting opening 8, the discrimination portion 9, the ejection spring contact portion (force receiving portion) 23 or the like. By the concentric arrangement of the cartridge side interface portions, the printer main assembly side interface portions can be concentrically arranged, so that the printer main assembly side interface portions can be made as a unit, which can be downsized.

The cartridge side interface portion is provided not only on the front surface 2*c* of the casing 2 but also on the upper surface 2*a* of the casing 2. The upper surface 2*a* of the casing 2 is provided with an engaging portion 24 engageable with a locking portion 54 of a locking lever 58 provided in the mounting portion 33 shown in FIG. 8. As shown in FIG. 2 and FIG. 5, the engaging portion 24 is in the form of a recess engageable with the locking projection as the locking portion 54 to retain the ink cartridge 1 in the mounting completion position against the urging force of the ejection spring 57. The engaging portion 24 functions as a locking portion for fixing the ink cartridge 1 to the cartridge mounting portion 33.

Figure 10:
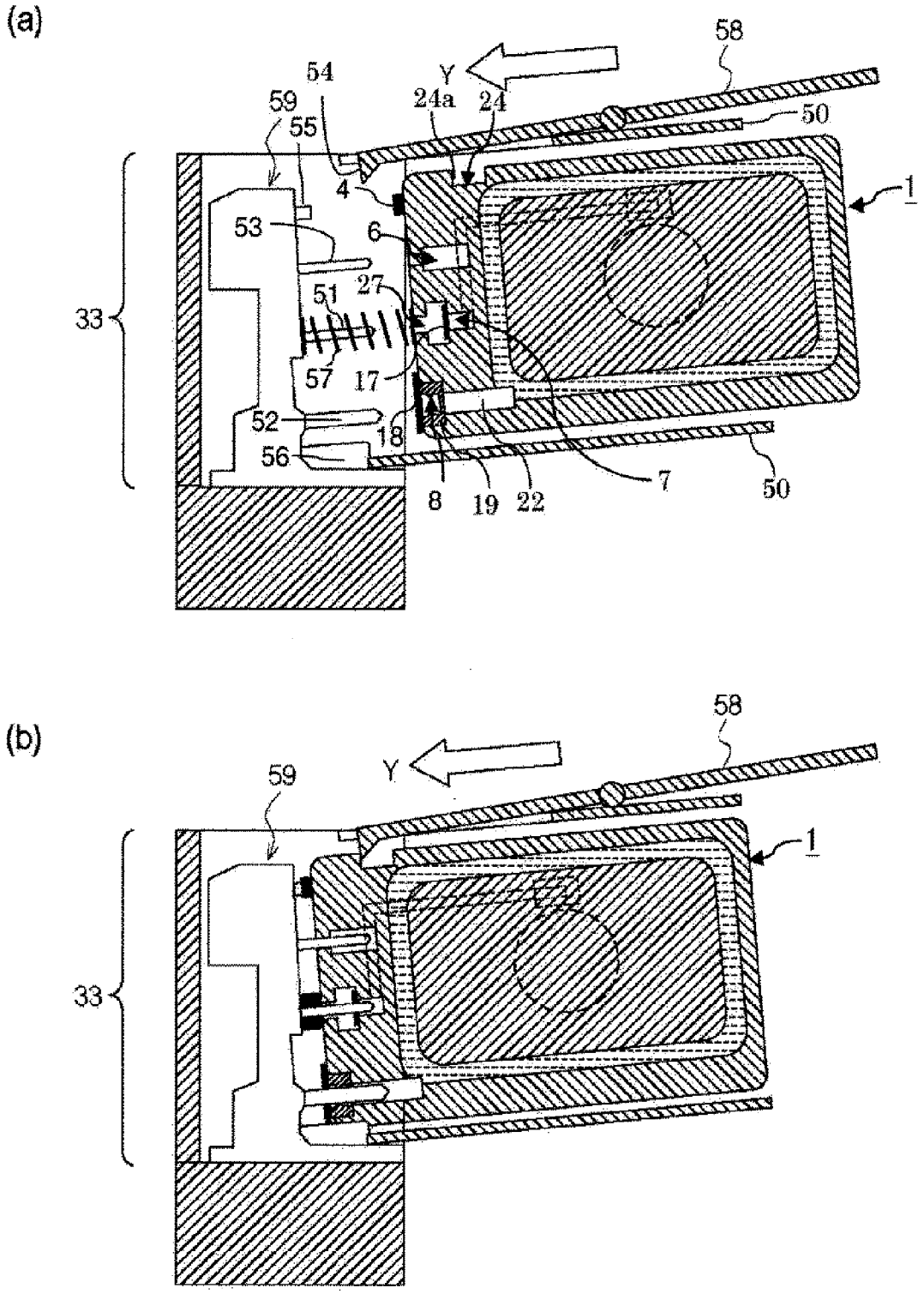
FIG. 10 illustrates a process of insertion of the ink cartridge into the mounting portion, in which a part (a) shows an initial state of the insertion, and part (b) shows a completed state of the insertion.

As shown in FIGS. 5 and 10, in this embodiment, the recess as the engaging portion 24 has a side which is an area 24*a* crossing with the Y axis direction, and at least a part of the area 24*a* contacts the locking projection 54. The area 24*a* is a surface crossing with the direction parallel with normal line of the electrical contact 4 or the normal line of the area on the substrate 3 provided with the electrical contact 4, more particularly in this embodiment, said area 24*a* is perpendicular to the direction parallel with the normal line. The area 24*a* is an area crossing with the direction parallel with the normal line of the formation surface of the ink discharge opening 8 and is an area crossing with the direction parallel with the direction in which the ink discharging path 22 extends. Furthermore, the area 24*a* is an area crossing with the direction parallel with the center line (a phantom line passing through the center of the ink discharge opening 8) of the ink discharge opening 8.

In the engaged state (locked state) between the engaging portion 24 and the locking portion 54, the connected state between the cartridge side interface portions and the printer main assembly side interface portions (the connected state between the electrical contact 4 and the electrical connecting portion 55, the connected state between the positioning portion 6 and the positioning pin 53 (engaged state between the positioning portion 6 and the positioning pin 53), the connected state between the tube inserting opening 8 and the ink reception tube 52 (the inserted state of the ink reception tube in the tube inserting opening 8), the fluid-communication state between the ink accommodating chamber 11 and the ink reception tube 52, or the like, for example) are maintained to retain the ink cartridge 1 in the mounting completion position. On the other hand, when the engaged state (locked state) between the engaging portion 24 and the locking portion 54 is released, the ink cartridge 1 is moved in the dismounting direction by the urging force of the ejection spring 57, and the connected state between the cartridge side interface portion and the printer main assembly side interface portion is also released. In this manner, the engaging portion 24 functions together with the locking portion 54 as the means for maintaining the connected state between the cartridge side interface portion and the printer main assembly side interface portion.

From another standpoint, the engaging portion 24 functions as a portion capable of receiving a regulating force for regulating movement of the casing 2 in the dismounting direction (the direction from the front surface toward the rear surface, for example) against the urging force of the ejection spring 57. In the case of this embodiment, the area 24*a* of the engaging portion 24 receives the regulating force from the locking projection 54 of the locking lever 58. In this manner, the engaging portion 24 is a regulating member for limiting the movement of the casing 2 caused by the force (external force) received from the outside of the ink cartridge 1.

As shown in FIG. 2 and FIG. 5, the engaging portion 24 is provided on the upper surface 2*a* of the casing 2. With the structure of this embodiment in which the engaging portion 24 is provided on the upper surface 2*a* of the casing 2, the distance between the engaging portion 24 and the electrical contact 4 is smaller than that in the case where the engaging portion is provided on the bottom surface of the casing, and therefore, even if positional deviation occurs about the engaging portion 24 with the locking operation, the positional deviation of the electrical contact attributable to the deviation can be reduced. Therefore, satisfactory electrical connection can be easily accomplished.

In this embodiment, the engaging portion 24 is disposed in a position closer to the electrical contact than to the tube inserting opening 8, and therefore, the satisfactory connection between the ink cartridge and the printer main assembly can be easily accomplished. That is, regarding the connection between the ink cartridge and the printer main assembly, the movement tolerable range of electrical contact in the front-rear direction (Y axis direction) is narrower than that of the tube inserting opening 8. In other words, the tolerance of the electrical contact 4 is smaller than that of the tube inserting opening 8, with respect to the deviation in the front-rear direction (Y axis direction) of the cartridge. On the other hand, upon the engagement (locking) between the engaging portion 24 and the locking portion 54, the movement may occur in the front-rear direction with the movement of the casing 2 about the engaging portion 24 in a θx direction. It is preferable that the positional relations between the engaging portion 24, the tube inserting opening 8 and the electrical contact are selected such that the movement distance of the electrical contact 4 of the casing 2 in the front-rear direction with the movement of the casing 2 in the θx direction about the engaging portion 24 is smaller than that of the tube inserting opening 8. In a example to accomplish this, the engaging portion 24 is disposed on the upper surface 2*a* of the casing 2, by which the engaging portion 24 is disposed closer to the electrical contact than to the tube inserting opening 8.

As shown in FIG. 2 and FIG. 5, the engaging portion 24 is disposed in a position closer to the front surface 2*c* than to the rear surface 2*d* in the longitudinal direction (depth direction) of the upper surface 2*a* of the casing 2. By disposing the engaging portion 24 in a position close to the electrical contact, the tolerance of the distance between the engaging portion 24 and the electrical contact 4 in the Y axis direction can be reduced, and therefore, the position tolerance of the electrical contact 4 relative to the engaging portion 24 in the front-rear direction (Y axis direction) upon the cartridge mounting can be reduced. When the position tolerance in the front-rear direction is small, the movable distance (stroke) of the electrical terminal 55 in the front-rear direction can be reduced in the design.

As shown in FIG. 2, the position regulation surfaces 10 adjacent to the bottom surface and adjacent to the front surface in the left surface 2*e* and the right-hand surface 2*f* of the casing 2 are contact surfaces contacting to a positioning wall 56 of the mounting portion 33 shown in FIG. 8 and FIG. 9 when the ink cartridge 1 is mounted to the mounting portion 33. The left and right position regulation surfaces 10 functions as position regulating means for regulating movement in the X axis direction and θy direction by contacting to the positioning wall 56. The ink cartridge of this embodiment is provided with the position regulation surfaces 10 in the left surface 2*e* and the right-hand surface 2*f*, but this is not restrictive to the present invention. For example, two grooves may be formed extending in the Y axis direction on the bottom surface 2*b* in the neighborhood of the front surface, and the side surfaces of the two grooves may function as the position regulation surfaces 10. What is required is that the position regulation surface 10 is effective to make a neighborhood of the bottom surface of the ink cartridge contact to the positioning wall 56 to limit the movement in the X axis direction and θy direction.

(Ink Accommodating Chamber)

The inside structures of the ink cartridge will be described particularly about the structure of the ink accommodating chamber. FIG. 4 is an exploded view of the ink cartridge shown FIG. 2. The casing 2 comprises a first casing member 40 including the upper surface 2*a*, the front surface 2*c*, the rear surface 2*d* and the left surface 2*e*, and a second casing member 41 including the right-hand surface 2*f* The second casing member 41 functions as a closing member for closing the opening of the first casing member 40. The ink accommodating chamber 11 is a chamber for accommodating the ink in the inside space defined by an internal wall surface of the first casing member 40 and the flexible member 12 (flexible sheet) welded to the inner wall edge of the first casing member 40.

A sealing member unit 20 is a member to be inserted into the tube insertion path 22 of the first casing member 40. The sealing member unit 20 includes a cylindrical sealing member 19 having an opening and closing slit at one end portion thereof and having an opening on the other end and an outer casing 21 integral with the outer peripheral surface of the sealing member 19. When the sealing member unit 20 is inserted into the tube insertion path 22, the opening at the other end constitutes the tube inserting opening 8.

Inside the ink accommodating chamber 11, there are provided a negative pressure generation spring 13 as a negative pressure producing member and a plate member 14 which is slightly smaller than the inner wall circumference of the first casing member 40. One end portion of the negative pressure generation spring 13 is engaged with the inner wall of the left surface 2*e* of the first casing member 40, and the other end portion of the negative pressure generation spring 13 is engaged with the plate member 14. The negative pressure generation spring 13 urges the flexible member 12 through the plate member 14 in the direction of expanding the ink accommodating chamber, by which the ink accommodating chamber is maintained under a predetermined range of the negative pressure. When the ink amount in the ink accommodating chamber decreases by the ink supply to the outside of the ink accommodating chamber 11, the negative pressure in the ink accommodating chamber 11 tends to increase, but the negative pressure generation spring 13 contracts, so that the plate member 14 moves in the direction of reducing the inside volume of the ink accommodating chamber 11, thus suppressing the increase of the negative pressure.

The space (non-ink-accommodating space) between the ink accommodating chamber 11 and the second casing member 41 is in fluid communication with the outside of the ink cartridge 1 through the fluid communication path (unshown) provided in the rear wall of the ink cartridge 1 and through the ambient air opening 26 (FIG. 6). More particularly, the rear wall of the ink cartridge 1 is provided with a snaking groove (unshown) having one end portion in fluid communication with the non-ink-accommodating space and the other end in fluid communication with the ambient air opening 26. The snaking groove is covered with a label 25 (FIG. 6), and the groove covered with the label 25 functions as the fluid communication path for fluid communication between the non-ink-accommodating space and the ambient air opening 26. Therefore, when the plate member 14 moves in the direction of reducing the inside volume of the ink accommodating chamber 11, the ambient air is introduced into the space (non-ink-accommodating space) between the ink accommodating chamber 11 and the second casing member 41 from the ambient air opening 26 through the fluid communication path (unshown).

By the movement of the plate member 14, the ink supply is carried out, but when the negative pressure in the ink accommodating chamber 11 exceeds the meniscus force as a result of further consumption of the ink, the air is introduced into the ink accommodating chamber 11 passing through the filter 15 from the air vent path 16, as described above. Subsequently, the ambient air is introduced into the ink accommodating chamber through the air vent path 16 by the amount corresponding to the supply of the ink, and therefore, the negative pressure in the ink accommodating chamber is maintained within a predetermined range, so that the negative pressure does not increase unnecessarily. By the introduction of the ambient air into the ink accommodating chamber from a certain stage of the ink supply, the almost all the ink in the ink accommodating chamber can be used up.

<Injection of Ink>

In this embodiment, the method of injecting the ink into the ink cartridge 1 is not limited to a particular method. For example, an empty ink cartridge (free of the tube inserting opening sealing film 18) as shown in FIG. 4 is prepared, and the ink can be injected through the tube inserting opening 8. After the ink injection, the tube inserting opening sealing film 18 is stuck on the front surface 2*c* of the casing 2.

In the case that the air vent sealing film 17 and the flexible member 12 are separate members as described hereinbefore, the ink cartridge can be manufactured through the following steps. First, an empty ink cartridge (free of the air vent sealing film 17 and the tube inserting opening sealing film 18) as shown in FIG. 4 is prepared. More particularly, a casing 2 comprising (i) the ink accommodating chamber 11, (ii) the air vent path 16 capable of introducing the air into the ink accommodating chamber 11, (iii) the through hole formation wall (front wall 2*c*) provided with the through hole 27 into which the unsealing pin 51 can be inserted, (iv) the air vent formation wall disposed between the through hole formation wall (front wall) and the ink accommodating chamber 11 and provided with the air vent 7 at the end portion of the air vent path 16 is prepared. Then, the air vent sealing film 17 which can be unsealed by the unsealing pin 51 having passed through the through hole 27 is stuck covering the air vent 17. Then, the ink is injected, and finally, the tube inserting opening sealing film 18 which can be unsealed by the ink receiving tube 52 is stuck on the front surface 2*c* of the casing 2. The ink cartridge 1 can be manufactured through such the steps, too.

<Cartridge Mounting Unit>

Referring to FIGS. 6-9, a cartridge mounting unit (head unit) 38 to which the ink cartridge 1 is detachably mountable will be described.

Figure 7:
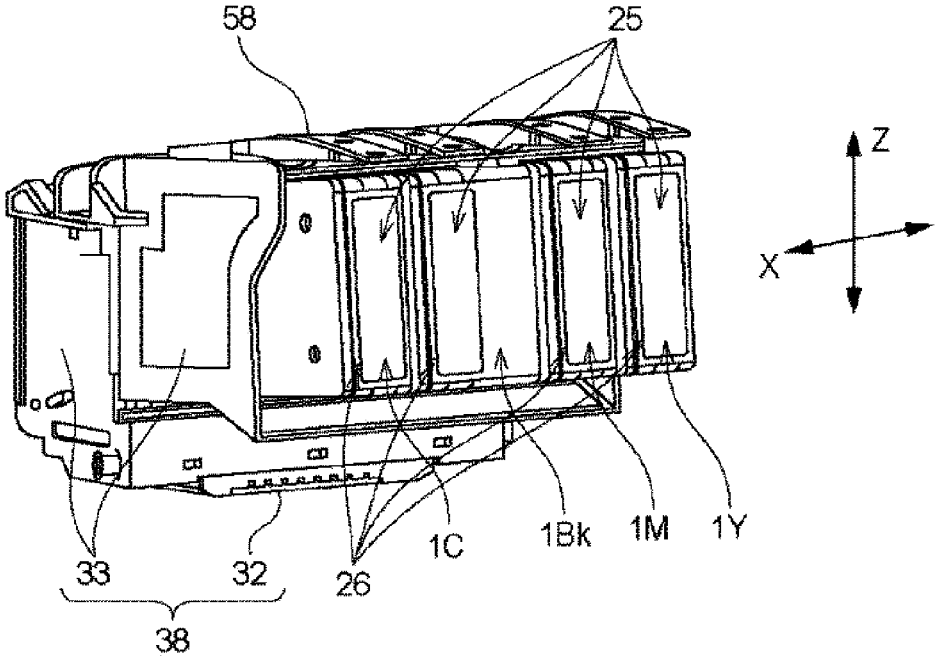
FIG. 7 is a perspective view illustrating a mounting completed state in which the ink cartridge has been mounted to the mounting portion of the cartridge mounting unit.

FIG. 6 is a perspective view illustrating a state before the ink cartridge 1 is mounted to the mounting portion 33 of the cartridge mounting unit 38 shown in FIG. 1. FIG. 7 is a perspective view in the state that the ink cartridge 1 has been mounted to the mounting portion 33 of the cartridge mounting unit 38 shown in FIG. 1. FIG. 8 is a sectional view of the cartridge mounting unit. FIG. 9 is a perspective view illustrating a connection relation between a joint unit (main assembly side connecting unit) 59 taken out of the cartridge mounting unit 38 of FIG. 8 and the ink cartridge 1. FIG. 9 illustrates the joint unit corresponding to two color ink cartridges.

As described hereinbefore, the cartridge mounting unit (head unit) 38 integrally comprises the ink jet head 32 and the cartridge mounting portion 33 and is detachably mountable to the carriage 31 of FIG. 1. As shown in FIGS. 6 and 8, the mounting portion 33 comprises a frame 49 constituting a generally rectangular parallelepiped outer configuration having an open front surface and a joint unit 59 provided in the rear side of the frame. The ink cartridges 1 are accommodated in the inside space of the frame 49. As shown in FIGS. 6 and 7, the four ink cartridges 1C, 1Bk, 1M, 1Y are arranged in the X axis direction. The black ink cartridge 1Bk has a larger width than the other color ink cartridges 1C, 1M and 1Y, and therefore, the mounting region for the black ink cartridge has a larger width than the other mounting regions.

As shown in FIG. 6, the ink cartridge 1 is mounted (inserted) in the Y axis direction perpendicular to the moving direction (X axis direction) of the carriage. A white arrow in FIG. 6 depicts the mounting direction (inserting direction) of the ink cartridge, and the ink cartridge dismounting direction is the opposite. In this embodiment, the cartridge mounting direction (Y axis direction) is the direction crossing with the direction of gravity (vertical direction), and in this example, it is inclined by an angle 5° relative to the horizontal surface crossing with the direction of gravity, and therefore, it is not completely horizontal direction, but substantially horizontal direction.

As shown in FIGS. 6, 8 and 9, the mounting portion 33 is provided with the joint unit 59 having the printer main assembly side interface portion. The joint unit 59 includes the unsealing pin 51 having a pointed free end and extended from a surface to oppose the front surface 2*c* of the ink cartridge, the ink reception tube 52 in the form of a tapered cylindrical hollow needle having a opening at the free end, the tapered cylindrical positioning pin 53, an electrical terminal 55, a positioning wall 56, the ejection spring 57 and the discrimination member 60 in the form of a projection. The unsealing pin 51, the ink reception tube 52, the positioning pin 53 and the discrimination member 60 are arranged in the Y axis direction, and the ejection spring 57 is contractable and expandable in the Y axis direction.

The unsealing pin 51 is an unsealing member for unsealing the air vent sealing film 17 piercing the air vent sealing film 17 upon the mounting of the ink cartridge 1. In this embodiment, the unsealing pin 51 is first inserted through the through-opening 27 and then through the air vent sealing film 17 into the air vent 7.

The ink receiving needle as the ink reception tube 52 is an ink receiving member for piercing the tube inserting opening sealing film 18 to unseal it, and insertable into the tube inserting opening 8 to connect with the tube insertion path 22, thus receiving the ink through the tube insertion path 22. The ink receiving tube 52 is in fluid communication with the ink jet head 32 to supply the ink received through the tube insertion path 22 into the ink jet head 32. That is, the ink receiving tube 52 functions as an ink supply tube for supplying the ink into the ink jet head 32. In this example, the ink receiving tube 52 is in the form of a tapered hollow cylindrical needle having the opening at the free end, but the present invention is not limited to such a configuration, and it will suffice if it is a hollow member capable of being inserted through the tube inserting opening 8 and having an opening capable of receiving the ink from the ink cartridge 1. The position of the opening is not necessarily at the free end, and the configuration is not necessarily a tapered cylinder.

The positioning pin 53 is a position regulation member insertable into the positioning portion 6 to limit the movement of the casing 2 in the direction (X axis direction and/or Z axis direction which is the direction along the front surface 2*c*, for example) perpendicular to the mounting direction of the ink cartridge 1, by engagement with the positioning portion 6.

The electrical terminals 55 are the electrical connecting portions (main assembly side electrical contacts) electrically connectable with the electrode pads 4, and the number of the electrical terminals 55 corresponds to the number of the electrode pads 4. In this embodiment, five electrical connecting portions (electrical terminals) 55 are provided corresponding to the five electrode pads 4, but the numbers are not limited to five. It will suffice if a plurality of electrical connecting portions (electrical terminals) 55 are provided corresponding to the plurality of electrode pads 4. The electrical connecting portions (electrical terminals) 55 are electrically connected with the controller 35 of the printer main assembly 30.

As shown in FIG. 9, the electrical connecting portions (electrical terminals) 55 are provided in an electrical connection unit 47. The electrical connection unit 47 includes the plurality of electrical connecting portions 55, a supporting member 46 supporting the electrical connecting portions 55, and an urging spring (unshown) for urging the supporting member 46 in the cartridge dismounting direction. The electrical connection unit 47 constitutes a part of the joint unit 59. The electrical connecting portions 55 disposed in an upper portion of the joint unit 59 are provided in the position capable of opposing the electrode pads 4 in the Y axis direction. The electrical connecting portions 55 are movable in the Y axis direction in interrelation with the expansion and contraction of the urging spring (unshown). More particularly, when the electrical connecting portion 55 is not in contact with the electrode pad 4, the electrical connecting portion 55 is in a first position with respect to the Y axis direction. When the ink cartridge moves in the cartridge mounting direction (Y axis direction) in the mounting operation of the ink cartridge, the electrode pads 4 of the ink cartridge contact to the electrical connecting portions 55 placed in the first position. Thereafter, by further insertion of the ink cartridge toward the rear side of the mounting portion, the electrical connecting portions 55 move to a second position which is in the rear side of the first position while keeping the contact with the electrode pads 4. Taking the manufacturing error or the like into account, the electrical connecting portion 55 is movable to a third position which is in the rear side of the second position in the mounting portion. On the other hand, upon the dismounting of the ink cartridge, the electrical connecting portion 55 returns from the second position to the first position in the Y axis direction with the movement of the dismounting direction of the ink cartridge, as is opposite from that in the mounting case. In this manner, the electrical connecting portions 55 are movable, and therefore, the contact pressure relative to the electrode pad 4 does not become unnecessarily high, thus suppressing the damage and/or failure of the electrode pad 4 and/or the electrical connecting portion 55.

As shown in FIG. 9, the positioning walls 56 are the position regulation members which are contactable to the position regulation surfaces 10 provided in the bottom end portion of the right-hand surface and the bottom end portion of the left surface of the ink cartridge 1 to limit the movement of the ink cartridge in the X axis direction and θy direction. Two positioning walls 56 sandwich the two position regulation surfaces from the left and right sides of the ink cartridge 1, so that the positional deviation of the ink cartridge adjacent to the bottom surface in the X axis direction and θy direction is suppressed.

The ejection spring 57 is an urging member for contacting to the ejection spring contact portion 23 of the front surface 2*c* of the ink cartridge and to elastically urge the ink cartridge 1 in the cartridge dismounting direction in order to dismount the ink cartridge 1 from the mounting portion 33. The ejection spring 57 is a coil spring provided so as to surround the unsealing pin 51 and expandable and contractable in the Y axis direction. The ejection spring 57 is in the expanded state when it is not contacted by the ink cartridge, and is contracted with the mounting of the ink cartridge. In the dismounting of the cartridge, the ink cartridge 1 is moved in the cartridge dismounting direction by the expansion of the ejection spring 57. By this movement, the connected state between the electrical contact 4 and the electrical connecting portion 55, the fluid-communication state between the ink accommodating chamber 11 and the ink receiving tube 52, the engaged state (connected state) between the positioning portion 6 and the positioning pin 53, the connected state between the tube inserting opening 8 and the ink receiving tube 52 (the state that the ink receiving tube 52 is inserted in the tube inserting opening 8) are broken, so that the ink cartridge is placed in a dismountable state.

In this example, the function of the ejection spring 57 is to break (1) connected state between the electrical contact 4 and the electrical connecting portion 55, (2) the fluid-communication state between the ink accommodating chamber 11 and the ink receiving tube 52, (3) the engaged state between the positioning portion 6 and the positioning pin 53 (the state that the positioning pin 53 is inserted in the positioning portion 6) and (4) the inserted state in which the ink receiving tube 52 is inserted in the tube inserting opening 8, are broken, in addition to the movement of the ink cartridge in the dismounting direction with the release of the engaged state between the engaging portion 24 and the locking portion 54. It is possible that the ink cartridge is dismounted even when a part of the ink receiving tube 52 remains in the tube insertion path 22, or a part of the positioning pin 53 remains in the positioning portion 6, for example, and the dismounting operation of the ink cartridge by the user is made easy if the ink cartridge is moved in the dismounting direction. It will suffice if the ejection spring 57 is capable of applying the urging force for moving the ink cartridge in the dismounting direction. Therefore, the force receiving portion 23 for receiving the urging force from the ejection spring 57 preferably receives from the ejection spring 57 the force urging the ink cartridge 1 in the dismounting direction to break the connected state, the fluid-communication state, the engagement and the inserted state, but such a structure is not restricted to the present invention, and it will suffice if the ink cartridge 1 is capable of receiving the force for moving the ink cartridge in the dismounting direction.

The discrimination member 60 is the projection configuration portion engageable with the recess which is the discrimination portion 9 of the ink cartridge. The positions of the projections of different mounting portions are different from each other to prevent mounting of non-corresponding color ink cartridges. That is, the discrimination member 60 engages with the discrimination portion 9 only of the corresponding color ink cartridge, and does not engage with a discrimination portion 9 of another color ink cartridge.

The above-described unsealing pin 51, ink receiving tube 52, positioning pin 53, electrical terminal 55, positioning walls 56, ejection spring 57 and discrimination member 60 are arranged in the positional relation shown in FIGS. 8 and 9. More particularly, the positioning wall 56, the ink receiving tube 52, the ejection spring 57, the positioning pin 53 and the electrical terminal 55 are arranged in the order named in the direction from the bottom to the top. In addition, the unsealing pin 51 is provided inside the ejection spring 57, and therefore, is disposed below the positioning pin 53 and above the ink receiving tube 52. Furthermore, the discrimination member 60 is disposed above the ink receiving tube and below the electrical terminal 55.

As shown in FIGS. 6 and 8, the mounting portion 33 of the cartridge mounting unit 38 is provided with the frame 49 constituting the inside space for receiving the ink cartridge 1, as well as the joint unit 59. The frame 49 is provided with a plate 48 for partitioning the space in the frame, and a locking lever 58 as a locking mechanism for fixing the ink cartridge 1 to the mounting portion 33. The frame 49 and the plate 48 function as a mounting guide 50 for regulating the attitude of the ink cartridge when it is mounted.

As shown in FIG. 6, the upper wall and bottom wall of the frame 49 are provided with respective plates 48 partitioning the inside space. The ink cartridges 1 are placed in the four spaces provided by the partition plates 48. The plates 48 are extended from the rear side toward the front surface of the frame 49. The plates 48 are arranged in parallel with each other at predetermined intervals in the X axis direction. The interval between the adjacent plates corresponds to the width of ink cartridge 1 to receive. The mounting guide 50 is constituted by the plates 48 and the bottom wall, the upper wall and the side walls of the frame 49, and the attitude of the ink cartridge is regulated by the mounting guide 50 in the mounting operation of the ink cartridge.

As shown in FIG. 8, the locking lever 58 extends from the front surface toward the rear side of the mounting guide 50, and a supporting shaft 78 is provided in the neighborhood of the center thereof in the extending direction. The supporting shaft 78 is rotatably supported by the upper part mounting guide 50 provided by the upper wall of the frame 49, and the locking lever 58 is rotatable about the supporting shaft 78. A rear side end portion of the locking lever 58 is provided with a locking projection as the locking portion 54 engageable with the engaging portion 24 of the ink cartridge 1. A push-up spring (unshown) is provided between the upper part mounting guide 50 and a lower surface portion of the locking lever 58 in the opposite side from the locking projection 54 across the supporting shaft 78. The push-up spring urges the locking lever 58 in the direction of pushing-up the locking lever portion in the opposite from the locking projection 54 across the supporting shaft 78, so that the locking projection 54 is in the inside space of the frame. When the locking lever 58 is free of an external force, a lower surface of a part between the locking projection 54 and the supporting shaft 78 in the locking lever 58 contacts the end portion of the upper part mounting guide 50, so that the locking lever 58 is prevented from rotating. With this attitude, the locking projection 54 is in a position (first position) in which it is contactable to the engaging portion 24 of the ink cartridge 1 being inserted into the mounting portion 33. When the ink cartridge 1 is inserted, the locking projection 54 contacts to the ink cartridge 1, by which the locking lever 58 rotates against the push-up force of the push-up spring, so that the locking projection 54 is moved to the second position above the first position. In the second position, the locking projection 54 contacts the upper surface 2*a* of the ink cartridge 1. Thereafter, when the engaging portion (engaging recess) of the recess configuration is moved to the position capable of contacting to the locking projection 54 as a result of the further insertion of the ink cartridge 1, the locking projection 54 is moved to the first position by the push-up force to engage with a side surface 24*a* of the engaging recess 24. By this, the ink cartridge 1 is fixed to the mounting portion 33 against the urging force of the ejection spring 57, thus completing the mounting of the ink cartridge 1. In the engaged state between the locking projection 54 and the engaging recess 24, the connected state between the electrical contact 4 and the electrical connecting portion 55, the fluid-communication state between the ink accommodating chamber 11 and the ink receiving tube 52, the engaged state between the positioning portion 6 and the positioning pin 53 are maintained.

On the other hand, when the ink cartridge 1 is dismounted from the mounting portion 33, the user moves the locking lever 58 to disengage the locking projection 54 of the locking lever 58 from the engaging portion 24 of the ink cartridge 1. When the engaged state is released, the ink cartridge 1 is moved in the dismounting direction by the urging force of the ejection spring 57, by which the ink cartridge becomes dismountable.

<Mounting Operation and Dismounting Operation of Ink Cartridge>

FIG. 10 illustrates the process of mounting (inserting) the ink cartridge 1 into the mounting portion 33, in which (a) shows an initial state of insertion (initial state of mounting), and (b) shows an insertion completed state (completion of mounting).

As shown in part (a) of FIG. 10, in the initial stage of the mounting operation, the ink cartridge 1 is inserted along the inside of the mounting guide 50. When the ink cartridge 1 contacts to the ejection spring 57, the ink cartridge 1 receives the urging force of the ejection spring 57 thereafter, and therefore, if the insertion is stopped before the mounting is completed, the ink cartridge 1 is pushed back.

When the ink cartridge 1 this is further inserted against the urging force of the ejection spring 57, the recess of the discrimination portion 9 of the ink cartridge 1 is checked in effect as to whether or not it matches the projection of the discrimination member 60 of the mounting portion 33. If the correspondence (correspondence in the color) between the ink cartridge 1 and the mounting position is correct, the recess of the discrimination portion 9 and the projection of the discrimination member 60 are complementary with each other, and therefore, the ink cartridge 1 can be further inserted. On the other hand, if the correspondence (correspondence in the color) between the ink cartridge 1 and the mounting position is not correct, the recess of the discrimination portion 9 and the projection of the discrimination member 60 are not complementary with each other, and therefore, the ink cartridge 1 cannot been inserted any further. At this stage, the air vent sealing film 17 or the tube inserting opening sealing film 18 are not yet unsealed. Therefore, if the ink cartridge is inserted into a wrong mounting position, the air vent sealing film 17 and the tube inserting opening sealing film 18 are kept unsealed.

The ink cartridge 1 is further inserted after the engagement between the discrimination portion 9 and the discrimination member 60, the tube inserting opening sealing film 18 is unsealed by the free end of the ink receiving tube 52, and the ink receiving tube 52 is inserted into the tube inserting opening 8. Then, the positioning pin 53 is inserted into the positioning portion 6, and two position regulation surfaces 10 are sandwiched between the two positioning walls 56, so that the positional deviation is suppressed thereafter. By the two position regulation surfaces 10, the position regulation is effected at two positions adjacent to the bottom surface, and by the positioning portion 6, the position regulation is effected at one position above the two position regulation surfaces 10, so that the movement of the ink cartridge 1 is generally limited in the directions (X axis direction, Z axis direction) along the front surface (XZ flat surface) 2*c* of the ink cartridge 1 and the θy direction.

Subsequently, the air vent sealing film 17 is unsealed by the unsealing pin 51 piercing into the through-opening 27, and the unsealing pin 51 is inserted into the air vent 7. Then, the ink receiving tube 52 is inserted into the slit of the sealing member 19 provided in the tube insertion path 22, by which the ink accommodating chamber 11 and the ink receiving tube 52 are brought into fluid communication with each other. Thereafter, the electrical contacts 4 are brought into contact to the electrical connecting portion 55.

Finally, the ink cartridge is pushed in until the engaging portion 24 is engaged with the locking projection 54, by which the ink cartridge 1 is fixed, and the mounting operation is completed, as shown in part (b) of FIG. 10. The position shown in part (b) of FIG. 10 is the position where the mounting is completed.

On the other hand, as described hereinbefore, when the ink cartridge 1 is dismounted from the mounting portion 33, the locking lever 58 is rotated to disengage the locking projection 54 from the engaging portion 24. When the engaged state is disestablished, the ink cartridge 1 is pushed back by the urging force of the ejection spring 57 to the position shown in part (a) of FIG. 10.

The connection steps between the ink cartridge and the printer main assembly having been described in conjunction with FIG. 10 is a preferable example of this embodiment, and this embodiment is not limited to the ink cartridge which is to be mounted through the above-described connecting steps. This embodiment is applicable to an ink cartridge which is mounted through the steps different from those described above.

<Arrangement of Cartridge Side Interface>

As shown in FIG. 2, in this embodiment, the electrical contact 4 is disposed in a position above the tube inserting opening 8, that is, in the position closer to the upper surface 2*a* than to the tube inserting opening 8 in the cartridge height direction. With this position in relationship, even if the ink leaks from the tube inserting opening 8, the contact of the ink to the electrical contact 4 can be suppressed. If the relationship between the tube inserting opening 8 and the electrical contact 4 is the opposite, that is, if the tube inserting opening 8 is disposed above the electrical contact 4, the ink receiving tube 52 of the printer main assembly side is also above the electrical connecting portion 55. Then, the ink draining from the ink receiving tube 52 contact to the electrical connecting portion 55*c*, and the ink may be transferred onto the electrical contact 4, but according to this embodiment, no such a problem arises.

In this embodiment, the electrical contacts 4 are provided on the surface crossing with the inserting direction of the cartridge (XZ surface perpendicular to the Y axis direction in the example of FIG. 2), and therefore, the amount of rubbing between the electrical contacts and the electrical terminals 55 is smaller than that in the case in which the electrical contacts 4 are provided on the surface (right-hand surface, left surface, upper surface or bottom surface) parallel with the inserting direction of the cartridge. Therefore, the disadvantages which may arise significant rubbing between the electrical terminals 55 can be suppressed. For example, with the structure in which the electrical contacts 4 are provided on the surface parallel with the cartridge inserting direction, the electrical terminals 55 relatively significantly rub the electrical contacts 4. Therefore, when the mounting and dismounting of the ink cartridge is repeated, the electrical terminals 55 may be worn with the possible result of adverse influence to the electrical connection therebetween. However, according to this embodiment, the amount of the rubbing between the electrical terminals 55 and the electrical contacts 4 is small, and therefore, the deterioration of the reliability in the electrical connection therebetween attributable to the wearing of the electrical terminals can be easily suppressed.

As shown in FIG. 2 and FIG. 5, in this embodiment, the engaging portion 24 as the locking portion for fixing the ink cartridge 1 to the cartridge mounting portion 33 is provided on the upper surface 2*a* of the casing 2. With this structure in which the engaging portion 24 is provided on the upper surface 2*a* of the casing 2, the distance between the engaging portion 24 and the electrical contact 4 is smaller than that in the case in which the engaging portion is provided on the bottom surface of the casing, and therefore, even if the positional deviation about the engaging portion 24 with the locking action occurs, the positional deviation of the electrical contact resulting from the positional deviation can be suppressed. Therefore, satisfactory electrical connection can be easily accomplished.

In this embodiment, the engaging portion 24 is disposed in a position closer to the electrical contact than to the tube inserting opening 8, and therefore, the satisfactory connection between the ink cartridge and the printer main assembly can be easily accomplished. That is, regarding the connection between the ink cartridge and the printer main assembly, the movement tolerable range of electrical contact in the front-rear direction (Y axis direction) is narrower than that of the tube inserting opening 8. In the other words, the tolerance of the electrical contact 4 is smaller than that of the tube inserting opening 8, with respect to the deviation in the front-rear direction (Y axis direction) of the cartridge. On the other hand, upon the engagement (locking) between the engaging portion 24 and the locking portion 54, the movement may occur in the front-rear direction with the movement of the casing 2 about the engaging portion 24 in a θx direction. It is preferable that the positional relations between the engaging portion 24, the tube inserting opening 8 and the electrical contact are selected such that the movement distance of the electrical contact 4 of the casing 2 in the front-rear direction with the movement of the casing 2 in the θx direction about the engaging portion 24 is smaller than that of the tube inserting opening 8. In order to accomplish this, it is preferable that the engaging portion 24 is provided on the upper surface 2*a*, so that the engaging portion 24 is disposed in the position closer to the electrical contacts 4 than to the tube inserting opening 8. If the engaging portion is provided on the bottom surface as disclosed in International Publication 2012-054050, the engaging portion is not closer to the electrical contact than to the tube inserting opening, and therefore, the above-described advantageous effects are not provided.

In addition, in this embodiment, as shown in FIG. 2 and FIG. 5, the engaging portion 24 is provided in a position closer to the front surface 2*c* than to the rear surface 2*d* on the upper surface 2*a* with respect to the depth direction. By disposing the engaging portion 24 in the position close to the front surface side on the upper surface 2*a*, the engaging portion 24 can be made closer to the electrical contacts 4 than in the case that the engaging portion 24 is disposed in a rear side on the upper surface 2*a*. By disposing the engaging portion 24 in a position close to the electrical contact, the variation of the distance between the engaging portion 24 and the electrical contact 4 in the Y axis direction can be reduced, and therefore, the positional variation of the electrical contact 4 relative to the engaging portion 24 in the front-rear direction (Y axis direction) upon the cartridge mounting can be reduced. When the position tolerance in the front-rear direction is small, the movable distance (stroke) of the electrical terminal 55 in the front-rear direction can be reduced in the design.

In this embodiment, the plurality of electrode pads 4 are arranged in the horizontal direction (widthwise direction of the cartridge, X axis direction) on the surface (preferably XZ surface) crossing with the cartridge mounting direction (Y axis direction). As described hereinbefore, when the ink cartridge is mounted, the movement of the cartridge in the direction (X axis direction or Z axis direction) along the front surface 2*c* and the θy direction are limited by the position regulation surface 10 provided adjacent to the bottom surface and the positioning portion 6 provided thereabove, when the ink cartridge is mounted. However, the movement in the θx direction occurs to a some extent. When the movement in the θx direction occurs, the lower end side of the substrate 3 is farther from the electrical connecting portion 55 in the Y axis direction than the upper end side. In other words, the deviation amount of the substrate 3 is larger in the lower end side than in the upper end side. Therefore, with the structure in which the plurality of electrode pads are arranged along the cartridge height direction (Z axis direction), the deviation amounts of the different electrode pads from the electrical terminal 55 are significantly different, and therefore, the contact pressures are different correspondingly, with the possible result of difficulty in assuring the stabilized electrical connection. If the entirety design is carried out to suit the contact pressure proper between the upper end side electrode pad of the substrate and the main assembly side electrical terminal 55, the contact pressure may be too low between the lower end side electrode pad and the main assembly side electrical terminal. On the other hand, if the entirety design is carried out to suit the contact pressure proper between the lower end side electrode pad of the substrate and the main assembly side electrical terminal 55, the contact pressure may be too high between the upper end side electrode pad and the main assembly side electrical terminal. If the main assembly side electrical terminals are designed to suit the respective electrode pads, the part have to be separate parts with the result in the increase in cost and design load. On the contrary, according to this embodiment in which the plurality of electrode pads are arranged in the horizontal direction (widthwise direction of the cartridge, X axis direction), even if the movement in the θx direction is produced, the deviation amounts from the electrical terminals 55 are not significantly different from each other, and therefore, the above-described disadvantages will not result.

With this structure of this example in which the movement in the θx direction may occur, the positional deviation may be produced in the Z axis direction. In this case, the size of the electrode pad is to be designed, taking the positional deviation in the Z axis direction into account. If the electrode pads are arranged along the Z axis direction, the substrate size in the Z axis direction is relatively large because of the size of the electrode pad. When the size of the electrode pad and/or the substrate is large, the possibility of deposition of the ink and/or foreign matter which may be a cause of the failure of the substrate increases, and in addition, the possibility of the user contacting the substrate also increases. Furthermore, the increase in cost arises. According to this embodiment, the substrate size measured in the Z axis direction can be made smaller than that in the case in which the electrode pads are arranged along the Z axis direction.

With the structure of this embodiment in which the electrical contacts 4 are arranged in the horizontal direction (widthwise direction of the cartridge, X axis direction), even if the ink or liquid deposited on the main assembly side electrical connecting portion 55 is transferred onto the electrical contacts of the ink cartridge, the possibility of the short circuit between the electrical contacts due to the bridge of the ink or liquid therebetween is lower than in the case in which the electrical contacts are arranged in the cartridge height direction (Z axis direction).

For example, when an empty cartridge from which the ink has been used up is dismounted, and a fresh cartridge is mounted, the user might remount the empty cartridge erroneously. If the liquid leaks from the empty cartridge when the empty cartridge is dismounted, the liquid or ink may be deposited on the electrical contact of the empty cartridge. Then, the liquid and/or ink deposited on the empty cartridge may be transferred onto the main assembly side electrical connecting portion 55. If the fresh cartridge is mounted thereafter, the liquid and/or ink now deposited on the main assembly side electrical connecting portion 55 may be transferred onto the electrical contact 4 of the fresh cartridge.

In another case, in the case of an ink jet printer with which the printing operation can be carried out under the condition that a great amount of ink mist is produced, the ink mist floating in the printer main assembly may be deposited on the printer main assembly side electrical connecting portion 55. If this occurs, when the fresh ink cartridge is mounted to the printer main assembly, the ink mist deposited on the electrical connecting portion 55 of the printer main assembly side may be transferred onto the electrical contact 4 of the cartridge. And, the ink transfer amount may be great.

In such a case, if the electrical contacts 4 are arranged in the cartridge height direction (Z axis direction), the liquid deposited on the upper side electrical contact 4 may fall to the lower side electrical contact 4 with the result of short circuit between the upper and lower electrical contacts 4. The short circuit may lead to a malfunction of the electrical contacts. On the other hand, according to this embodiment, the electrical contacts 4 are arranged in the widthwise direction (X axis direction) of the cartridge, and therefore, if the liquid deposited on the electrical contact 4 falls, the possibility of the short-circuit between the electrical contacts is lower than in the case that the electrical contacts 4 are arranged in the cartridge height direction (Z axis direction).

As shown in FIG. 9 and FIG. 10, in this embodiment, the ejection spring contact portion 23 is provided between the tube inserting opening 8 and the electrical contact 4 in the height direction of the front surface 2*c*. With this arrangement, the ejection spring contact portion 23 disposed in the position close to the tube inserting opening 8 receives the force from the ejection spring 57, and therefore, the ink receiving tube 52 can be easily removed from the sealing member 19 of annular rubber member provided in the tube insertion path 22. In this embodiment, the sealing member 19 of the annular rubber member is provided in the tube insertion path 22, and when the ink receiving tube 52 is inserted in the tube insertion path 22, the ink receiving tube 52 is press-contacted by the sealing member 19. Therefore, the press-contact state between the ink receiving tube 52 and the sealing member 19 is not easily broken than in the other interface portions. For the purpose of smooth disconnection between the ink receiving tube 52 and the sealing member 19, it is preferable that the ejection spring contact portion 23 is disposed in the position close to the tube inserting opening 8.

In this embodiment, the ejection spring contact portion 23 is disposed between the tube inserting opening 8 and the electrical contact 4, more particularly between the tube inserting opening 8 and the positioning portion 6, and therefore, the ejection spring contact portion 23 is not remote from the tube inserting opening 8, the electrical contact 4 and the positioning portion 6. Therefore, in addition to the disconnection between the ink receiving tube 52 and the sealing member 19, the smooth disconnection is easily accomplished as to the engagement between the positioning portion 6 and the positioning pin 53 and as to the connection between the electrical contact 4 and the electrical connecting portion 55.

In addition, as shown in FIG. 2, in this embodiment, the electrical contacts 4 are provided on the front surface 2C on which the positioning portion 6 and the tube inserting opening 8 are also provided, and therefore, the positional deviation of the electrical contacts 4 in the plane of the front surface 2*c* can be suppressed.

Furthermore, as shown in FIG. 2, in this embodiment, the positioning portion 6 is provided between the tube inserting opening 8 and the electrical contact 4, more particularly in the position closer to the electrical contact than to the tube inserting opening 8. Of the interface portions of the cartridge, the ones for which the highest positioning accuracy is required are electrical contacts 4, and the required positioning accuracy is higher in the electrical contacts 4 than in the tube inserting opening 8. On the other hand, the high precision positioning for the cartridge is effected by the positioning portion 6. Therefore, it is preferable that the positioning portion 6 is disposed adjacent to the electrical contact 4. In order to accomplish this, it is preferable that positioning portion 6 is provided in a position closer to the electrical contact than to the tube inserting opening 8. With such an arrangement, the electrical contact 4 can be positioned with high precision corresponding to the positioning precision provided by the positioning accuracy of the positioning portion 6, and therefore, the satisfactory electrical connection can be accomplished between the electrical contacts 4 and the electrical connecting portions 55.

<Wide Ink Cartridge>

Figure 11:
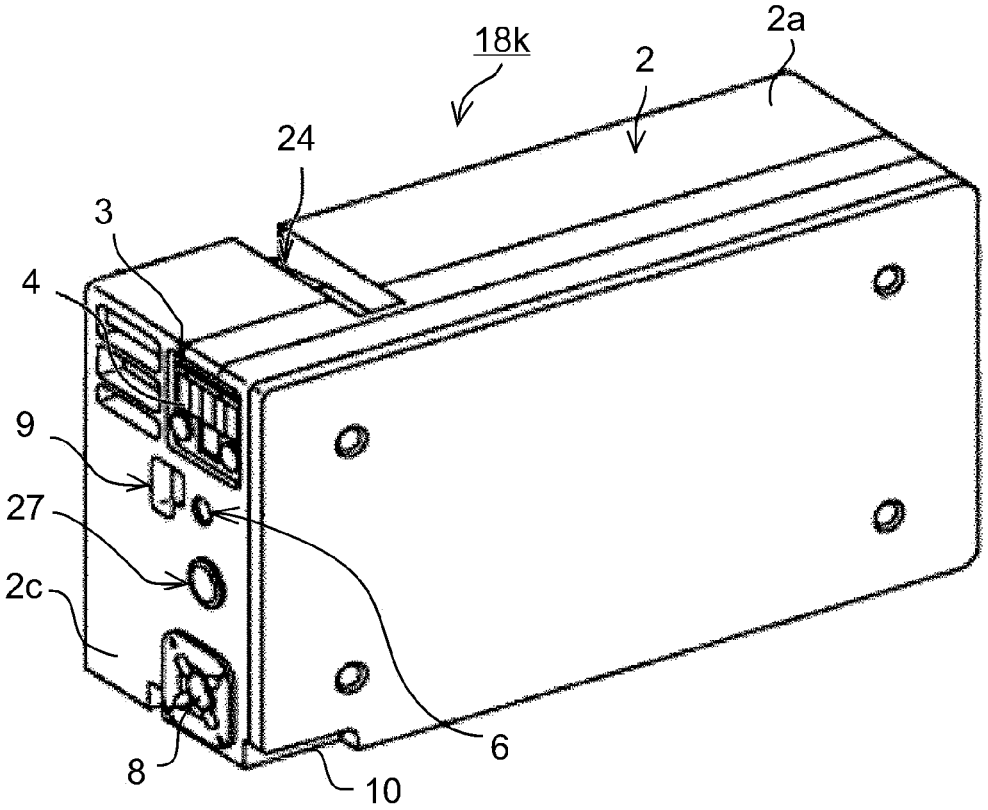
FIG. 11 is a schematic view of an ink cartridge 1BK applicable to a first embodiment of the present invention.
Figure 11:
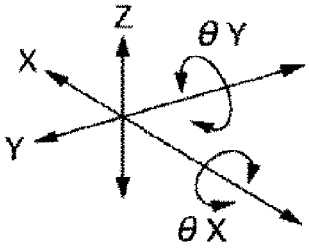

FIG. 11 is a schematic view of an ink cartridge 1BK according to the first embodiment. The basic structures of the black ink cartridge 1BK shown in FIG. 11 are substantially the same as the color ink cartridge 1M (1C, 1Y) shown in FIG. 2. For example, the heights and the depths are the same, and the kinds, the arrangements and the arrangement widths of the cartridge interface portions are also the same.

A major difference between the black ink cartridge 1Bk and the color ink cartridge is that the width of the black ink cartridge 1Bk is larger than those of the color ink cartridges, and that the cartridge interface portions are offset to one side (more particularly to the right side) of the front surface. By the offset structure, the width of the cartridge interface portions of the black cartridge is the same as those of the color cartridges. By this, the size and the general structure of the joint unit 59 can be made common between the black and the other colors.

[Modified Example of the First Embodiment]

The specific structures of the ink cartridge is merely an example of this embodiment, and this embodiment is not limited to the exemplary specific structures. It is possible to modify the structure of the ink cartridge of this embodiment in various aspects. Some of such modified examples will be described.

(Arrangement of the Electrical Contacts on the Substrate)

The arrangement of the electrical contacts (electrode pads) on the substrate of this embodiment is not limited to that shown in FIG. 3. For example, the arrangement of the electrode pads shown in FIG. 12 can be used in this embodiment.

Figure 12:
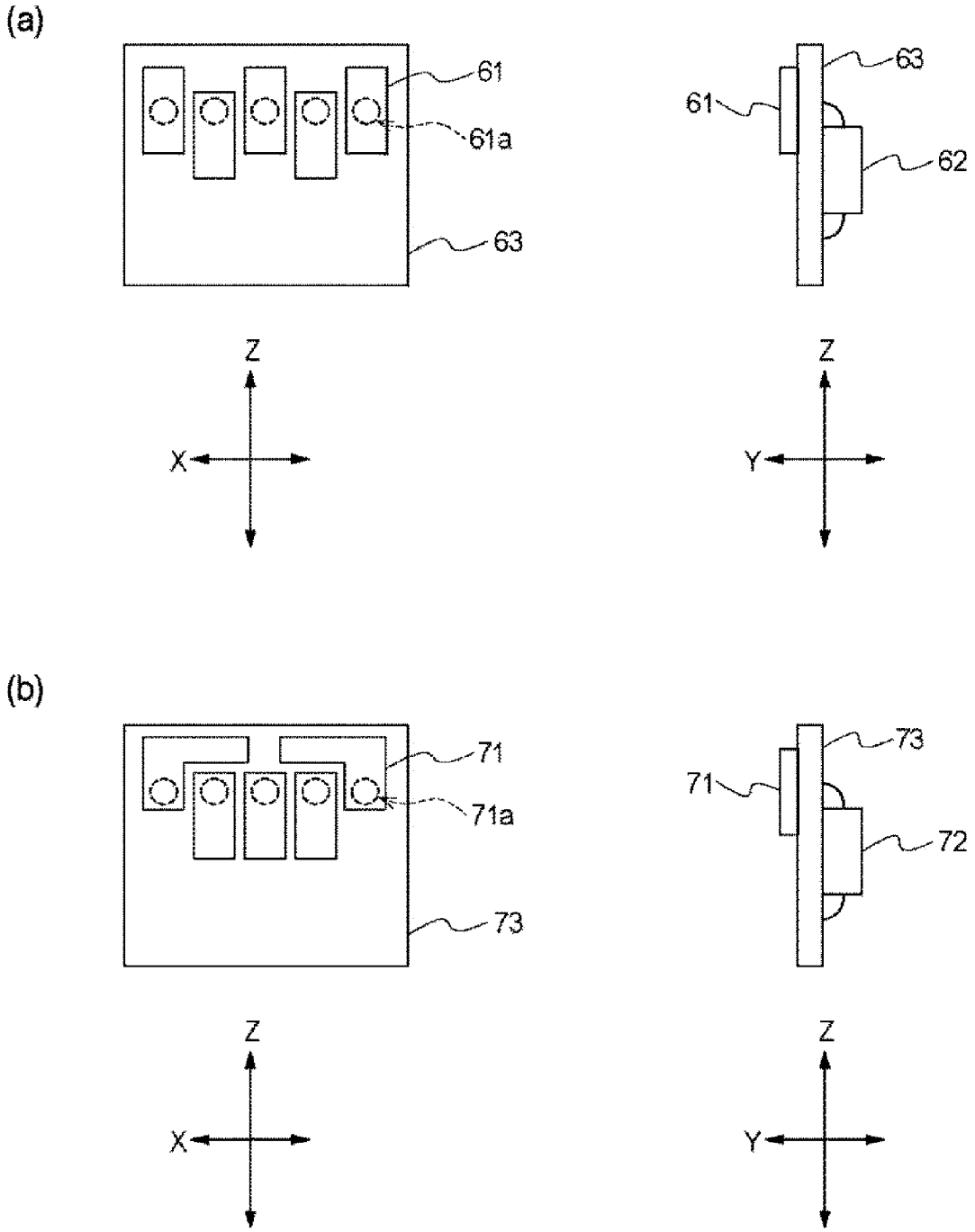
FIG. 12 illustrates an example of a position of an electrode pad on the substrate.

In FIG. 12, a plurality of electrode pads 61, 71 are arranged in the X axis direction (horizontal direction) on the XZ flat surface, similarly to FIG. 3. In part (a) of FIG. 12, the positions of the different electrode pads 61 are different in the Z axis direction, and in part (b) of FIG. 12, the configurations of different electrode pads 71 and the positions thereof in the Z axis direction are different. However, in these examples, the contact positions 61*a*, 71*a* relative to the electrical terminals 55 are arranged in the horizontal direction (X axis direction), similarly to FIG. 3. Therefore, similarly to FIG. 3, even if the movement of the ink cartridge in the θx direction occurs upon the mounting of the ink cartridge, the satisfactory electrical connection can be accomplished between the electrode pads 4 and the electrical terminals 55.

(Configuration of the Casing)

The configuration of the casing (body of the cartridge) 2 of this embodiment is not restricted to the rectangular parallelepiped shape shown in FIG. 2. Depending on the internal function, the outer casing, the design or the structure of the cartridge mounting portion 33, a part or all of the surfaces constituting the casing 2 (upper surface, bottom surface, side surfaces) may include at least one of a pit-and-projection, a stepped portion, a cut-away portion, a bent portion and an inclined portion.

Figure 13:
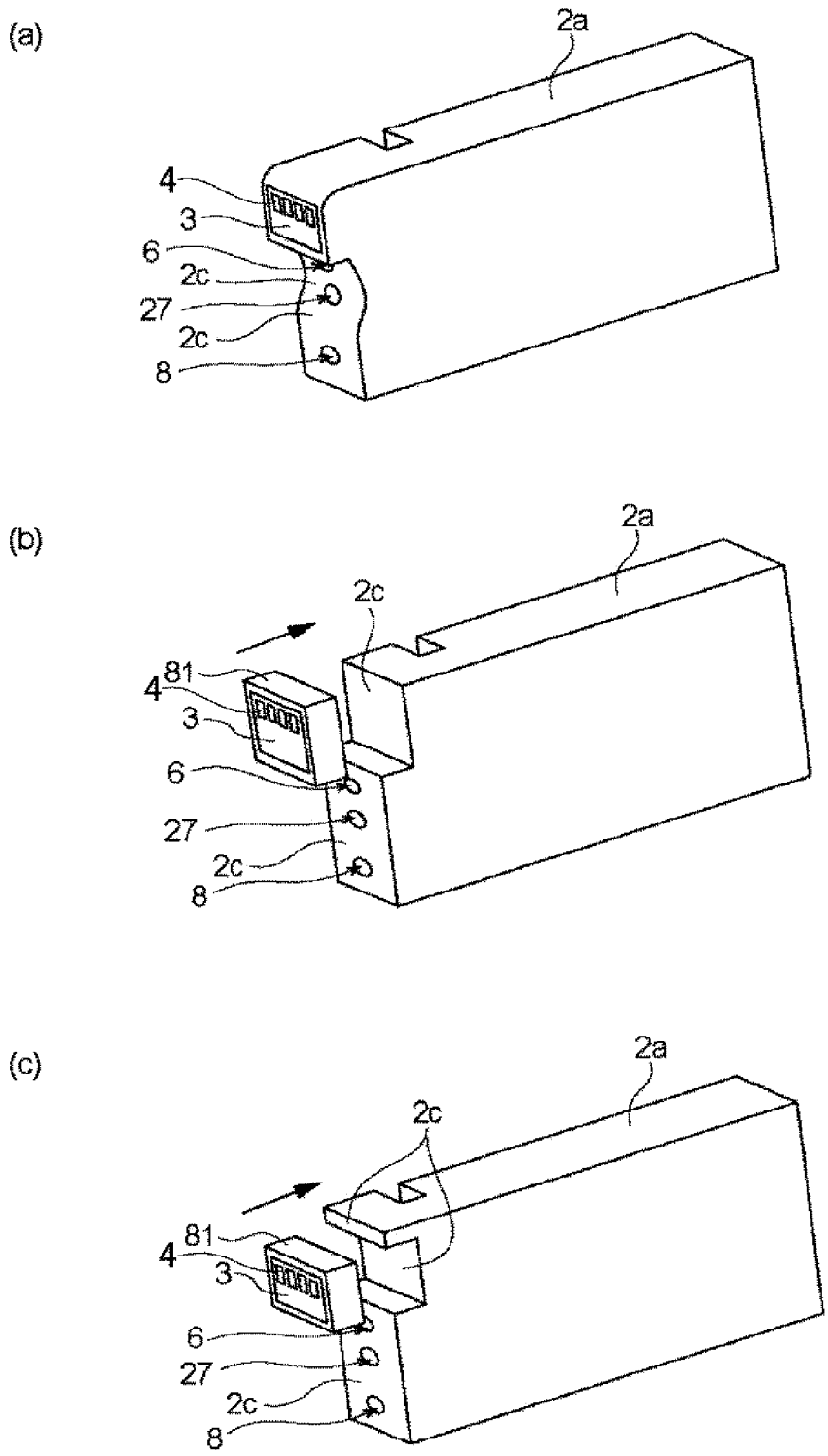
FIG. 13 illustrates an example of the arrangement and the mounting method of the substrate.

For example, as shown in part (a) of FIG. 13, a part of the front surface 2*c* may be curved. In the example of part (a) of FIG. 13, the electrical contact 4 is projected toward the front side beyond the opening (positioning opening) of the positioning portion 6, the through-opening 27 and the tube inserting opening 8, and the positioning opening 6 and the through-opening 27 are retracted toward the rear side beyond the tube inserting opening 8, and such a configuration is usable in this embodiment. In the example of part (a) of FIG. 13, the substrate 3 is provided on the front surface 2*c* of the casing 2, similarly to FIG. 3. In the example of part (a) of FIG. 13, the plurality of electrical contacts are provided on the area of the substrate crossing with the cartridge mounting direction (cartridge depth direction), similarly to the example of FIG. 3. Other examples are shown in part (b) and part (c) of FIG. 13, in which a cut-away portion and/or recess is provided in a part of the front surface 2*c*, and the substrate 3 is provided in the cut-away portion or recess. In the example shown in FIG. 13, the substrate 3 is provided directly on the front surface 2*c* including the tube inserting opening (8) formation region or indirectly thereon through a supporting member, and the electrical contacts 4 on the substrate include areas crossing with the direction parallel with the normal line of the tube inserting opening (8) formation region.

(Mounting Method of the Substrate)

In the mounting method for mounting the substrate 3 usable in this embodiment, the substrate 3 is directly mounted on the casing 2 as shown in FIG. 4, but the method is not restrictive to this embodiment, and the substrate 3 may be mounted to the casing 2 through another member. In a example, the substrate 3 is mounted on a substrate supporting member 81, and the substrate supporting member 81 is mounted on the casing 2, as shown in part (b) and part (c) of FIG. 13. In part (b) of FIG. 13, the casing 2 is cut away at a corner portion. The substrate 3 is provided on the substrate supporting member 81 having a configuration corresponding to the cut-away portion, and the substrate supporting member 81 is engaged with the cut-away portion to constitute an ink cartridge. As shown in part (b) of FIG. 13, the cut-away portion also constitutes the front surface 2*c* of the casing. The cut-away portion is not flush with the front surface 2*c* provided with the tube inserting opening 8, and the structure is usable. In part (b) of FIG. 13, the substrate 3 is mounted on the front surface 2*c* of the casing 2 through the substrate supporting member 81. The casing 2 shown in part (c) of FIG. 13 is cut away into a rectangular parallelepiped shape at the part of the front surface of the casing, and similarly to part (b) of FIG. 13, the substrate supporting member 81 provided with the substrate 3 is engaged with the cut-away portion (recess). As shown in part (c) of FIG. 13, the recess also constitutes the front surface 2*c* of the casing. Similarly, the substrate 3 is provided on the front surface 2*c* of the casing 2 through the substrate supporting member 81. As described, the substrate 3 may be electrically connected to the casing 2 and may be indirectly connected to the casing 2 through another member. In part (b) and part (c) of FIG. 13, similarly to FIG. 3, the substrate 3 is provided on the front surface 2*c* of the casing 2. In these examples of part (b) and part (c) of FIG. 13, the plurality of contacts are provided on the substrate crossing with the mounting direction of the cartridge (cartridge depth direction), and this is the same as with FIG. 3.

(Surface on which Electrical Contacts are Arranged)

The examples shown in FIG. 2 and FIGS. 11, 13 in which the electrode pads 4 as the electrical contacts are arranged on the surface parallel with the front surface 2*c* (XZ surface), are merely preferable examples of this embodiment, and the surface on which the electrode pads 4 are provided is not limited to the XZ surface.

As described hereinbefore, in this embodiment, it will suffice if the electrode pads 4 are provided in the position capable of connecting with the electrical terminals 55 shown in FIG. 9 and FIG. 10. For this purpose, the electrode pads 4 as the electrical contacts are preferably provided on (1) the surface/area crossing with the cartridge mounting direction, (2) the surface crossing with the Y axis direction, (3) the surface/area crossing with the cartridge depth direction, (4) the surface/area crossing with the direction parallel with the normal line of the formation surface/formation region of the tube inserting opening (ink discharge opening) 8, (5) the surface/area crossing with the direction parallel with the extending direction of the tube insertion path (ink discharging path) 22, or (6) the surface/area crossing with the direction parallel with the center line of the tube inserting opening (ink discharge opening). The above-described (1) surface/area crossing with the cartridge mounting direction, (2) surface/area crossing with the Y axis direction, (3) surface/area crossing with the cartridge depth direction, (4) surface/area crossing with the direction parallel with the normal line of the formation surface/formation region of the tube inserting opening (ink discharge opening) 8, (5) surface/area crossing with the direction parallel with the extending direction of the tube insertion path (ink discharging path) 22, and (6) surface/area crossing with the direction parallel with the center line of the tube inserting opening (ink discharge opening) are not limited to the XZ surface, but includes a surface inclined relative to the XZ surface. The electrical contact 4 is preferably provided with (1) the area crossing with the cartridge mounting direction, (2) the area crossing with the Y axis direction, (3) the area crossing with the cartridge depth direction, (4) the area crossing with the direction parallel with the normal line of the tube inserting opening (ink discharge opening) 8 formation surface, (5) the area crossing with the direction parallel with the extending direction of the tube insertion path (ink discharging path) 22, or (6) the area crossing with the direction parallel with the center line of the tube inserting opening (ink discharge opening).

[Second Embodiment]

Figure 14:
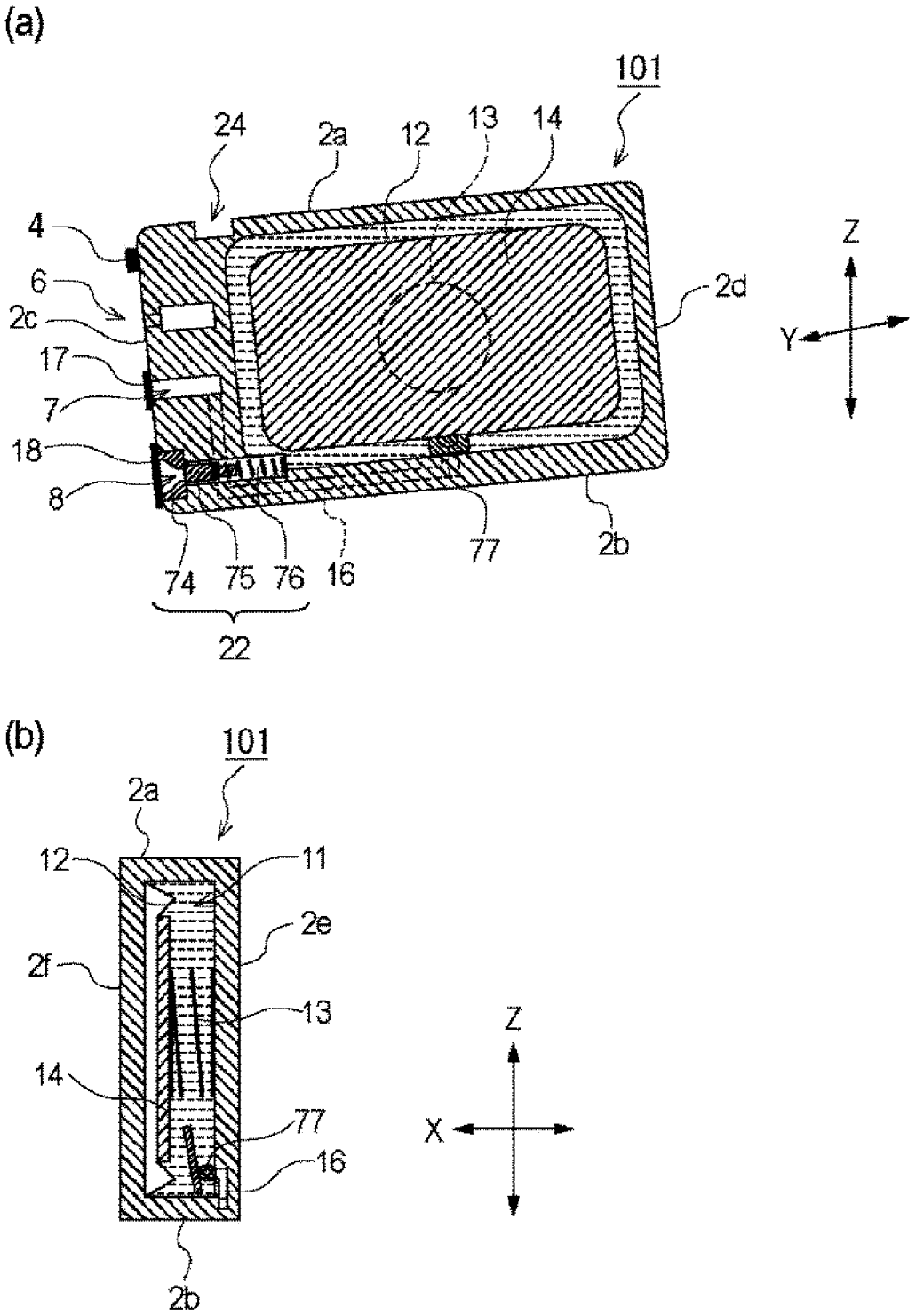
FIG. 14 illustrates an internal structure of the ink cartridge applicable to a second embodiment of the present invention, in which part (a) is a view of the ink cartridge as seen from the right-hand surface side along the X axis direction, and part (b) is a view of the ink cartridge as seen from the rear side along the Y axis direction.
Figure 15:
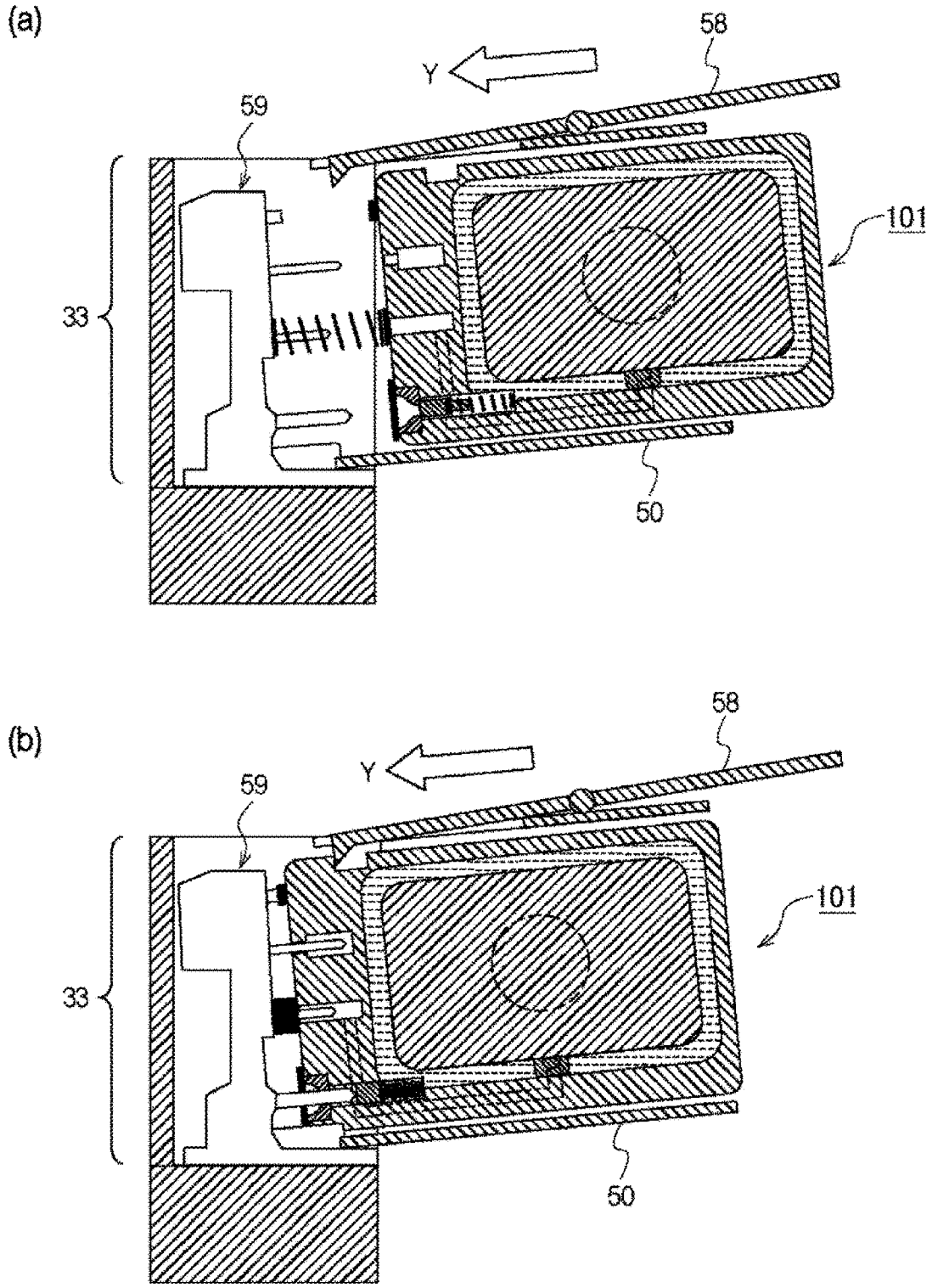
FIG. 15 shows a process of inserting the ink cartridge into the mounting portion in the second embodiment, in which part (a) shows the initial state of the insertion, and part (b) shows a completed state of the insertion.

Referring to FIGS. 14 and 15, an ink cartridge according to a second embodiment will be described. This embodiment is different from the first embodiment mainly in the structure of the tube insertion path 22, the structure of the air vent path 16, the position of the air vent sealing film 17 and the structure of the connecting portion between the air vent path 16 and the ink accommodating chamber 11, and the other structures of this embodiment are substantially the same as of the first embodiment. Therefore, in the description of this embodiment, the same reference numerals as in the first embodiment are assigned to the elements having the corresponding functions in this embodiment, and the detailed description thereof is omitted for simplicity.

FIG. 14 shows the internal structure of the ink cartridge of the second embodiment, in which (a) is a view of the ink cartridge as seen in the X axis direction, and (b) is a view of the ink cartridge as seen from the rear side in the Y axis direction. FIG. 15 shows the process of mounting of the ink cartridge into the mounting portion in the second embodiment, in which (a) shows the initial state of the insertion, and (b) shows the final stage in which the insertion is completed.

<Internal Structure of the Ink Cartridge>

(Structure of the Tube Insertion Path)

As shown in FIG. 14, the tube inserting opening 8 is provided on the front surface 2*c* of the casing 2 in the neighborhood of the bottom surface. The tube inserting opening 8 is disposed at one end portion of a tube insertion path 22, and the other end portion of the tube insertion path 22 is connected to the ink accommodating chamber 11. The tube insertion path 22 is provided with a sealing member 74 of elastic member (annular rubber member, for example), the valve 75 movable between a position for contacting to the sealing member 74 and the position spaced away from the sealing member 74, and a spring 76 for urging the valve 75 toward the sealing member 74. The outer peripheral surface of the sealing member 74 is in close contact with the inner surface of the tube insertion path 22. In the state that an ink receiving tube 52 is not yet inserted into the tube insertion path 22, the valve 75 contacts with the sealing member 74 to seal the opening of the sealing member 74. Therefore, the tube insertion path 22 is isolated from the sealing member 74 by the valve 75, and the fluid communication between the ink accommodating chamber 11 and the outside is not established. When the ink receiving tube is inserted into the tube insertion path 22 through the tube inserting opening 8, the valve 75 is moved in the direction of compressing the spring 76 to space the valve 75 from the sealing member 74, so that the fluid communication between the ink receiving tube 52 and the ink accommodating chamber 11 is established, and the inner surface of the sealing member 74 contacts to the outer peripheral surface of the ink receiving tube 52 to prevent the leakage of the ink. By the insertion of the ink receiving tube 52 into the tube insertion path 22, the ink in the ink accommodating chamber 11 can be supplied into the ink receiving tube 52.

(Structure of the Connecting Portion Between Air Vent Path and Ink Accommodating Chamber)

As shown in FIG. 14, one end portion of the air vent path 16 is provided with an air vent 7, and the other end portion of the air vent path 16 is connected with the ink accommodating chamber 11. The air vent sealing film 17 sealing the air vent 7 is mounted to the front surface 2*c* which is an outer wall surface of the casing 2, and is a member separate from a flexible member 12. In the connecting portion between the air vent path 16 and the ink accommodating chamber 11, there is provided an interrelation valve 77 capable of opening and closing in interrelation with movement of a plate member 14, and when the interrelation valve 77 is opened, the air vent path 16 and the ink accommodating chamber 11 is brought into fluid communication with each other. More particularly, when the ink amount in the ink accommodating chamber 11 is not less than a predetermined amount, the interrelation valve 77 is in the closed position as shown in part (b) of FIG. 14, so that the ink accommodating chamber 11 is not in fluid communication with the air vent path 16. The plate member 14 is constituted such that it moves toward the left surface 2*e* with consumption of the ink, and the ink amount in the ink accommodating chamber 11 becomes less than the predetermined amount, the plate member 14 pushes the interrelation valve 77 to open it. By this, the ink accommodating chamber 11 and the air vent path 16 are brought into fluid communication with each other. In the fluid communication state, the ambient air is introduced into the ink accommodating chamber 11 through the air vent path 16 corresponding to the amount of the ink consumption from the ink accommodating chamber 11, and therefore, the negative pressure in the ink accommodating chamber 11 does not become too high. Therefore, it can be avoided that the ink supply from the ink accommodating chamber 11 to the outside is impeded as a result of the too high negative pressure inside the ink accommodating chamber 11, and therefore, most of the ink can be used up out of the ink accommodating chamber.

<Mounting Operation and Dismounting Operation of Ink Cartridge>

The mounting operation of the ink cartridge in this embodiment is as shown in FIG. 15, and it is substantially similar to the mounting operation in the first embodiment shown in FIG. 10.

As shown in part (a) of FIG. 15, the ink cartridge 1 is inserted along the inside of the mounting guide 50 to contact to the ejection spring 57. When the ink cartridge 1 is further inserted, the recess of the discrimination portion 9 of the ink cartridge 1 is checked in effect as to whether or not it meets the projection of the discrimination member 60 of the mounting portion 33, and if so, the cartridges is further inserted toward the rear side. Then, the tube inserting opening sealing film 18 is unsealed by the free end of the ink receiving tube 52, and the ink receiving tube 52 is inserted into the tube inserting opening 8. The positioning pin 53 is inserted into the positioning portion 6, and thereafter, the air vent sealing film 17 is unsealed by the unsealing pin 51, and the unsealing pin 51 is inserted into the air vent 7. Subsequently, the ink receiving tube 52 is inserted into the opening of the sealing member 74 provided in the tube insertion path 22 to push the valve 75, so that the ink accommodating chamber 11 and the ink receiving tube 52 are brought into fluid communication with each other. Then, the electrical contact contacts to the electrical connecting portion 55, and finally, the engaging portion 24 is engaged with the locking projection 54 of the locking lever 58, and the mounting operation is completed (part (b) of FIG. 15)

As described, in the second embodiment, too, similarly to the first embodiment, the cartridge side interface portions are properly connected with the printer main assembly side interface portions.

[Modified Example of Second Embodiment]

The structures of this embodiment shown in FIG. 14 is different from the first embodiment in the four structures (the structure of the tube insertion path, the structure of the air vent path, the position of the air vent sealing film and the structure of the connecting portion between the air vent path and the ink accommodating chamber), but this embodiment is not restricted to such structures. For example, only the structure of the tube insertion path 22 may be different from that of the first embodiment, or only the structure of the connecting portion between the air vent path 16 and the ink accommodating chamber 11 may be different from the first embodiment. In addition, at least one of the structures of the four structures (one, two or three of the structures) may be different from the first embodiment, and such modifications are within the modified examples of this embodiment.

[Third Embodiment]

Referring to FIGS. 16-19, a third embodiment will be described. The ink cartridge 1801 according to the third embodiment is substantially the same as the first embodiment except that the size of the casing is different from that of the first embodiment. More particularly, the ink cartridge 1801 according to the third embodiment is provided with the cartridge side interface portions such as the tube inserting opening 8, the electrical contacts, the positioning portion 6 and the engaging portion 24, similarly to the ink cartridge 1 of the first embodiment. The positional relationship among the cartridge side interface portions in the third embodiment are common with the positional relationships among the cartridge side interface portions in the first embodiment at least in the following points (1)-(4). (1) the tube inserting opening 8 is disposed in a position closer to the bottom surface than to the upper surface, on the front surface of the casing. (2) the electrical contact 4 is disposed in a position above the tube inserting opening 8. (3) the positioning portion 6 is disposed in a position above the tube inserting opening 8 and below the electrical contact 4. (4) the engaging portion 24 is provided on the upper surface of the casing. In the description of this embodiment, the same reference numerals as in the first embodiment are assigned to the elements having the corresponding functions in this embodiment, and the detailed description thereof is omitted for simplicity.

<Structure of Ink Cartridge>

Figure 16:
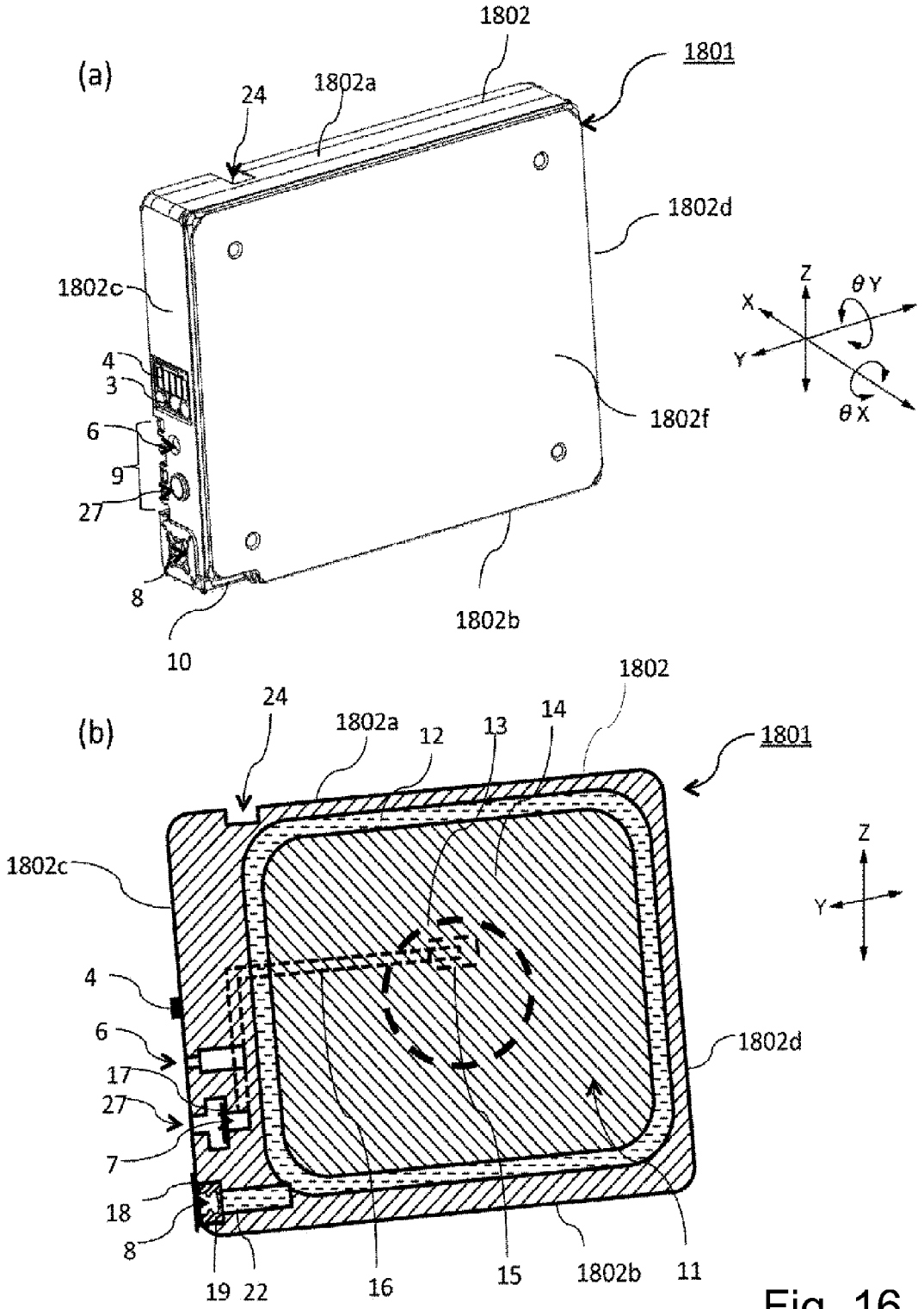
FIG. 16 illustrates a schematic structure of the ink cartridge 1801 applicable to a third embodiment of the present invention, in which part (a) is a perspective view of an outer appearance of the ink cartridge 1801, and part (b) illustrates an internal structure of the ink cartridge 1801.

FIG. 16 shows a schematic structure of the ink cartridge 1801 according to the third embodiment, in which (a) is a perspective view of an outer appearance of the ink cartridge 1801, and (b) shows an inside structure of the ink cartridge 1801. FIG. 9 is a perspective view illustrating a connection relation between the ink cartridge 1801 and a joint unit 59 taken out of the cartridge mounting unit. As will be understood from FIG. 17, the joint unit 59 of the third embodiment is the same as the joint unit 59 of the first embodiment. Therefore, the structure, the positional relation and the size of the cartridge side interface portions connectable with the joint unit 59 as the printer main assembly side interface portions are the same as those of the first embodiment. More particularly, the structure, the positional relation and the sizes the electrical contact, the positioning hole 6, the through-opening 27, the tube inserting opening 8 and the discrimination portion 9 provided on the front surface 1802*c* of the ink cartridge 1801 in the third embodiment are the same as those of the electrical contact, the positioning hole 6, the through-opening 27, the tube inserting opening 8 and the discrimination portion 9 provided on the front surface 2*c* of the ink cartridge 1 in the first embodiment. Therefore, in designing both of the ink cartridge 1 (FIG. 9) of the first embodiment and the ink cartridge 1801 (FIG. 17) of the third embodiment, the joint unit 59 as the printer main assembly side interface portion may be common, and the cost of the joint unit 59 can be reduced. In addition, the structure, the positional relation and the size of the cartridge side interface portions such as the electrical contacts 4, the positioning hole 6, the through-opening 27, the tube inserting opening 8 and the discrimination portion 9 may be common, and therefore, the design load of the ink cartridge can be reduced.

Figure 17:
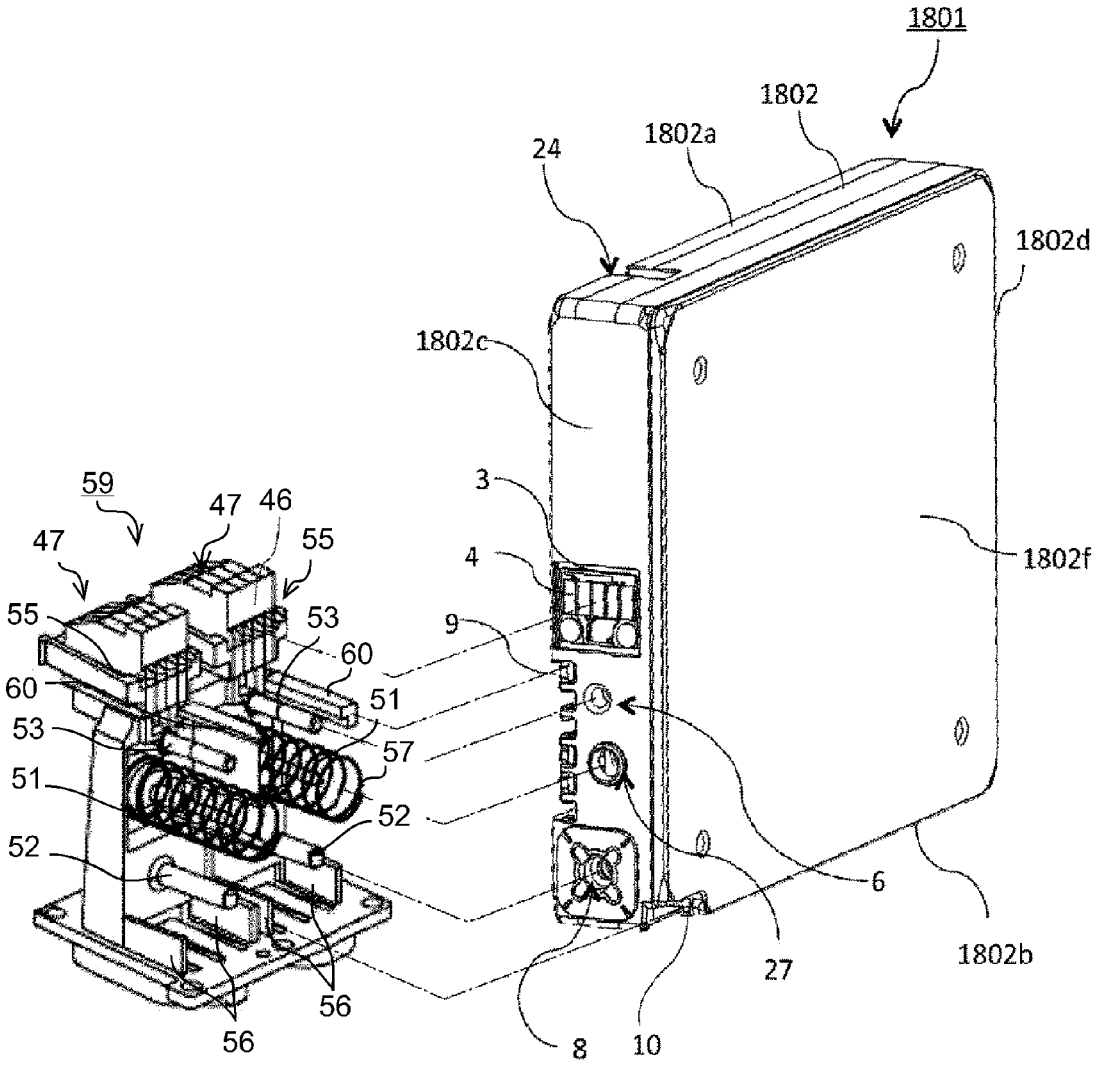
FIG. 17 is a perspective view illustrating a connection relation between the ink cartridge 1801 and a joint unit 59 taken out of the cartridge mounting unit in the third embodiment.

As will be understood from FIGS. 16 and 17, the ink cartridge 1801 is provided with a rectangular parallelepiped shape casing 1802 including an ink accommodating chamber 11 therein. The casing 1802 includes an upper surface 1802*a*, a lower surface (bottom surface) 1802*b*, a plurality of side surfaces 1802*c*-1802*f* The side surfaces include a front surface (front side) 1802*c* as a first side surface, a rear surface (rear side) 1802*d* as a second side surface, a left surface 1802*e* as a third side surface connecting the first side surface and the second side surface with each other, and a right-hand surface 1802*f* as a fourth side surface connecting the first side surface and the second side surface with each other.

The size of the casing 1802 is larger than that of the casing 2 of the first embodiment. More particularly, the size (height) of the casing 1802 in the Z axis direction is larger than that of the casing 2 of the first embodiment, and the size (depth) of the casing 1802 in the Y axis direction is larger than that of the casing 2 of the first embodiment. For example, in the example of the sizes of the casing 1802, the height is approx. 7.8 cm, the depth is approx. 9.5 cm which are larger than the height of approx. 4.7 cm and the depth of approx. 8.4 cm of the casing 2 of the first embodiment, respectively. On the other hand, the size (width) of the casing 1802 measured in the X axis direction is the same as that of the casing 2 of the first embodiment (approx. 1.6 cm, for example). The specific dimensions are merely preferable examples, and this embodiment is not limited to such dimensions.

The casing 1802 has a generally rectangular parallelepiped shape having six major sides. The left surface 2*e* and the right-hand surface 2*f* of the 6 surfaces have the maximum area, and the front surface (front side) 2*c* and the rear surface (rear side) 2*d* have the minimum area. The relationship of the areas of the six sides is the front surface 2*c* and the rear surface 2*d*<upper surface 2*a* and the lower surface (bottom surface) 2*b*<the left surface 2*e* and right-hand surface 2*f* The areas of the left surface 2*e* and the right-hand surface 2*f* are approx. 74.10 (=7.8×9.5) cm^2. The areas of the upper surface 2*a* and the lower surface 2*b* are approx. 15.20 (=1.6×9.5) cm^2. The areas of the front surface (front side) 2*c* and the rear surface (rear side) is each approx. 12.48 (=1.6×7.8) cm^2.

As described above, the positional relation in the cartridge side interface portions are the same as that of the first embodiment, and for example, the tube inserting opening 8, the through-opening 27, the positioning hole 6 and the substrate 3 are disposed in the order named from the bottom side toward the upper side. However, as contrasted to the ink cartridge 1 of the first embodiment, in the ink cartridge 1801 according to the third embodiment, the electrical contacts 4 are disposed in the neighborhood of the center of the front surface 1802*c* in the height direction. More particularly, the electrical contacts are disposed slightly above the center portion of the front surface 1802*c* with respect to the height direction. That is, the electrical contacts 4 are disposed on the positions in an upper side of the front surface 1802*c* (the portion above the center with respect to the height direction) and closer to the center portion than to the upper surface. With such a structure, the relative positional relationship between the tube inserting opening 8, the electrical contact and the engaging portion 24 are the same as that of the first embodiment. More particularly, even if the electrical contacts 4 are provided adjacent to the neighborhood of the center of the front surface 1802*c*, the engaging portion 24 it is still disposed in the position closer to the electrical contacts 4 than to the tube inserting opening 8, and therefore, the advantageous effects of the first embodiment are provided. In the third embodiment, the engaging portion 24 is provided on the upper surface 1802*a* (more particularly, the position closer to the front surface 1802*a* than to the rear surface 1802*d* on the upper surface 1802*a*) in order to dispose engaging portion 24 in the position closer to the electrical contact than to the tube inserting opening 8, but the structure for disposing the engaging portion 24 to the position closer to the electrical contact the than to the tube inserting opening 8 is not limited to the above-described structure.

In addition, in the third embodiment, the positioning portion 6 is disposed in the position closer to the electrical contact than to the tube inserting opening 8, similarly to the first embodiment, and therefore, the advantageous effects similar to those of the first embodiment in this respect are provided in the third embodiment. Similarly to the first embodiment, the electrical contacts 4 are arranged along the X axis direction in the third embodiment, and therefore, the same advantageous effects similar to the first embodiment in this respect can be provided in the third embodiment.

<Mounting Operation and Dismounting Operation of Ink Cartridge>

Figure 18:
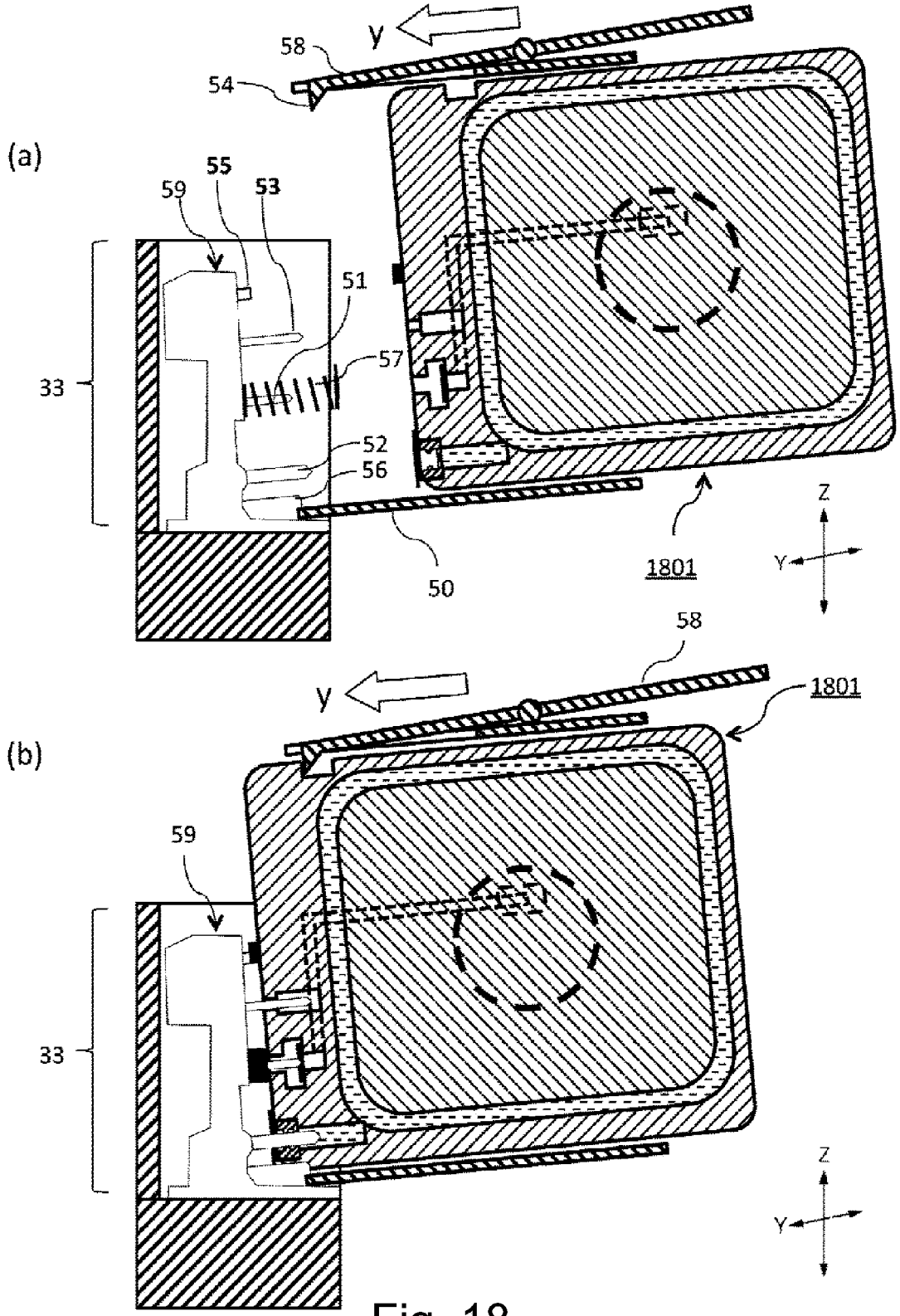
FIG. 18 illustrates a process of inserting the ink cartridge 1801 in the third embodiment, in which part (a) shows an initial state of the insertion, and part (b) shows a completed state of the insertion.

The mounting operation of the ink cartridge 1801 in the third embodiment is shown in FIG. 18 and is almost the same as the mounting operation in the first embodiment. The ink cartridge 1801 of the third embodiment is taller than the ink cartridge 1 of the first embodiment, and therefore, the locking lever 58 is at a higher position, correspondingly. The mounting guide and the inside space of the mounting portion 33 in the third embodiment are larger than those in the first embodiment, but the functions of the mounting portions of these embodiments are the same, and the detailed description is omitted for the sake of simplicity.

As shown in part (a) of FIG. 18, the ink cartridge 1801 is inserted along the inside of the mounting guide 50 to contact to the ejection spring 57. When the ink cartridge 1801 is further inserted, the recess of the discrimination portion 9 of the ink cartridge 1 is checked in effect as to whether or not it meets the projection of the discrimination member 60 of the mounting portion 33, and if so, the cartridges is further inserted toward the rear side. Then, the tube inserting opening sealing film 1801 is unsealed by the free end of the ink receiving tube 52, and the ink receiving tube 52 is inserted into the tube inserting opening 8. The positioning pin 53 is inserted into the positioning portion 6, and thereafter, the air vent sealing film 17 is unsealed by the unsealing pin 51, and the unsealing pin 51 is inserted into the air vent 7. Subsequently, the ink receiving tube 52 is inserted into the slit of the sealing member 74 provided in the tube insertion path 22 to push the valve 75, so that the ink accommodating chamber 11 and the ink receiving tube 52 are brought into fluid communication with each other. Then, the electrical contact contacts to the electrical connecting portion 55, and finally, the engaging portion 24 is engaged with the locking projection 54 of the locking lever 58, and the mounting operation is completed (part (b) of FIG. 18).

As described, in the third embodiment, too, similarly to the first embodiment, the cartridge side interface portions are properly connected with the printer main assembly side interface portions.

<Wide Ink Cartridge>

Figure 19:
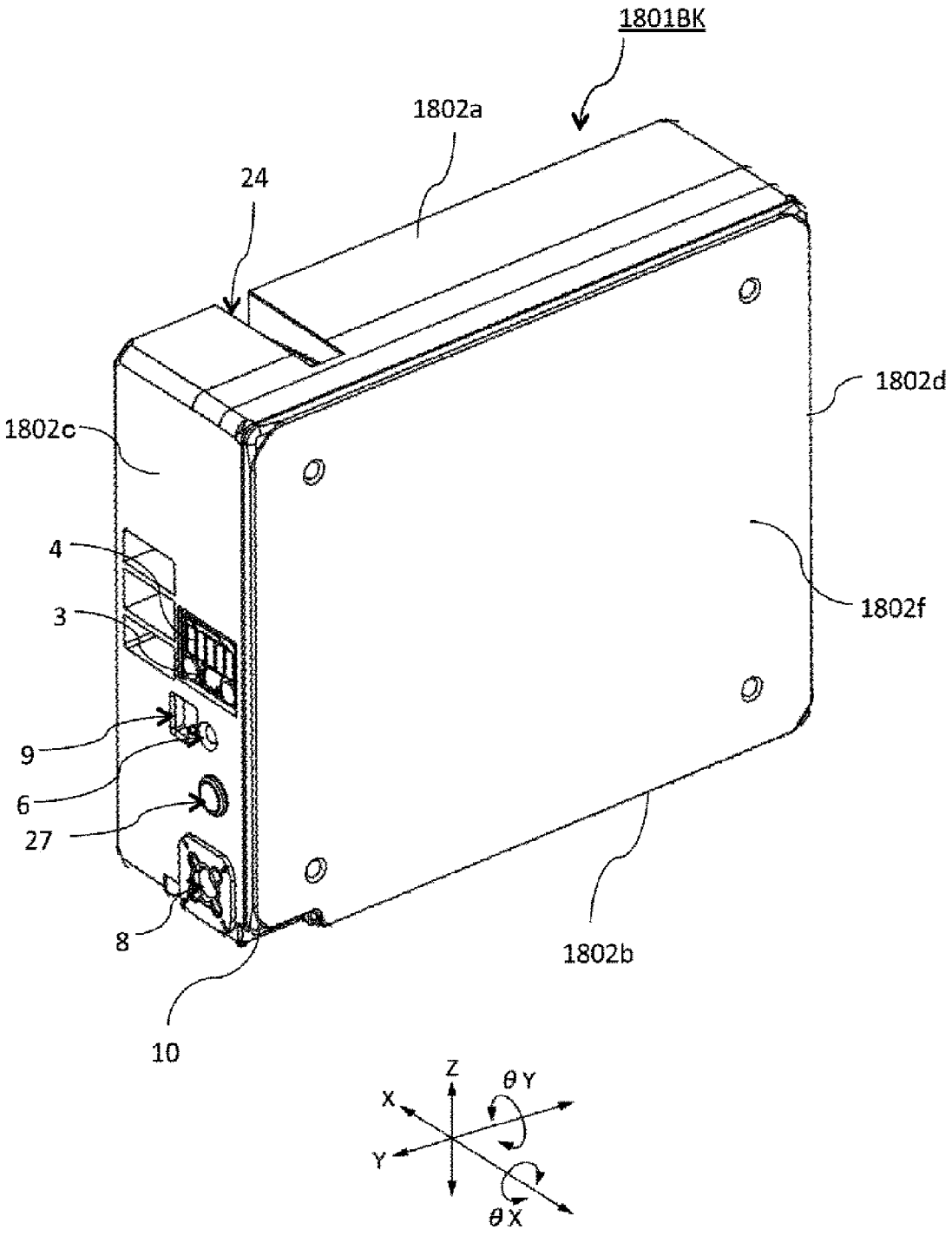
FIG. 19 is a schematic view illustrating an ink cartridge 1BK applicable in the third embodiment.

FIG. 19 is a schematic view of an ink cartridge 1801BK of the third embodiment. The basic structures of the black ink cartridge 1801BK shown in FIG. 19 are substantially the same as the color ink cartridge 1801 shown in FIG. 16. For example, the heights and the depths are the same, and the kinds, the arrangements and the arrangement widths of the cartridge interface portions are also the same.

A major difference between the black ink cartridge 1801Bk and the color ink cartridge 1801 is that the width of the black ink cartridge 1801Bk is larger than those of the color ink cartridges, and that the cartridge interface portions are offset to one side (more particularly to the right side) of the front surface. By the offset structure, the width of the cartridge interface portions of the black cartridge is the same as those of the color cartridges. By this, the size and the general structure of the joint unit 59 can be made common between the black and the other colors.

[Fourth Embodiment]

Figure 20:
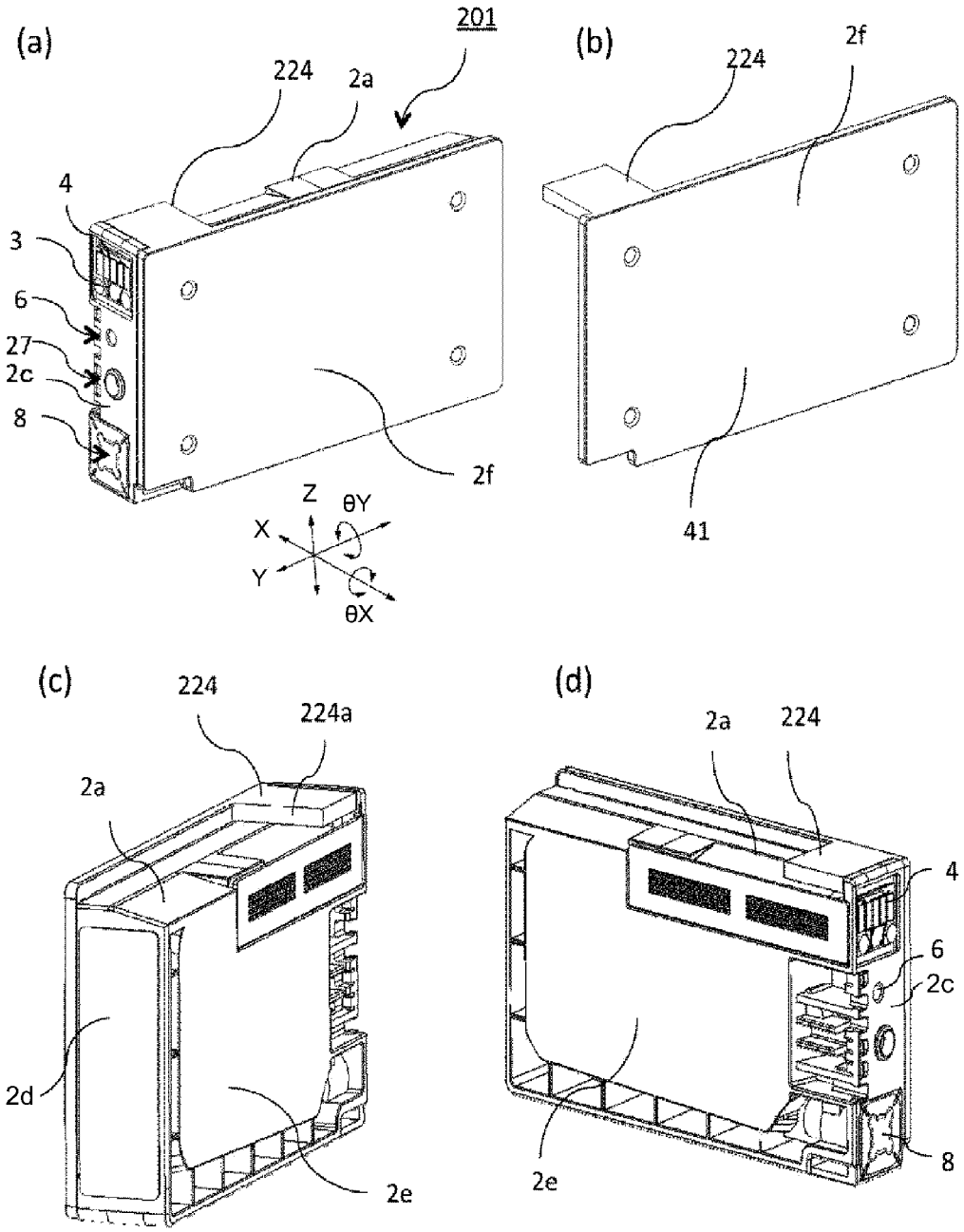
FIG. 20 is a schematic view illustrating a schematic structure of the ink cartridge 201 applicable in the fourth embodiment.

Referring to FIG. 20, a fourth embodiment will be described. FIG. 20 is a schematic view schematically showing the structure of the ink cartridge of this embodiment, which is characterized in the structure of an engaging portion 224. This embodiment is different from the first embodiment only in the structure of the engaging portion, and the other structures are substantially the same as those of the first embodiment. Therefore, in the description of this embodiment, the same reference numerals as in the first embodiment are assigned to the elements having the corresponding functions in this embodiment, and the detailed description thereof is omitted for simplicity.

In the foregoing embodiments, in order to provide the engaging portion 24 in the position closer to the electrical contact than to the tube inserting opening 8, the engaging portion 24 is placed on the upper surface of the casing, but the structure of placing the engaging portion 24 in the position closer to the electrical contact than to the tube inserting opening 8 is not limited to the structures of the foregoing embodiments. The engaging portion may be disposed in the position closer to the electrical contact than to the tube inserting opening 8, by placing the engaging portion in a portion different from the upper surface of the casing. In order to place the engaging portion 24 in the position closer to the electrical contact 4 than to the tube inserting opening 8, it is preferable that the engaging portion is placed in a position closer to the upper surface than to the bottom surface.

As shown in FIG. 20, a second casing member (closing member) 41 constituting a right-hand surface 2*f* of the casing is provided with the engaging portion 224. More particularly, the engaging portion 224 is in the form of a projection extending from the right-hand surface 2*f* in the X axis direction (widthwise direction perpendicular to the right-hand surface). The projection 224 includes a side which is an area 224*a* crossing with the cartridge mounting direction (Y axis direction), and at least a part of the area 224*a* contacts to the locking projection 54 of the locking lever 58 so that the engaging portion 124 and the locking projection 54 are engaged with each other. Similarly to the area 24*a* of the engaging recess 24 shown in FIG. 5, the contact region 224*a* of the engaging portion 224 is the area crossing with the direction parallel with the normal line of the electrical contact 4 or the normal line of the area on the substrate 3 on which the electrical contacts 4 are provided, and particularly in this embodiment, the area 224*a* is perpendicular to the direction parallel with the normal line. The area 224*a* is an area crossing with the direction parallel with the normal line of the formation surface of the ink discharge opening 8 and is an area crossing with the direction parallel with the direction in which the ink discharging path 22 extends. Furthermore, the area 224*a* is an area crossing with the direction parallel with the center line of the ink discharge opening 8 (a phantom line passing through the center of the ink discharge opening 8).

In this embodiment, the engaging portion is provided in a portion different from the upper surface of the casing, as shown in FIG. 20, but the present invention is not limited to such a structure. For example, the engaging portion may be provided in the position used in a fifth embodiment or a sixth embodiment which will be described hereinafter. Similarly to this embodiment, the engaging portion is disposed in a position closer to the upper surface than to the lower the surface also in the fifth embodiment and the sixth embodiment which will be described hereinafter.

As will be understood from the description of this embodiment, the engaging portion used in the present invention is not limited to the recess configuration, but it may be a projected configuration as shown in FIG. 20.

[Fifth Embodiment]

Figure 21:
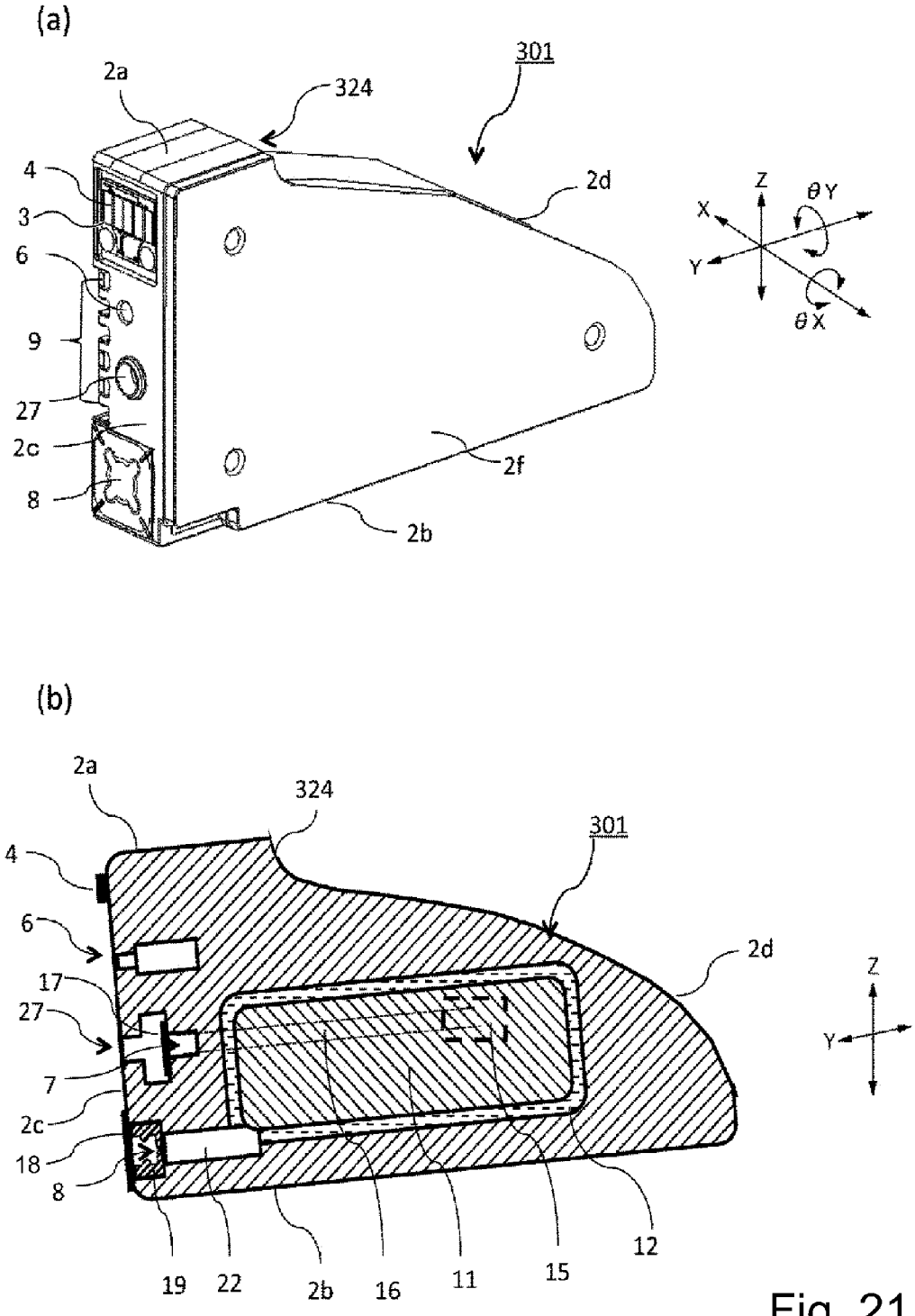
FIG. 21 illustrates a schematic structure of the ink cartridge 301 applicable in a fifth embodiment, in which part (a) is a perspective view of an outer appearance of the ink cartridge 301, and part (b) shows an internal structure of the ink cartridge 301 as seen from the right-hand surface side along the X axis direction.
Figure 22:
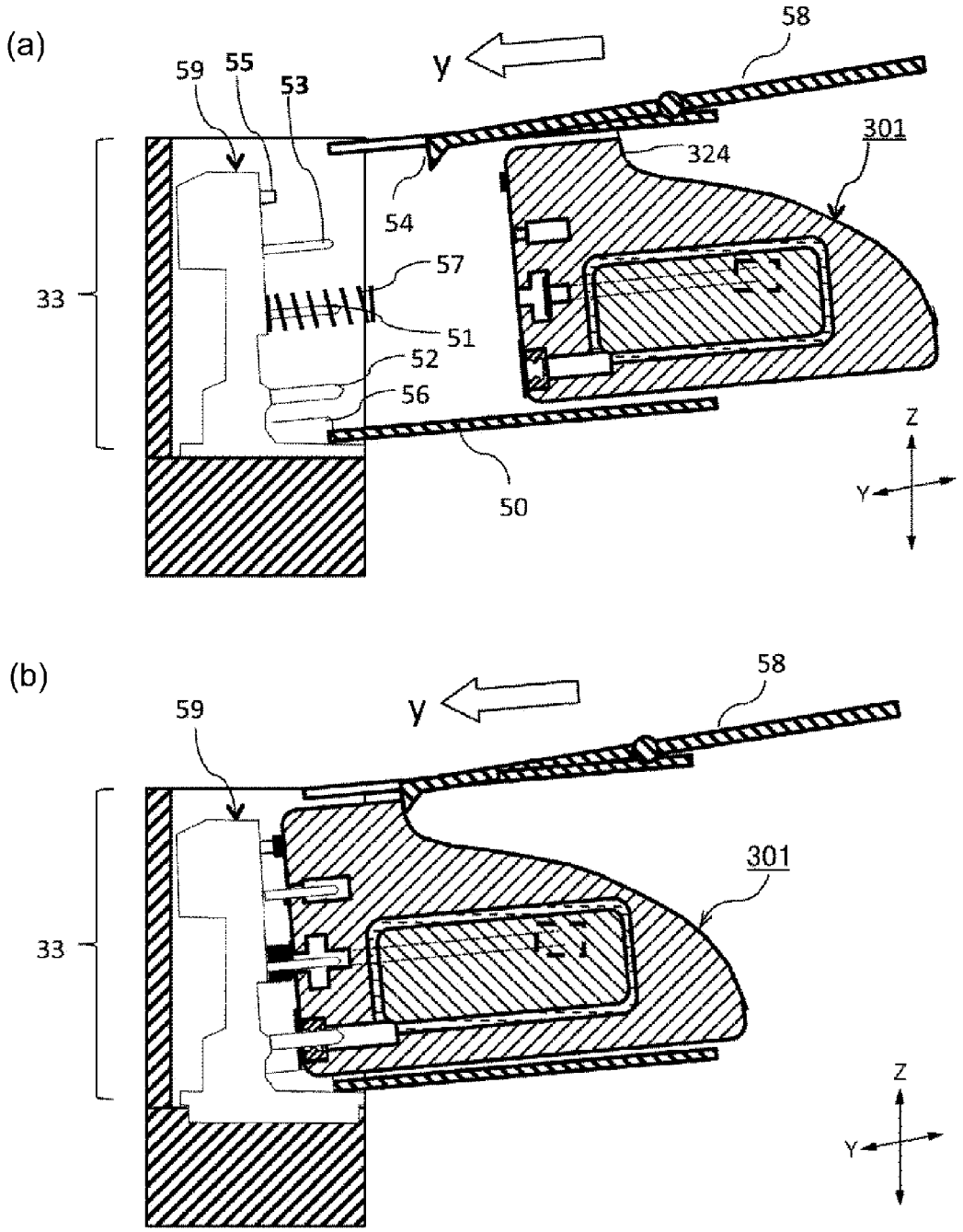
FIG. 22 illustrates a process of inserting the ink cartridge 301 in the fifth embodiment, in which part (a) shows an initial state of the insertion, and part (b) shows a completed state of the insertion.

Referring to FIGS. 21-22, a fifth embodiment will be described. This embodiment is different from the first embodiment only in the structure of the engaging portion and the configuration of the casing, and the major structures in the other aspects of this embodiment are substantially the same as first embodiment. Therefore, in the description of this embodiment, the same reference numerals as in the first embodiment are assigned to the elements having the corresponding functions in this embodiment, and the detailed description thereof is omitted for simplicity. Corresponding to the difference in the configuration of the casing, the internal structures (the configuration of the ink accommodating chamber, the configuration of the air vent path, for example) are different, but the functions are the same despite the difference in the configuration, and therefore, the description of the internal structures will be omitted.

FIG. 21 schematically shows the structure of the ink cartridge 301 of the fifth embodiment, in which (a) is a perspective view of the outer appearance of the ink cartridge 301, and (b) shows the internal structure of the ink cartridge 301 as seen from the right-hand surface side along the X axis direction. As shown in FIG. 21, the configuration of the casing 2 is peculiar, that is, the upper surface 2*a* is small, and the rear surface 2*d* is constituted by a curved surface and an inclined surface. An area of a part of the rear surface 2*d* functions as an engaging portion 324. More particularly, the inclined surface or the curved surface of the rear surface 2*d* adjacent to the upper surface constitutes the engaging portion 324. The engaging portion 324 is closer to the upper surface 2*a* than to the bottom surface 2*b*.

The mounting operation of the ink cartridge 301 of the fifth embodiment is shown in FIG. 22, and is almost the same as the mounting operation in the first embodiment shown in FIG. 10. Therefore, the detailed description is omitted, but briefly, the engaging portion 324 is engaged with the locking projection 54 of the locking lever 58 as shown in FIG. 22. As will be understood from the foregoing, the engaging portion usable in the ink cartridge of the present invention is not limited to the recesses used in the first-third embodiments or to the projection used in the fourth embodiment, but may be a curved surface or an inclined surface. In addition, the position of the engaging portion is not limited to the upper surface 2*a* of the casing 2 as shown in FIG. 2 or to the side surface 2*f* of the casing 2 as shown in FIG. 20, but it may be a rear surface 2*d* of the casing 2 of this embodiment as shown in FIG. 21.

Similarly to the area 24*a* shown in FIG. 5 or the area 224*a* shown in FIG. 20, the inclined surface or the curved surface constituting the engaging portion 324 crosses with the direction parallel with the normal line of the electrical contact 4 or the normal line of the area on the substrate 3 on which the electrical contact 4 is provided, and particularly in this embodiment, the engaging portion 324 is perpendicular to the direction parallel with the normal line. The engaging portion 324 crosses with the direction parallel with the normal line of the formation surface of the ink discharge opening 8 and crosses with the direction parallel with the extending direction of the ink discharging path 22. Furthermore, the engaging portion 324 crosses with the direction parallel with the center line of the ink discharge opening 8 (phantom line passing through the center of the ink discharge opening 8).

[Sixth Embodiment]

Figure 23:
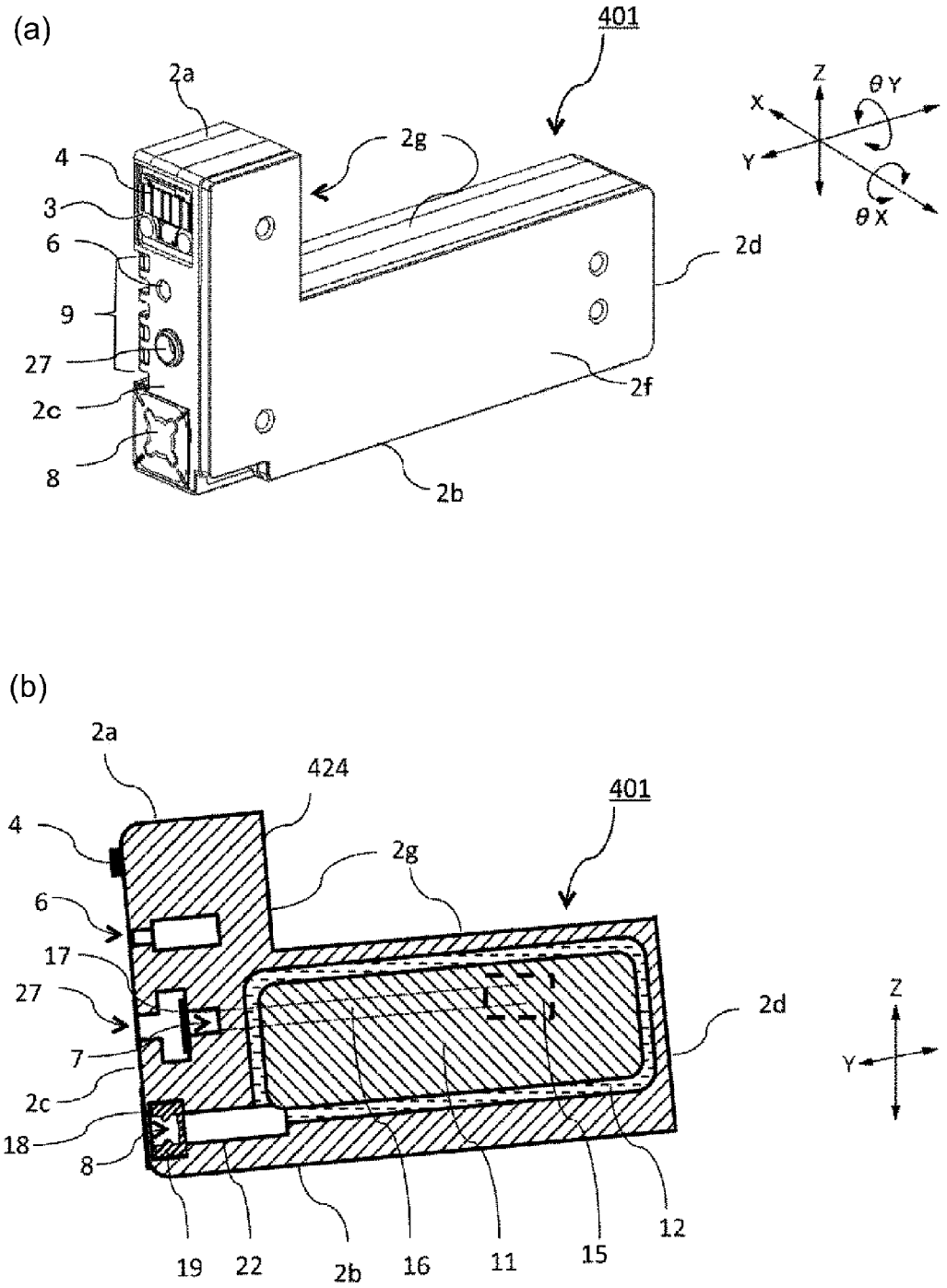
FIG. 23 illustrates a schematic structure of the ink cartridge 401 applicable in a sixth embodiment, in which part (a) is a perspective view of an outer appearance of the ink cartridge 401, and part (b) shows an internal structure of the ink cartridge 401 as seen from the right-hand surface side along the X axis direction.
Figure 24:
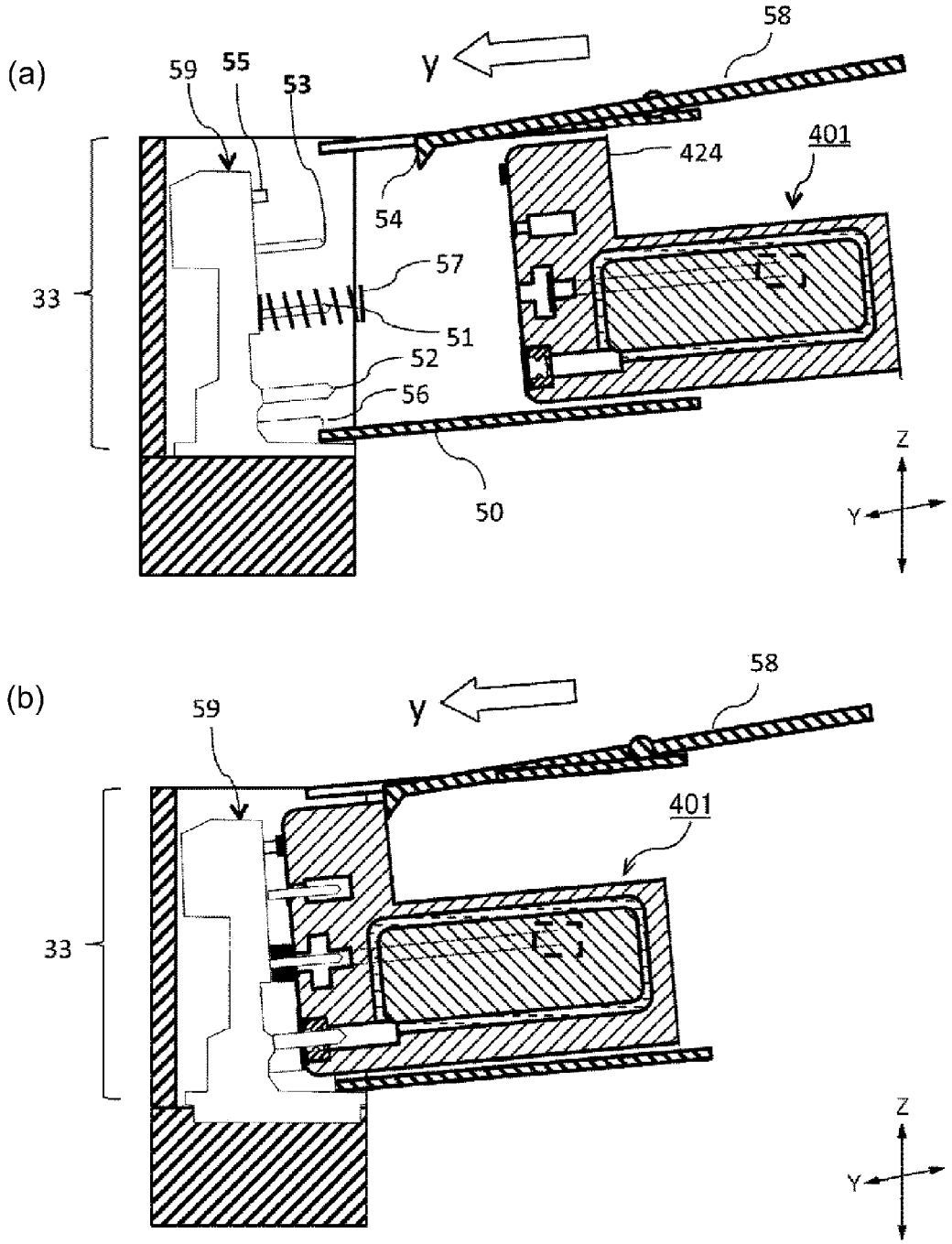
FIG. 24 illustrates a process of inserting the ink cartridge 401 in the sixth embodiment, in which part (a) shows an initial state of the insertion, and part (b) shows a completed state of the insertion.

Referring to FIGS. 23-24, a sixth embodiment will be described. This embodiment is different from the first embodiment only in the structure of the engaging portion and the configuration of the casing, and the major structures in the other aspects of this embodiment are substantially the same as first embodiment. Therefore, in the description of this embodiment, the same reference numerals as in the first embodiment are assigned to the elements having the corresponding functions in this embodiment, and the detailed description thereof is omitted for simplicity. Corresponding to the difference in the configuration of the casing, the internal structures (the configuration of the ink accommodating chamber, the configuration of the air vent path, for example) are different, but the functions are the same despite the difference in the configuration, and therefore, the description of the internal structures will be omitted.

FIG. 23 schematically shows the structure of the ink cartridge 401 of the sixth embodiment, in which (a) is a perspective view of the outer appearance of the ink cartridge 401, and (b) shows the internal structure of the ink cartridge 401 as seen from the right-hand surface side along the X axis direction. In FIG. 23, the configuration of the casing 2 is peculiar, and the upper surface 2*a* and the rear surface 2*d* a small, and there is provided a connection region 2*g* connecting the upper surface 2*a* and the rear surface 2*d*. A part of the connection region 2*g* functions as the engaging portion 424. More particularly, the connection region 2*g* includes a first area which is connected with the upper surface 2*a* and which extends substantially in parallel with the front surface 2*c*, and a second area which is connected with the rear surface 2*d* and which extends substantially in parallel with the bottom surface 2*b*, in which a flat surface portion which is adjacent to the upper surface and which is a part of the first area functions as the engaging portion 424. The engaging portion 424 is in the position closer to the upper surface 2*a* than to the bottom surface 2*b*.

The mounting operation of the ink cartridge 401 in the sixth embodiment is shown in FIG. 24, and is almost the same as the mounting operation in the first embodiment shown in FIG. 10. Therefore, the detailed description is omitted, but briefly, the engaging portion 424 is engaged with the locking projection 54 of the locking lever 58 as shown in FIG. 242. As will be understood, the engaging portion of the ink cartridge usable in the present invention is not limited to the recesses used in the first-third embodiments or to the curved surface, the projection used in the fourth embodiment or the inclined surface used in the fifth embodiment. The position of the engaging portion is not limited to the upper surface 2*a* of the casing 2 as shown in FIG. 2, the side surface 2*f* of the casing 2, the rear surface 2*d* of the casing 2 as shown in FIG. 20, but it may be that connection region 2*g* between the upper surface 2*a* and the rear surface 2*d* of the casing 2 of this embodiment as shown in FIG. 23.

Similarly to the area 24*a* shown in FIG. 5 and the area 224*a* shown in FIG. 20, the surface constituting the engaging portion 424 crosses with the direction parallel with the normal line of the electrical contact 4 or the normal line of the area on the substrate 3 on which the electrical contact 4 is provided. The engaging portion 424 crosses with the direction parallel with the normal line of the formation surface of the ink discharge opening 8 and crosses with the direction parallel with the extending direction of the ink discharging path 22. Furthermore, the engaging portion 424 crosses with the direction parallel with the center line of the ink discharge opening 8 (phantom line passing through the center of the ink discharge opening 8).

[Seventh Embodiment]

Figure 25:
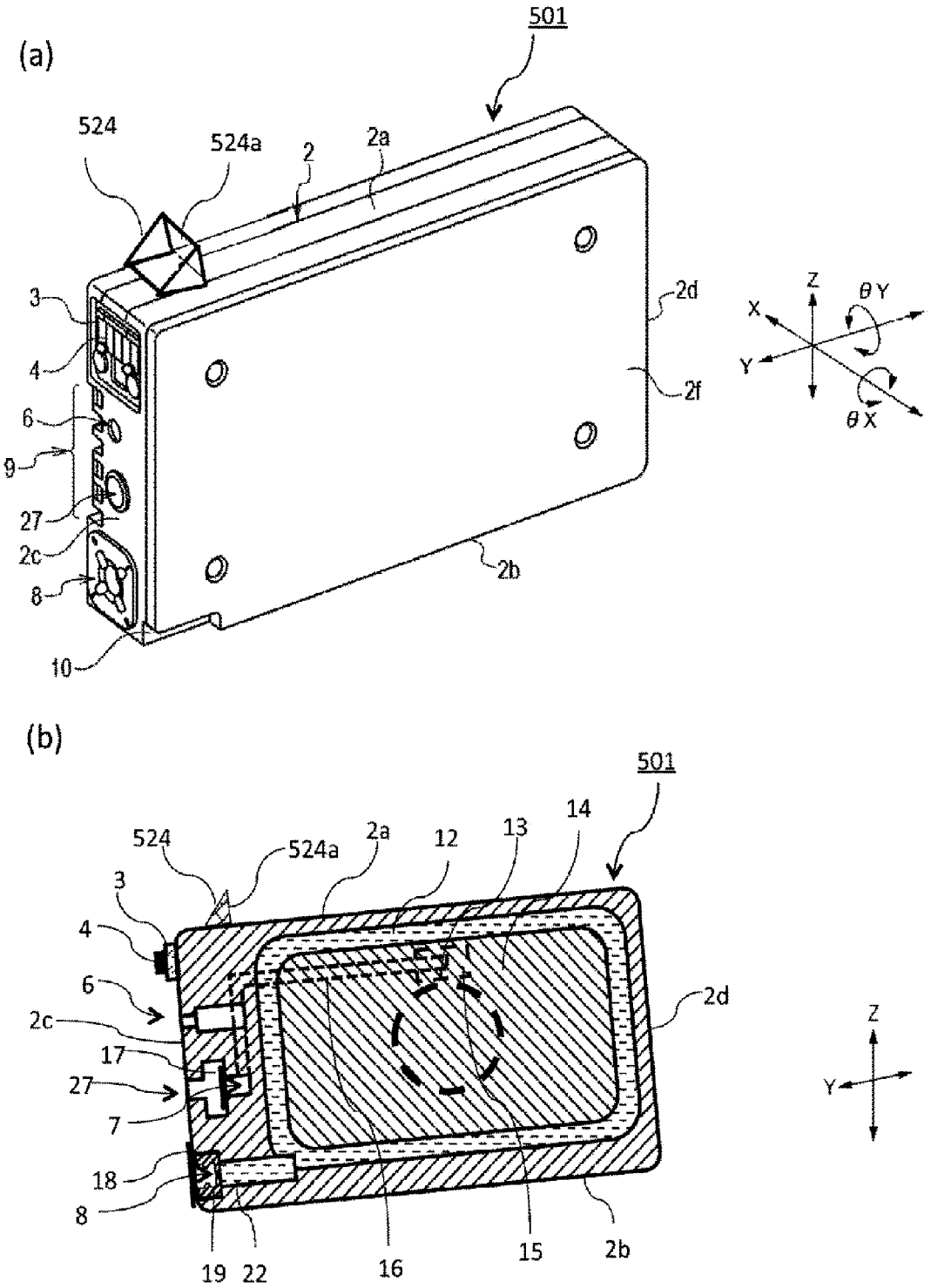
FIG. 25 illustrates a schematic structure of the ink cartridge 501 applicable in a seventh embodiment, in which part (a) is a perspective view of an outer appearance of the ink cartridge 501, and part (b) shows an internal structure of the ink cartridge 501 as seen from the right-hand surface side along the X axis direction.
Figure 26:
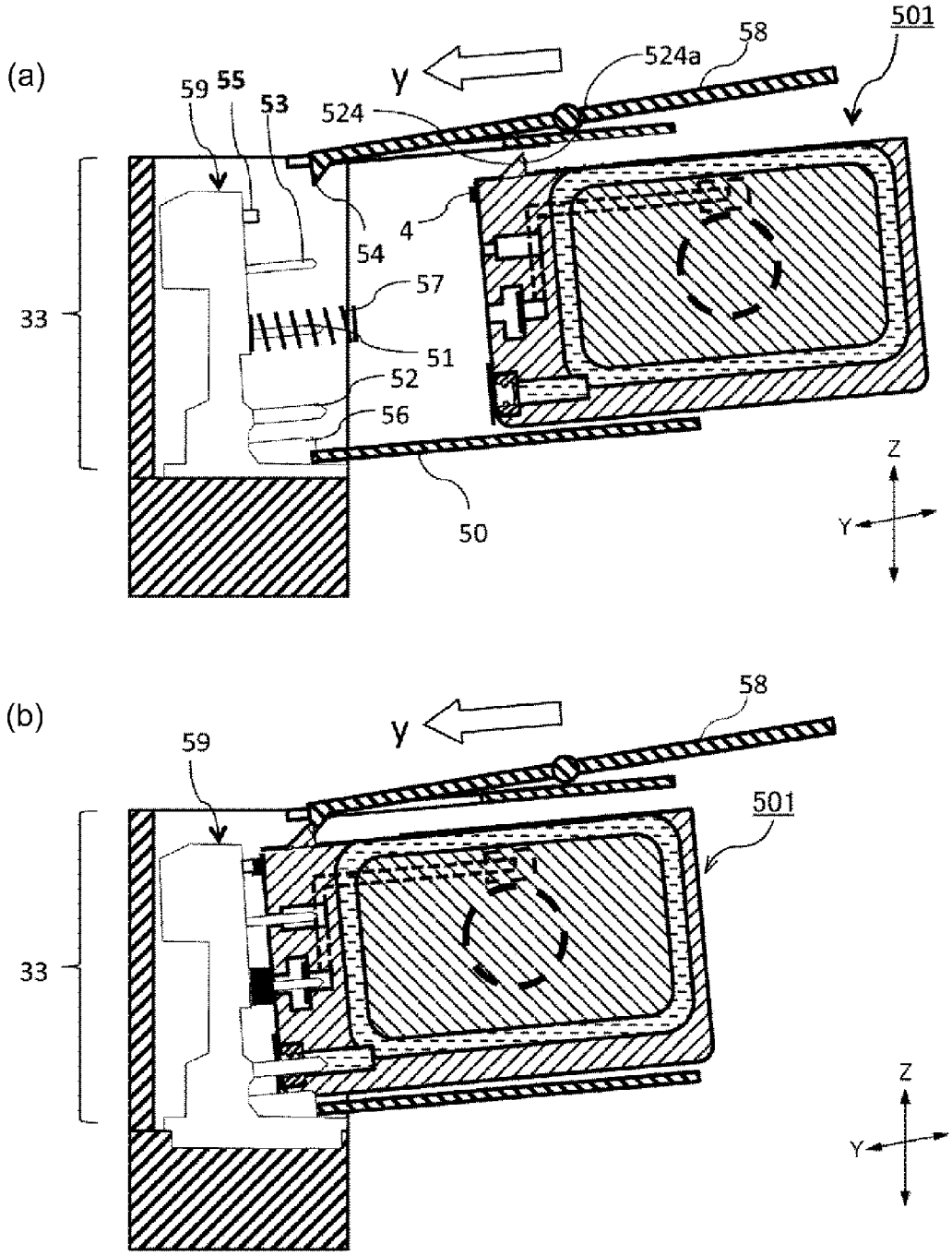
FIG. 26 illustrates a process of inserting the ink cartridge 501 in the seventh embodiment, in which part (a) shows an initial state of the insertion, and part (b) shows a completed state of the insertion.

Referring to FIGS. 25-26, a seventh embodiment will be described. This embodiment is different from the first embodiment only in the structure of the engaging portion, and the major structures in the other aspects of this embodiment are substantially the same as first embodiment. Therefore, in the description of this embodiment, the same reference numerals as in the first embodiment are assigned to the elements having the corresponding functions in this embodiment, and the detailed description thereof is omitted for simplicity.

FIG. 25 schematically shows the structure of the ink cartridge 501 of the seventh embodiment, in which (a) is a perspective view of the outer appearance of the ink cartridge 501, and (b) shows the internal structure of the ink cartridge 501 as seen from the right-hand surface side along the X axis direction. As shown in FIG. 25, the engaging portion 524 in the form of a projection is provided on the upper surface 2*a* of the casing 2. More particularly, the engaging portion 524 is a projection having a pentahedron shape in the form of a horizontal triangular prism. The projection 524 includes a side which is an area 524*a* crossing with the cartridge mounting direction (Y axis direction), and at least a part of the area 524*a* contacts the locking projection 54 of the locking lever 58 so that the engaging portion 124 and the locking projection 54 of the locking lever 58 are engaged. Similarly to the area 24*a* of the engaging recess 24 shown in FIG. 5, the contact region 524*a* of the engaging portion 524 is the area crossing with the direction parallel with the normal line of the electrical contact 4 or the normal line of the area on the substrate 3 on which the electrical contacts 4 are provided, and particularly in this embodiment, the area 524*a* is perpendicular to the direction parallel with the normal line. The area 524*a* is an area crossing with the direction parallel with the normal line of the formation surface of the ink discharge opening 8 and is an area crossing with the direction parallel with the direction in which the ink discharging path 22 extends. Furthermore, the area 524*a* is an area crossing with the direction parallel with the center line (a phantom line passing through the center of the ink discharge opening 8) of the ink discharge opening 8.

The mounting operation of the ink cartridge 501 in the seventh embodiment is shown in FIG. 26, and it is almost the same as the mounting operation in the first embodiment shown in FIG. 10. Therefore, only the relationship between the engaging portion 524 and the locking lever 58 will be described. When the ink cartridge 501 placed in the position indicated in part (a) of FIG. 26 further enters in the mounting direction (Y axis direction), the engaging portion 524 pushes up the locking projection side of the locking lever 58 by the contact with the locking projection 54. When the ink cartridge 701 further enters to the point where the engaging portion 524 is downstream of the locking projection 54 with respect to the mounting direction, the area 524*a* of the engaging portion 524 is engaged with the locking projection 54 as shown in part (b) of FIG. 26. Thus, the mounting of the ink cartridge 501 is completed. As described above, the engaging portion usable with the ink cartridge of the present invention is not limited to the recess shown in the first-third embodiments of the present invention, the projection used in the fourth embodiment, the curved surface or inclined surface used in the fifth embodiment, the flat surface of the sixth embodiment, or the like.

[Eighth Embodiment]

Figure 27:
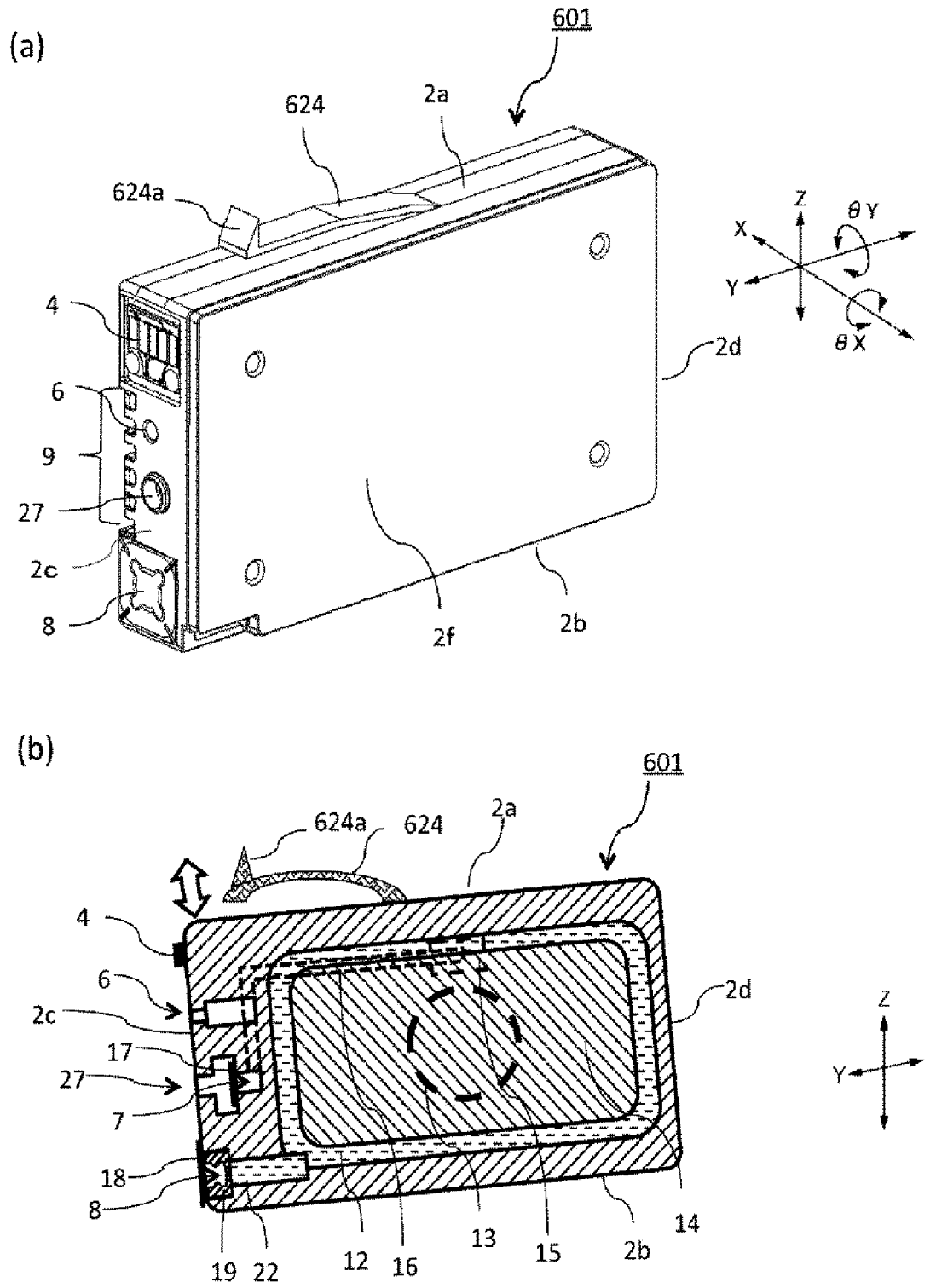
FIG. 27 illustrates a schematic structure of the ink cartridge 601 applicable in an eighth embodiment, in which part (a) is a perspective view of an outer appearance of the ink cartridge 601, and part (b) shows an internal structure of the ink cartridge 601 as seen from the right-hand surface side along the X axis direction.
Figure 28:
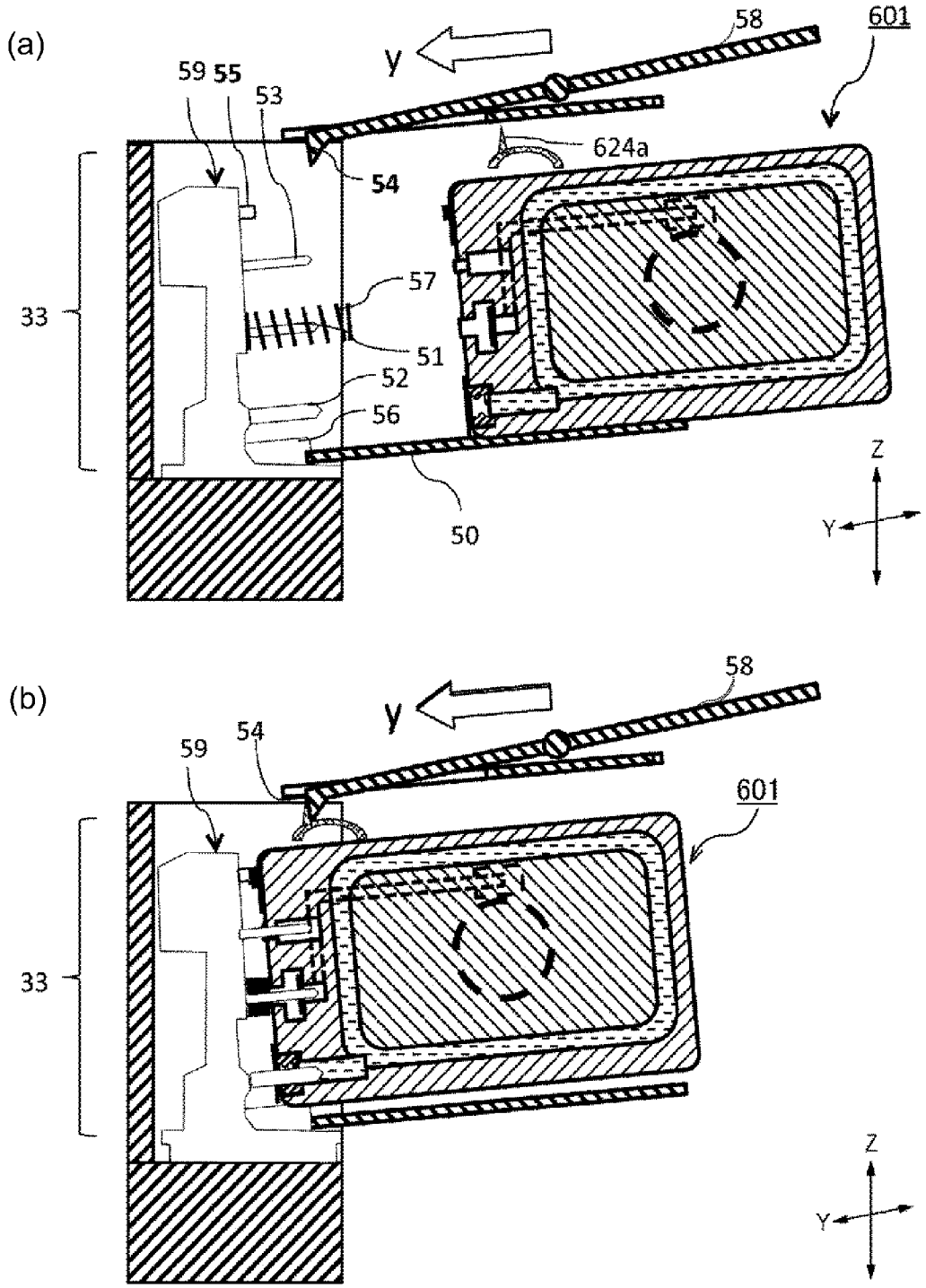
FIG. 28 illustrates a process of inserting the ink cartridge 601 in the eighth embodiment, in which part (a) shows an initial state of the insertion, and part (b) shows a completed state of the insertion.

Referring to FIGS. 27-28, an eighth embodiment will be described. This embodiment is different from the first embodiment only in the structure of the engaging portion, and the major structures in the other aspects of this embodiment are substantially the same as first embodiment. Therefore, in the description of this embodiment, the same reference numerals as in the first embodiment are assigned to the elements having the corresponding functions in this embodiment, and the detailed description thereof is omitted for simplicity.

FIG. 27 schematically shows the structure of the ink cartridge 601 of the eighth embodiment, in which (a) is a perspective view of the outer appearance of the ink cartridge 601, and (b) shows the internal structure of the ink cartridge 601 as seen from the right-hand surface side along the X axis direction. An engaging portion 624 is a movable member provided on the upper surface 2*a* of the casing 2. More particularly, the engaging portion 624 includes an elastically deformable lever supported by the upper surface 2*a* of the casing 2 so that a projection 624*a* extending in the Z axis direction is movable toward the upper surface 2*a* of the casing 2. By the projection 624*a* engaging with a locking projection 54 of the locking lever 58, the engaging portion 624 engages with the locking lever 58. Similarly to the area 24*a* of the engaging recess 24 shown in FIG. 5, the projection 624*a* crosses with a direction parallel with the normal line of the electrical contact 4 or the normal line of the area on the substrate 3 on which the electrical contact 4 is provided, and more particularly, in this embodiment the projection 624*a* is perpendicular to the direction parallel with the normal line. The projection 624*a* is a portion crossing with the direction parallel with the normal line of the ink discharge opening (8) formation surface, and is also a station crossing with the direction parallel with the extending direction of the ink discharging path 22. Furthermore, the projection 624*a* is a portion crossing with the direction parallel with the center line of the ink discharge opening 8 (phantom line passing through the center of the ink discharge opening 8).

The mounting operation of the ink cartridge 601 according to the eighth embodiment is shown in FIG. 28, and is almost the same as the mounting operation in the first embodiment shown in FIG. 10. Therefore, only the relationship between the engaging portion 624 and the locking lever 58 will be described. When the ink cartridge 601 placed in the position shown in part (a) of FIG. 28 advances in the mounting direction (Y axis direction), the projection 624*a* contacts to the locking projection 54 to raise a locking projection side of the locking lever 58. When the ink cartridge 601 further advances, and projection 624*a* becomes downstream of the locking projection 54 with respect to the mounting direction, the engaging portion 624 is pushed down by the locking projection 54 at this position, and as shown in part (b) of FIG. 28, the projection 624*a* of the engaging portion 624 is engaged with the locking projection 54 of the locking lever 58. Thus, the mounting of the ink cartridge 601 is completed. As will be understood from the foregoing, the engaging portion usable with the ink cartridge according to the present invention is not limited to a stationary (non-movable) engaging portion used in the first-seventh embodiments.

[Ninth Embodiment]

Figure 29:
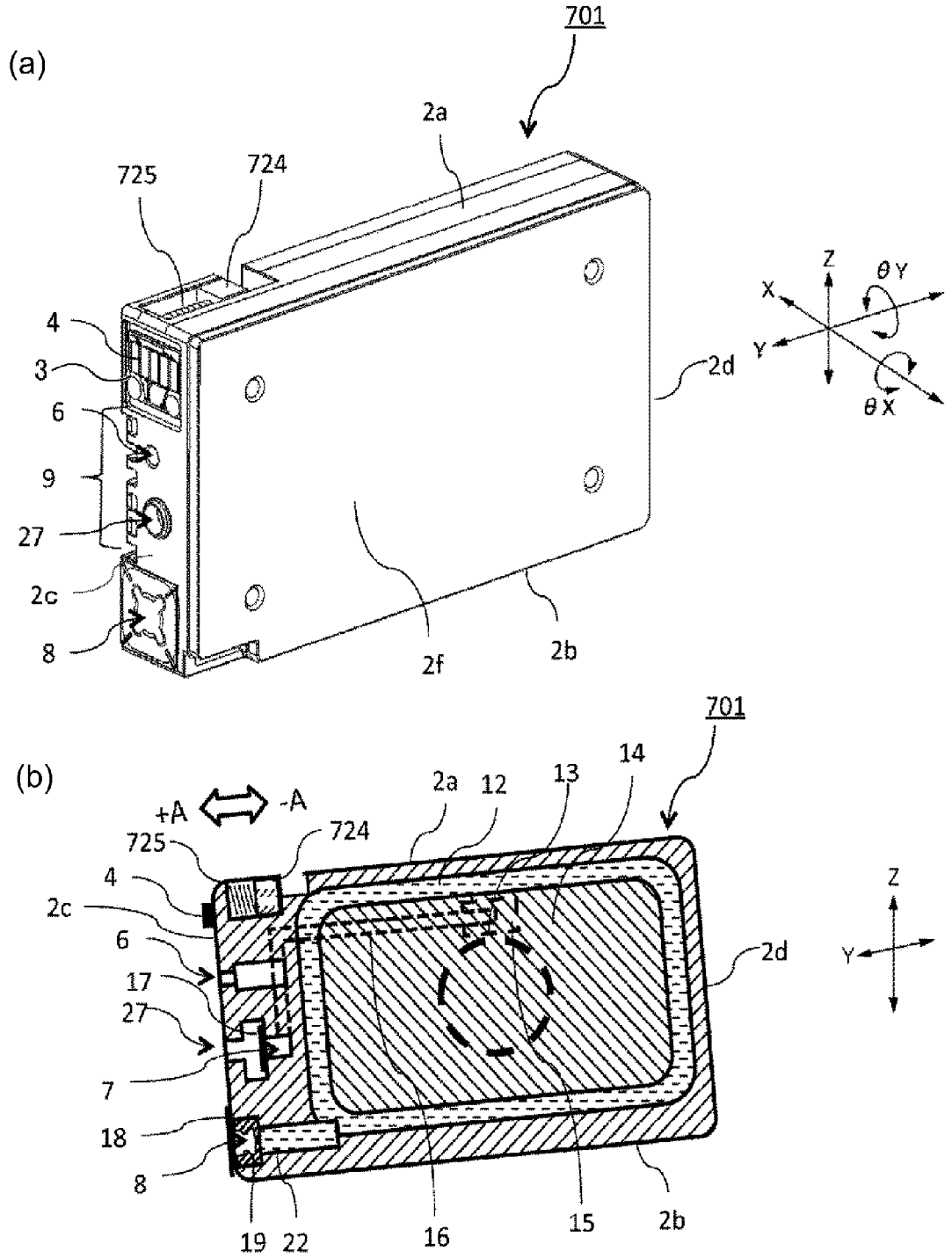
FIG. 29 illustrates a schematic structure of the ink cartridge 701 applicable in a ninth embodiment, in which part (a) is a perspective view of an outer appearance of the ink cartridge 701, and part (b) shows an internal structure of the ink cartridge 701 as seen from the right-hand surface side along the X axis direction.
Figure 30:
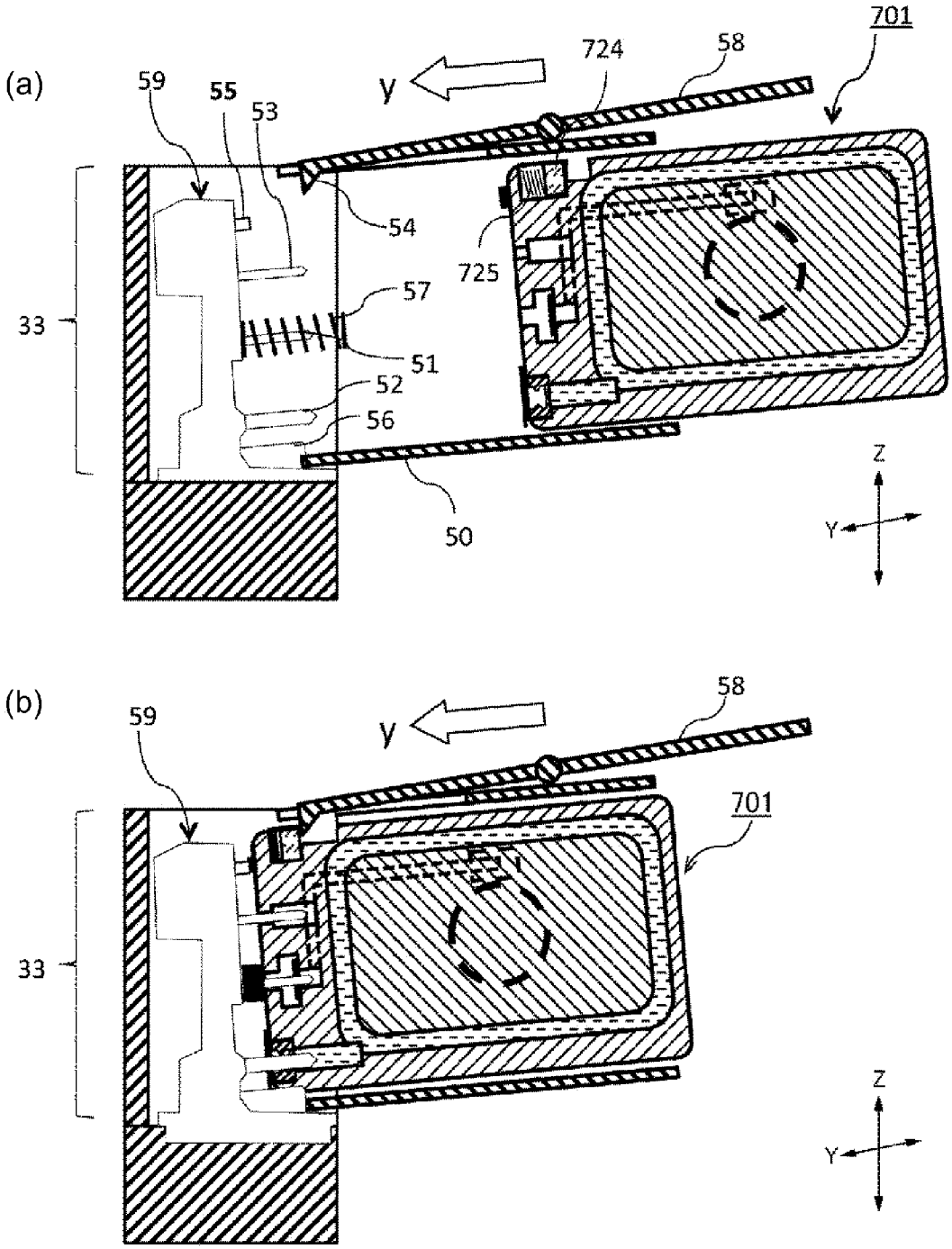
FIG. 30 illustrates a process of inserting the ink cartridge 701 in the ninth embodiment, in which part (a) shows an initial state of the insertion, and part (b) shows a completed state of the insertion.

Referring to FIGS. 29-30, a ninth embodiment will be described. This embodiment is different from the first embodiment only in the structure of the engaging portion, and the major structures in the other aspects of this embodiment are substantially the same as first embodiment. Therefore, in the description of this embodiment, the same reference numerals as in the first embodiment are assigned to the elements having the corresponding functions in this embodiment, and the detailed description thereof is omitted for simplicity.

FIG. 29 schematically shows the structure of the ink cartridge 701 of the ninth embodiment, in which (a) is a perspective view of the outer appearance of the ink cartridge 701, and (b) shows the internal structure of the ink cartridge 7601 as seen from the right-hand surface side along the X axis direction. The engaging portion 724 is a member movable relative to the front surface 2*c* of the casing 2*a*, and is provided on the upper surface 2*a* of the casing 2. The movable engaging portion 724 is urged by a spring 725 as an elastic portion in −A direction, and is movable in the −A and +A directions by the expansion and contraction of the spring 725. The spring 725 functions as engaging portion moving means for moving the engaging portion 724 relative to the casing 2. Similarly to the area 24*a* of the engaging recess 24 shown in FIG. 5, the engaging portion 724 crosses with the direction parallel with the normal line of the electrical contact 4 or the normal line of the area on the substrate 3 on which the electrical contact 4 is provided, and particularly in this embodiment, the engaging portion 724 is perpendicular to the direction parallel with the normal line.

The mounting operation of the ink cartridge 701 according to the ninth embodiment is shown in FIG. 30, and is almost the same as the mounting operation in the first embodiment shown in FIG. 10. Therefore, only the relationship between the engaging portion 724 and the locking lever 58 will be described. In the state that the engaging portion 724 does not contact the locking projection 54 (non-engagement state), the spring 725 is expanded as shown in part (a) of FIG. 30. When the ink cartridge 701 advances in the mounting direction (Y axis direction), the engaging portion 724 contacts to the locking projection 54 so that they are brought into engagement with each other, as shown in part (b) of FIG. 30. In the engagement state, the spring 725 is in the compressed state. The position of the engaging portion 724 in part (b) of FIG. 30 is closer to the front surface 2*c* or electrical contact 4 than the position of the engaging portion 724 in part (a) of FIG. 30.

[Tenth Embodiment]

Figure 31:
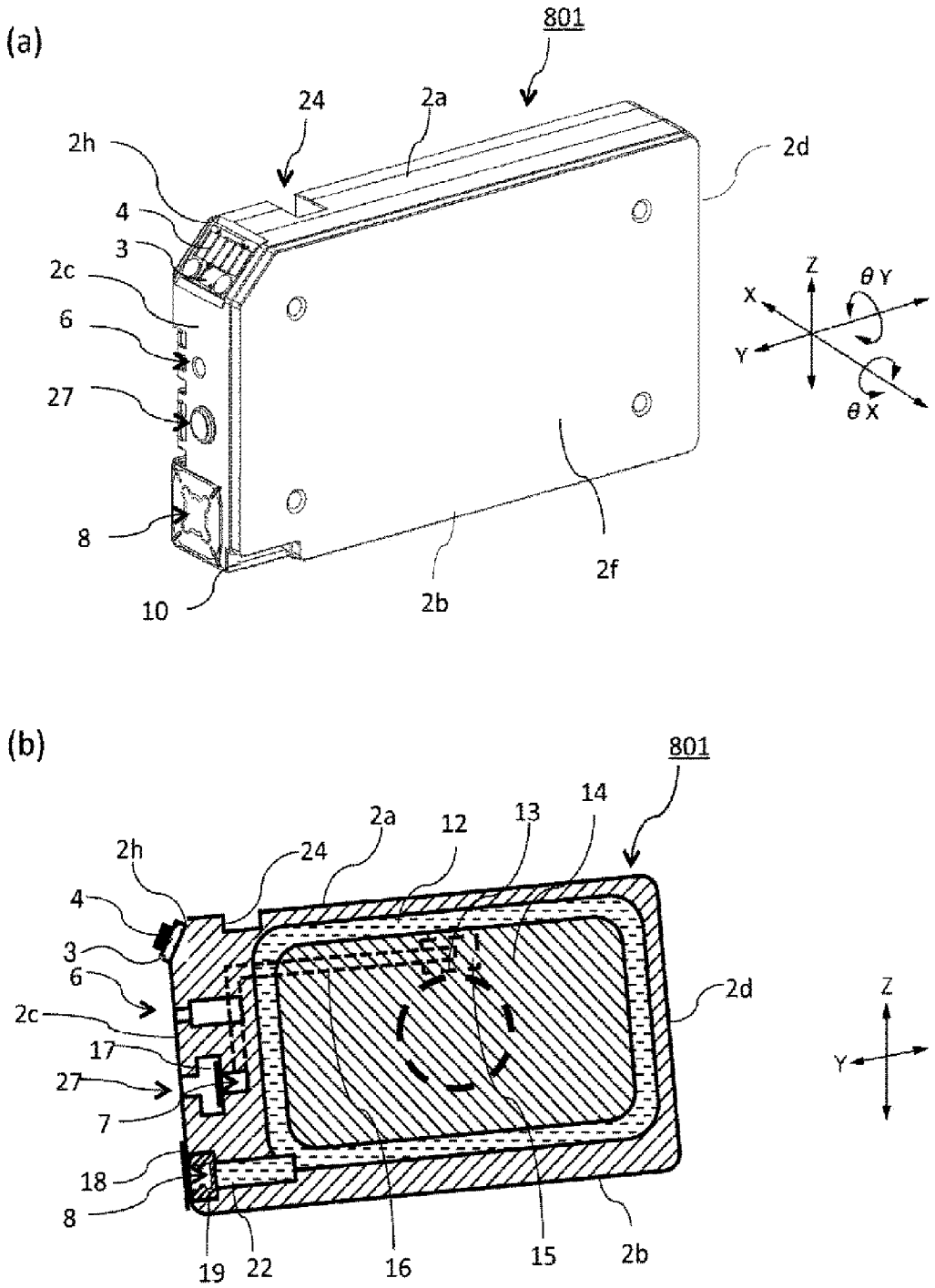
FIG. 31 illustrates a schematic structure of the ink cartridge 801 applicable in a tenth embodiment, in which part (a) is a perspective view of an outer appearance of the ink cartridge 801, and part (b) shows an internal structure of the ink cartridge 701 as seen from the right-hand surface side along the X axis direction.

Referring to FIG. 31, a tenth embodiment will be described. This embodiment is different from the first embodiment only in the disposition of the substrate having the electrical contacts, and the major structures in the other aspects of this embodiment are substantially the same as first embodiment. Therefore, in the description of this embodiment, the same reference numerals as in the first embodiment are assigned to the elements having the corresponding functions in this embodiment, and the detailed description thereof is omitted for simplicity.

FIG. 31 schematically shows the structure of the ink cartridge 801 of the tenth embodiment, in which (a) is a perspective view of the outer appearance of the ink cartridge 801, and (b) shows the internal structure of the ink cartridge 801 as seen from the right-hand surface side along the X axis direction. As will be understood from FIG. 31, the substrate 3 is provided on an inclined surface 2*h* connecting the upper surface 2*a* and the front surface 2*c*. More particularly, the electrical contact 4 on the substrate 3 has an area crossing with the Y axis direction so as to be electrically connectable to the main assembly side electrical connecting portion 55, and the area is inclined relative to both of the upper surface 2*a* and the front surface 2*c*. With this structure of FIG. 31, the electrical contact 4 has the area crossing with the cartridge inserting direction (Y axis direction), and therefore, the electrical contact 4 is not provided on a surface parallel with the Y axis direction, and the amount of rubbing between the electrical contact 4 and the main assembly side electrical connecting portion 55 upon the insertion of the ink cartridge 801 can be suppressed. Furthermore, similarly to the first embodiment, the plurality of electrical contacts 4 are arranged along the widthwise direction (X axis direction) of the ink cartridge 1101, and therefore, the same advantageous effects as of the first embodiment are provided. As will be understood from the description of this embodiment, the structures of the substrate 3 and the electrical contacts 4 of the ink cartridge according to the present invention are not limited to the structure in which they are provided on the front surface 2*c* as in the first-ninth embodiments.

The electrical contact 4 shown in FIG. 31 has (1) a area crossing with the cartridge inserting direction (mounting direction), (2) a area crossing with the Y axis direction, (3) a area crossing with the cartridge depth direction, (4) a area crossing with the direction parallel with the normal line of the tube inserting opening 8 (ink discharge opening) the formation surface, (5) a area crossing with the direction parallel with the extending direction of the tube insertion path (ink discharging path) 22, and (6) a area crossing with the direction parallel with the center line of the tube inserting opening (ink discharge opening) 8. The substrate 3 shown in FIG. 31 has (1) a surface crossing with the cartridge inserting direction (mounting direction), (2) a surface crossing with the Y axis direction, (3) a surface crossing with the cartridge depth direction, (4) a surface crossing with the direction parallel with the normal line of the tube inserting opening 8 (ink discharge opening) formation surface, (5) a surface crossing with the direction parallel with the extending direction of the tube insertion path (ink discharging path the 22, and (6) a surface crossing with the direction parallel with the center line of the tube inserting opening (ink discharge opening) 8.

[Eleventh Embodiment]

Figure 32:
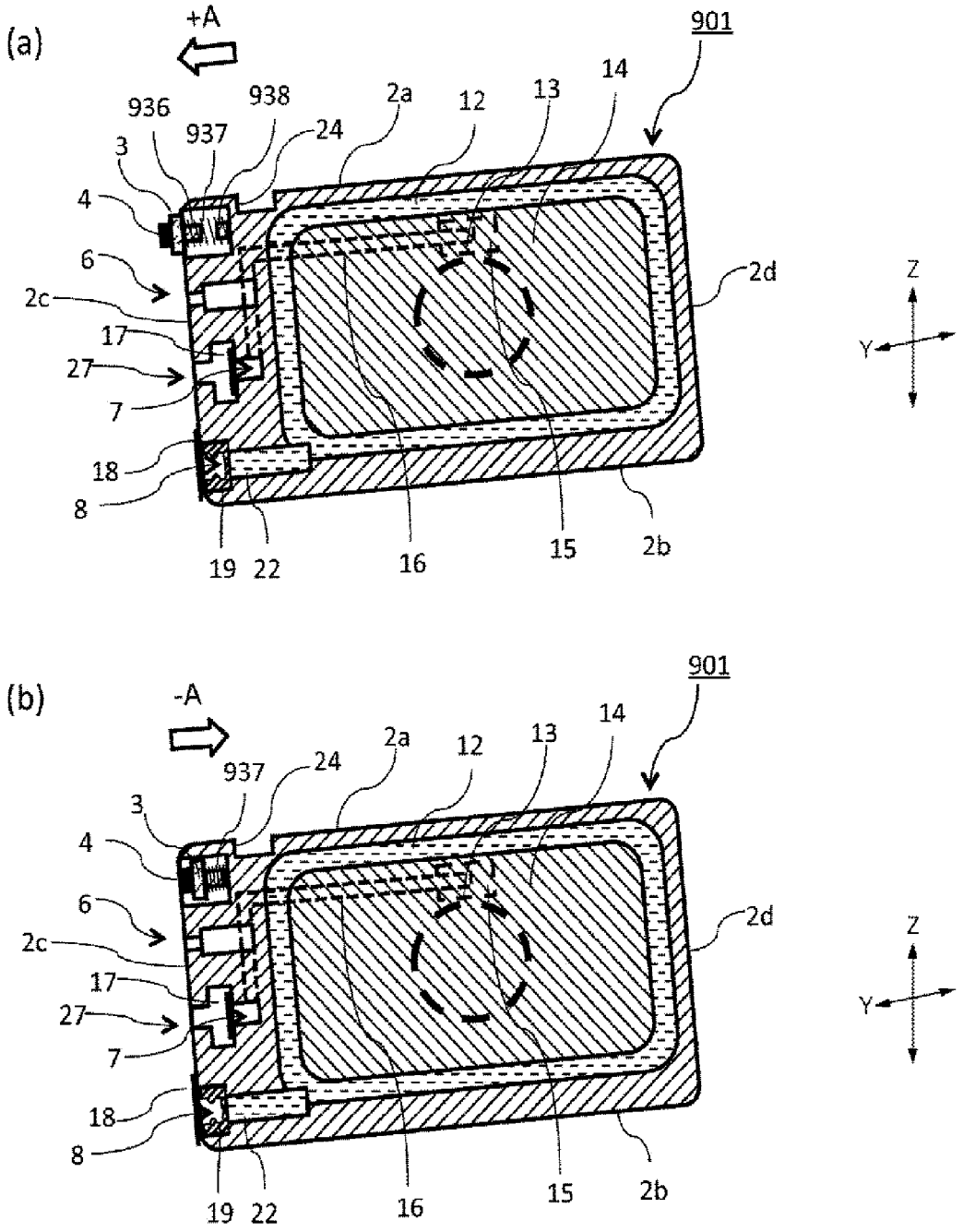
FIG. 32 illustrates a schematic structure of the ink cartridge 901 applicable in an eleventh embodiment, in which part (a) is a perspective view of an outer appearance of the ink cartridge 901, and part (b) shows an internal structure of the ink cartridge 901 as seen from the right-hand surface side along the X axis direction.
Figure 33:
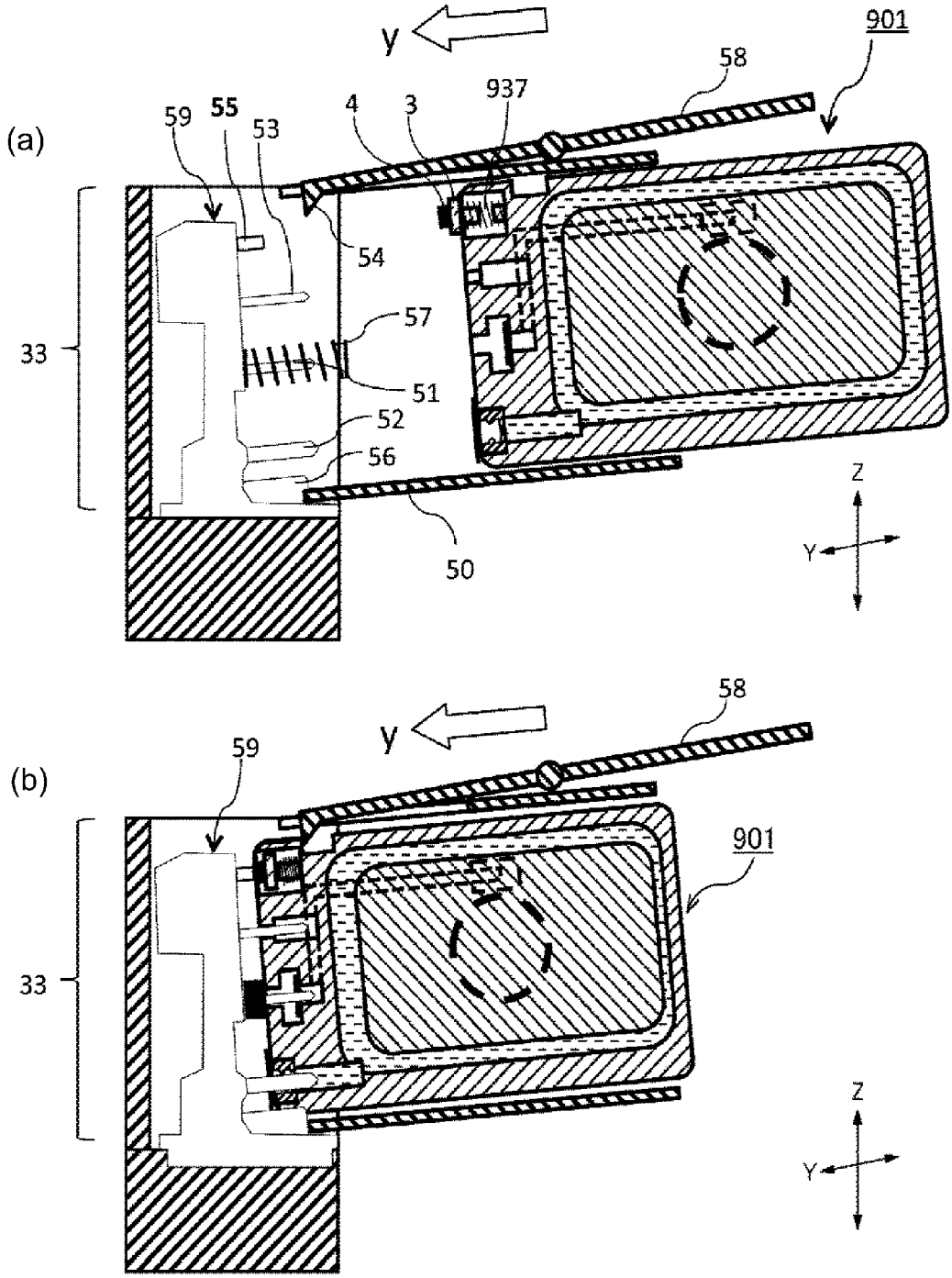
FIG. 33 illustrates a process of inserting the ink cartridge 901 in the eleventh embodiment, in which part (a) shows an initial state of the insertion, and part (b) shows a completed state of the insertion.

Referring to FIGS. 32-33, an eleventh embodiment will be described. This embodiment is different from the first embodiment only in the structure of supporting the substrate having the electrical contacts, and the major structures in the other aspects of this embodiment are substantially the same as first embodiment. Therefore, in the description of this embodiment, the same reference numerals as in the first embodiment are assigned to the elements having the corresponding functions in this embodiment, and the detailed description thereof is omitted for simplicity.

FIG. 32 schematically illustrates the structure of the ink cartridge 901 of the eleventh embodiment. The substrate 3 provided with the electrical contacts 4 is urged in the direction indicated by +A by a spring as an elastic member 937, and is movable in the directions +A and −A by the expansion and contraction of the spring 937. The spring 937 functions as a substrate moving means for moving the substrate 3 relative to the casing. The spring 937 is positioned by a projection 936 provided on the back side of the substrate 3 and a projection 938 provided on the front wall of the casing 2. In the state that the ink cartridge 901 is not mounted to the mounting portion 33 (non-use state of the ink cartridge), the spring 937 is in the expanded state, as shown in part (a) of FIG. 32. On the other hand, in the state that the ink cartridge 901 is mounted in the mounting portion 33, the spring 937 is in the compressed state as shown in part (b) of FIG. 32, and the substrate 3 retracts toward the rear side beyond the front surface 2*c* correspondingly to the compression of the spring 937.

FIG. 33 shows of the process in which the ink cartridge 901 of the eleventh embodiment is inserted into the mounting portion 33, in which a (a) shows an initial state of insertion, and on (b) shows the insertion completed state. The mounting operation in this embodiment is shown in FIG. 33, and is almost the same as the mounting operation in the first embodiment shown in FIG. 10. Therefore, only the expansion and contraction of the spring 937 and the movement of the substrate 3 will be described. In the state the electrical contact on the substrate 3 is not contacted with the main assembly side electrical connecting portion 55, as shown in part (a) of FIG. 33, the spring 937 is in the expanded state. When the ink cartridge 901 is inserted from the position shown in part (a) of FIG. 33 to the position shown in part (b) of FIG. 33, the electrical contact 4 contacts to the main assembly side electrical connecting portion 55. The cartridge 901 is further inserted toward the rear side, then the electrical contact 4 is pressed by the main assembly side electrical connecting portion 55, and the spring 937 is compressed, and the substrate 3 is moved toward the rear side beyond the front surface 2*c*. Thereafter, as shown in part (b) of FIG. 33, the engaging portion 24 is engaged with the locking lever 58, by which the mounting of the ink cartridge 901 is completed.

With this structure of FIG. 32, the substrate 3 is urged by the spring 937 in the direction of +A (mounting direction), and the contact between the electrical contacts 4 and the main assembly side electrical connecting portion 55 is easily stabilized. In addition, the substrate 3 is movable in the −A direction using the spring 937, and therefore, when the electrical contacts 4 contact to the main assembly side electrical connecting portions 55, the contact pressure therebetween does not increase beyond the necessity. As will be understood from the description of this embodiment, the substrate 3 and the electrical contacts 4 of the ink cartridge of the present invention is not limited to those fixed on the front surface 2*c*.

The electrical contact 4 shown in FIGS. 32 and 33 has (1) a area crossing with the cartridge inserting direction (mounting direction), (2) a area crossing with the Y axis direction, (3) a area crossing with the cartridge depth direction, (4) a area crossing with the direction parallel with the normal line of the tube inserting opening 8 (ink discharge opening) the formation surface, (5) a area crossing with the direction parallel with the extending direction of the tube insertion path (ink discharging path) 22, and (6) a area crossing with the direction parallel with the center line of the tube inserting opening (ink discharge opening) 8. The substrate 3 shown in FIGS. 32 and 33 has (1) a surface crossing with the cartridge inserting direction (mounting direction), (2) a surface crossing with the Y axis direction, (3) a surface crossing with the cartridge depth direction, (4) a surface crossing with the direction parallel with the normal line of the tube inserting opening 8 (ink discharge opening) formation surface, (5) a surface crossing with the direction parallel with the extending direction of the tube insertion path (ink discharging path the 22, and (6) a surface crossing with the direction parallel with the center line of the tube inserting opening (ink discharge opening) 8.

[Twelfth Embodiment]

Figure 34:
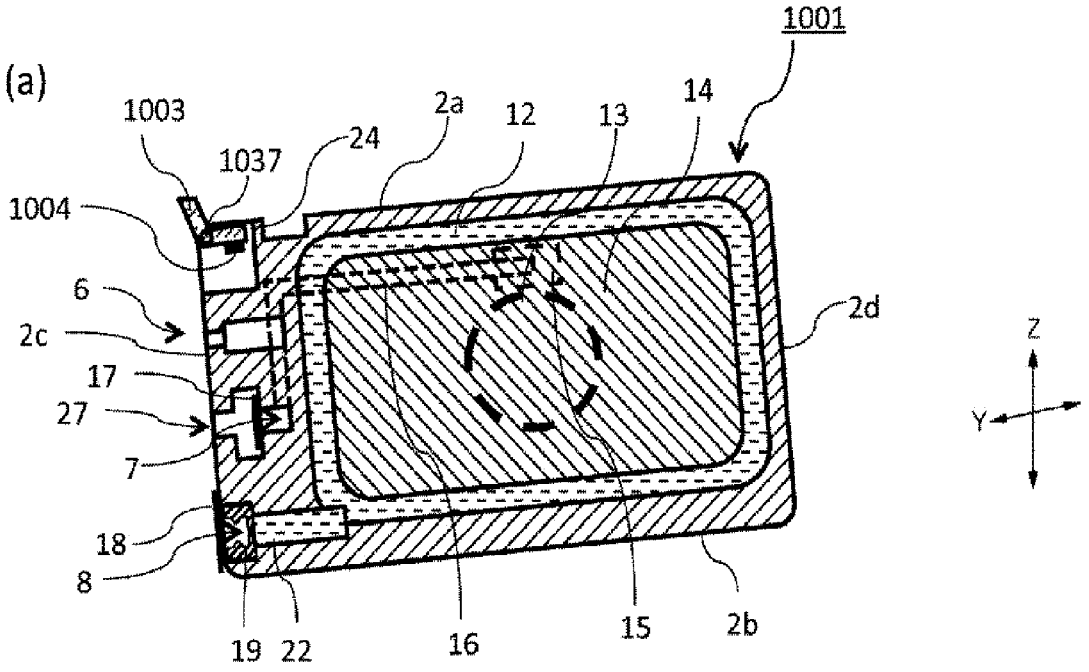
FIG. 34 illustrates a schematic structure of the ink cartridge 10701 applicable in a twelfth embodiment, in which part (a) is a perspective view of an outer appearance of the ink cartridge 1001, and part (b) shows an internal structure of the ink cartridge 1001 as seen from the right-hand surface side along the X axis direction.
Figure 34:
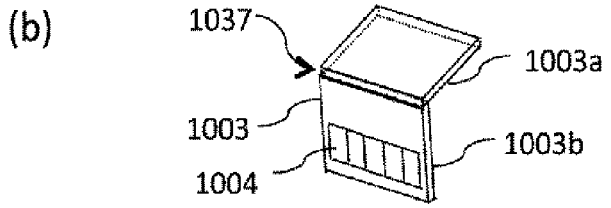
Figure 35:
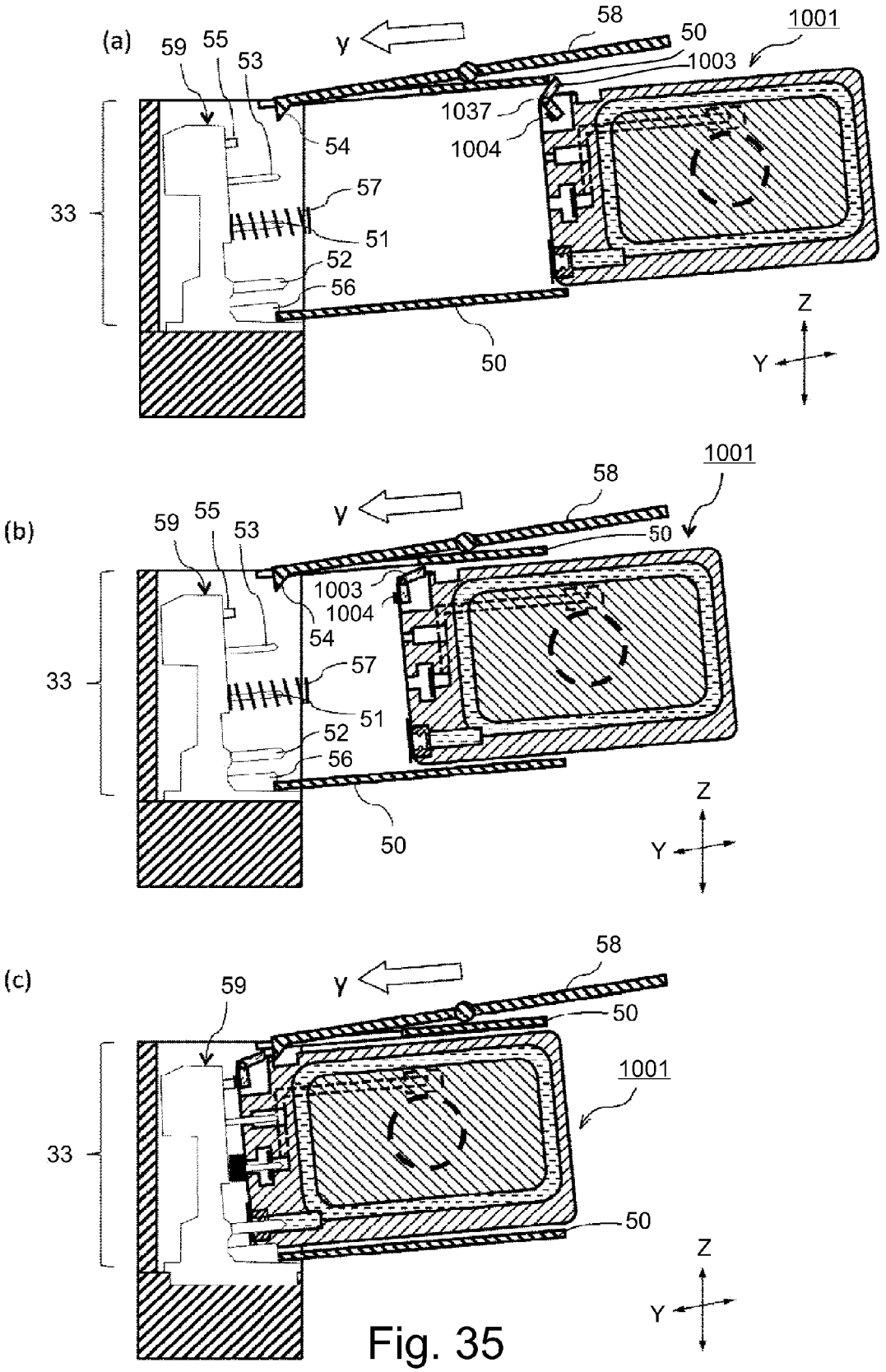
FIG. 35 illustrates a process of inserting the ink cartridge 1001 in the twelfth embodiment, in which part (a) shows an initial state of the insertion, part (b) shows an intermediate state of insertion, and part (c) shows a completed state of the insertion.

Referring to FIGS. 34-35, a twelfth embodiment will be described. This embodiment is different from the first embodiment only in the structure of the substrate having the electrical contacts, and the major structures in the other aspects of this embodiment are substantially the same as first embodiment. Therefore, in the description of this embodiment, the same reference numerals as in the first embodiment are assigned to the elements having the corresponding functions in this embodiment, and the detailed description thereof is omitted for simplicity.

FIG. 34 schematically shows the structure of the ink cartridge 801 of the twelfth embodiment, in which (a) shows an internal structure of the ink cartridge 1001 as seen from the right-hand surface side along the X axis direction, and (b) is a perspective view of a substrate 1003. The substrate 1003 provided with the electrical contact 1004 is rotatable about a rotation shaft 1037. The substrate 1003 has a L shape including a first portion 1003*a* and a second portion 1003*b* substantially perpendicular to the first portion, wherein the first portion 1003*a* and the second portion 1003*b* are connected with each other by the rotation shaft 1037. The rotation shaft 1037 is fixed to the casing at the opposite ends thereof. A back side of the second portion 1003*b* of the substrate 1003 is provided with a tension spring (unshown) connected to a lower surface of the upper wall of the casing 2. The tension spring urges the second portion 1003*b* of the substrate 1003 such that in the non-use state of the ink cartridge, the electrical contact 1004 faces substantially downwardly. On the other hand, the first portion 1003*a* of the substrate 1003 functions to receive a rotational force from the mounting portion 33 by being contacted by the mounting portion 33 in the insertion of the ink cartridge 1001. By the first portion 1003*a* receiving the rotational force, the entire substrate 1003 is rotated about the rotation shaft 1037, and the electrical contacts 1004 provided on the second portion 1003*b* of the substrate 1003 are electrically connected to the main assembly side electrical connecting portions 55. In this manner, the electrical contact 1004 faces substantially downwardly in the non-use state of the ink cartridge, but in the electrical connection state connecting with the main assembly side electrical connecting portions 55, it faces toward the front.

FIG. 35 shows the process in which the ink cartridge 1001 of the twelfth embodiment is inserted into the mounting portion 33, in which (a) shows an initial state of the insertion, (b) shows the state during the insertion, and (c) shows the insertion completed state. As shown in part (a) of FIG. 35, when the ink cartridge 1001 is inserted, the first portion 1003*a* of the substrate 1003 contacts to the upper mounting guide 50, so that the substrate 1003 is rotated. As shown in part (b) of FIG. 35, the ink cartridge 1001 is inserted in the state that the second portion 1003*b* of the substrate 1003 faces frontwardly. Thereof, as shown in part (c) of FIG. 35, the electrical contact of the substrate 1003 is electrically connected to the main assembly side electrical connecting portion 55, and the engaging portion 24 is engaged with the locking lever 58, thus completing the mounting. When the ink cartridge 1001 is dismounted from the cartridge mounting portion 33, the substrate 1003 is rotated in the opposite direction by the tension spring (unshown) provided on the back side of the second portion 1003*b* of the substrate 1003, by which the electrical contact 1004 faces downward as shown in part (a) of FIG. 34. The tension spring functions as substrate moving means for moving the substrate 1003 relative to the casing.

With this structure shown in FIGS. 34 and 35, the electrical contact the 1004 are placed in the casing at a deep portion which is less accessible by the user before the cartridge is mounted, and with the mounting operation of the ink cartridge, the substrate 1003 is rotated so that the electrical contacts 1004 are moved to the positions where they are electrically connectable with the main assembly side electrical connecting portion 55, and therefore, the likelihood of the user touching the electrical contacts 1004 before the mounting of the cartridge mounting can be reduced.

In the non-use state of the cartridge, the electrical contact 1004 shown in FIGS. 34 and 35 does not have (1) a area crossing with the cartridge inserting direction (mounting direction), (2) a area crossing with the Y axis direction, (3) a area crossing with the cartridge depth direction, (4) a area crossing with the direction parallel with the normal line of the tube inserting opening 8 (ink discharge opening) the formation surface, (5) a area crossing with the direction parallel with the extending direction of the tube insertion path (ink discharging path) 22, or (6) a area crossing with the direction parallel with the center line of the tube inserting opening (ink discharge opening) 8. However, in the mounting completed state of the ink cartridge 1001 or in the connected state relative to the main assembly side electrical connecting portion 55, the electrical contact 1004 shown in FIGS. 34 and 35 has these areas (1)-(6).

[Thirteenth Embodiment]

Figure 36:
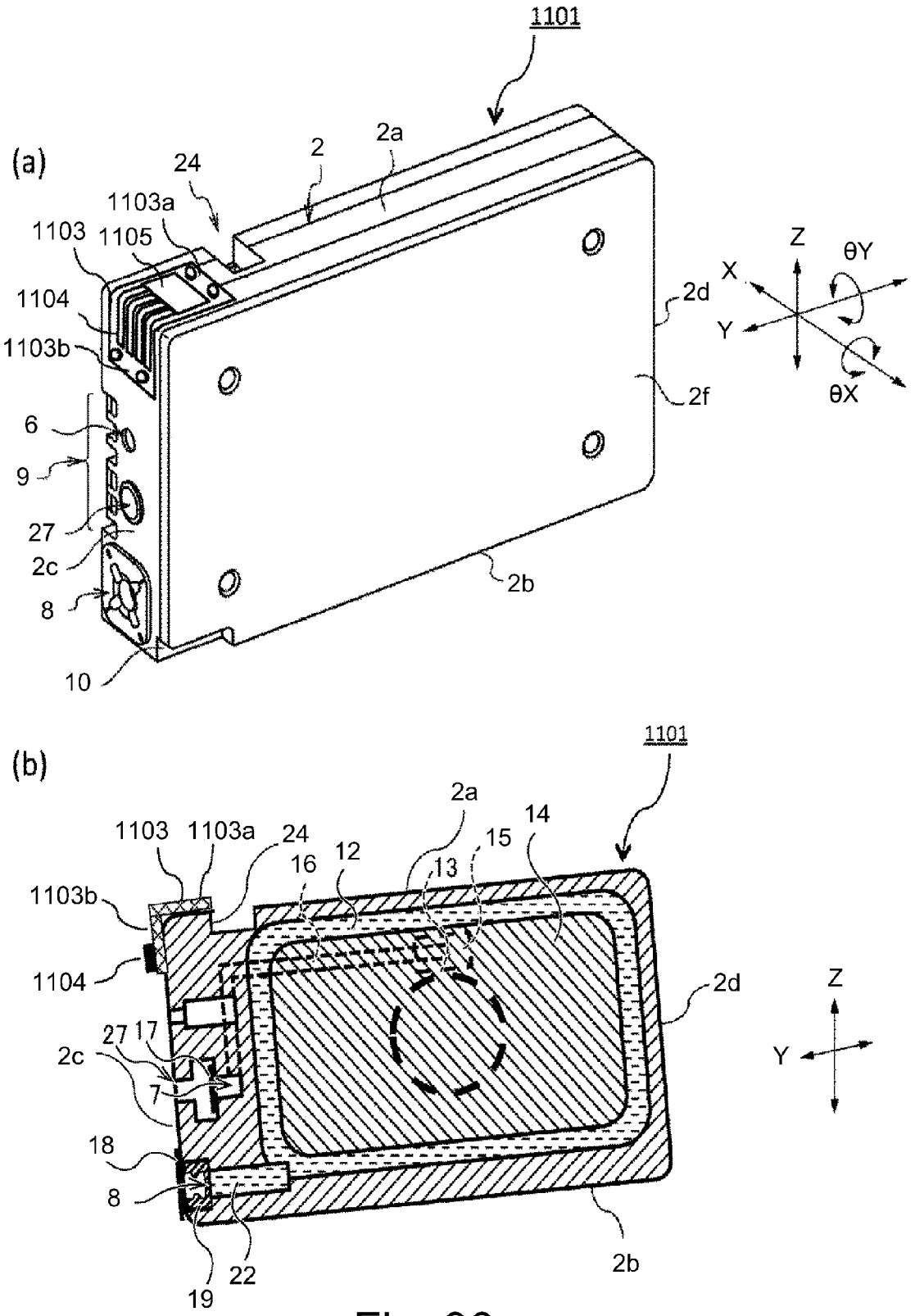
FIG. 36 illustrates a schematic structure of the ink cartridge 1101 applicable in a fourteenth embodiment, in which part (a) is a perspective view of an outer appearance of the ink cartridge 1101, and part (b) shows an internal structure of the ink cartridge 1101 as seen from the right-hand surface side along the X axis direction.
Figure 37:
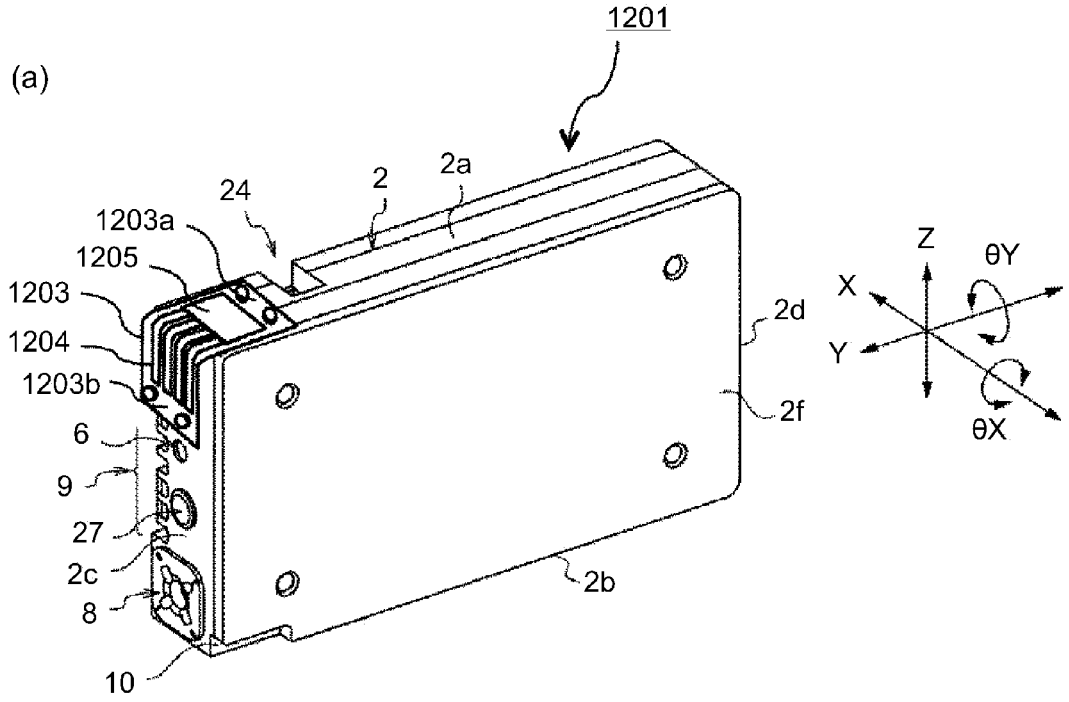
FIG. 37 illustrates a schematic structure of the ink cartridge 1201 applicable in a thirteenth embodiment, in which part (a) is a perspective view of an outer appearance of the ink cartridge 1201, and part (b) shows an internal structure of the ink cartridge 1201 as seen from the right-hand surface side along the X axis direction.
Figure 37:
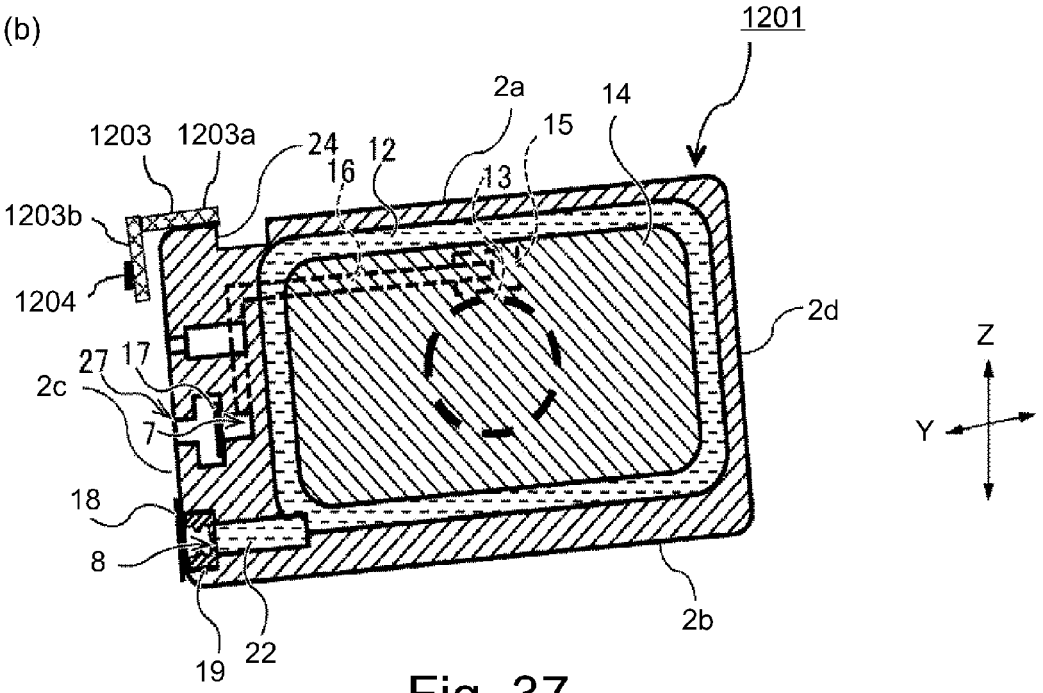

Referring to FIGS. 36 and 37, a thirteenth embodiment will be described. This embodiment is different from the first embodiment only in the structure and disposition of the substrate having the electrical contacts, and the major structures in the other aspects of this embodiment are substantially the same as the first embodiment. Therefore, in the description of this embodiment, the same reference numerals as in the first embodiment are assigned to the elements having the corresponding functions in this embodiment, and the detailed description thereof is omitted for simplicity.

FIG. 36 schematically shows the structure of the ink cartridge 1101 of the tenth embodiment, in which (a) is a perspective view of the outer appearance of the ink cartridge 1101, and (b) shows the internal structure of the ink cartridge 1101 as seen from the right-hand surface side along the X axis direction. As shown in FIG. 36, the substrate 1103 has a substantially L shape including a first portion 1103*a* parallel with the upper surface and a second portion 1103*b* substantially perpendicular to the first portion 1103*a*, and a back side of the first portion 1103*a* is supported by the upper surface 2*a*, and a back side of the second portion 1103*b* is supported by the front surface 2*c*. The electrode contact 1104 is supported by the second portion 1103*b* of the substrate 1103 such that it includes an area contactable to the main assembly side electrical connecting portion 55 (area crossing with the Y axis direction). The electrical contact 1104 is connected with a storing element 1105 provided in the first portion 1103*a* of the substrate 1103 through electric wiring.

FIG. 37 schematically shows the structure of the ink cartridge 1201 of the tenth embodiment, in which (a) is a perspective view of the outer appearance of the ink cartridge 1201, and (b) shows the internal structure of the ink cartridge 1201 as seen from the right-hand surface side along the X axis direction. As shown in FIG. 37, the substrate 1203 has a substantially L shape including a first portion 1203*a* parallel with the upper surface and a second portion 1203*b* bent from the first portion 1203*a*, and a back side of the first portion 1203*a* is supported by the upper surface 2*a*. The back side of the second portion 1203*b* is spaced from the front surface 2*c*, as is different from the structure of FIG. 36. The electrode contact 1204 is supported by the second portion 1203*b* of the substrate 1203 such that it includes an area contactable to the main assembly side electrical connecting portion 55 (area crossing with the Y axis direction). The electrical contact 1204 is connected with a storing element 1205 provided in the first portion 1203*a* of the substrate 1203 through electric wiring. When the ink cartridge 1201 is inserted into the mounting portion 33, the electrical contact 1204 contacts to the main assembly side electrical connecting portion 55, and then the second portion 1203*b* of the substrate 1203 is deformed while keeping the contact state therebetween and contacts to the front surface 2*c* of the casing 2. In this state, the engaging portion 24 is engaged with the locking lever 58, thus completing the mounting operation.

With this structures shown in FIGS. 36 and 37, the electrical contacts 1104, 1204 have areas crossing with the cartridge inserting direction (Y axis direction), and are not provided on a surface parallel with the Y axis direction, and therefore, the amount of rubbing between the electrical contacts and the main assembly side electrical connecting portions 55 can be suppressed. Furthermore, similarly to the first embodiment, the plurality of electrical contacts 1104, 1204 are arranged in the widthwise direction (X axis direction) of the ink cartridge 1301, and therefore, the same advantageous effects as with the first embodiment are provided. As will be understood from the description of this embodiment, the substrate 3 of the ink cartridge of the present invention is not limited to that supported by the front surface 2*c*.

The electrical contacts 1104 and 1204 shown in FIGS. 36 and 37 each have (1) a area crossing with the cartridge inserting direction (mounting direction), (2) a area crossing with the Y axis direction, (3) a area crossing with the cartridge depth direction, (4) a area crossing with the direction parallel with the normal line of the tube inserting opening 8 (ink discharge opening) the formation surface, (5) a area crossing with the direction parallel with the extending direction of the tube insertion path (ink discharging path) 22, and (6) a area crossing with the direction parallel with the center line of the tube inserting opening (ink discharge opening) 8. The substrate (1103, 1203) shown in FIGS. 36 and 37 each have (1) a surface (1103*b*, 1203*b*) crossing with the cartridge inserting direction (mounting direction), (2) a surface (1103*b*, 1203*b*) crossing with the Y axis direction, (3) a surface (1103*b*, 1203*b*) crossing with the cartridge depth direction, (4) a surface (1103*b*, 1203*b*) crossing with the direction parallel with the normal line of the tube inserting opening 8 (ink discharge opening) formation surface, (5) a surface (1103*b*, 1203*b*) crossing with the direction parallel with the extending direction of the tube insertion path (ink discharging path the 22, and (6) a surface (1103*b*, 1203*b*) crossing with the direction parallel with the center line of the tube inserting opening (ink discharge opening) 8.

[Fourteenth Embodiment]

Figure 38:
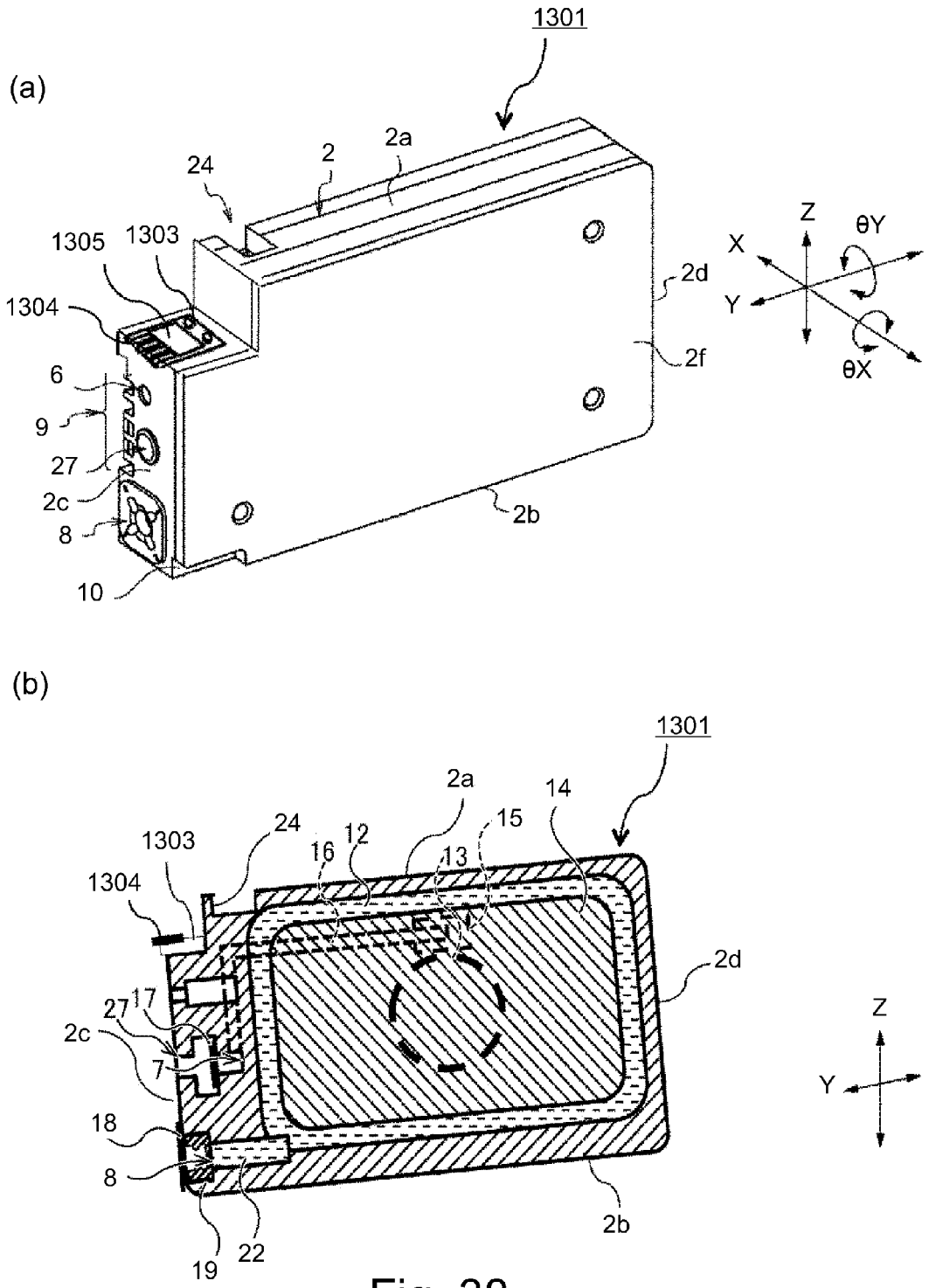
FIG. 38 illustrates a schematic structure of the ink cartridge 1301 applicable in a fourteenth embodiment, in which part (a) is a perspective view of an outer appearance of the ink cartridge 1301, and part (b) shows an internal structure of the ink cartridge 1301 as seen from the right-hand surface side along the X axis direction.

Referring to FIG. 38, a fourteenth embodiment will be described. This embodiment is different from the first embodiment only in the structure and disposition of the substrate having the electrical contacts, and the major structures in the other aspects of this embodiment are substantially the same as first embodiment. Therefore, in the description of this embodiment, the same reference numerals as in the first embodiment are assigned to the elements having the corresponding functions in this embodiment, and the detailed description thereof is omitted for simplicity.

FIG. 38 schematically shows the structure of the ink cartridge 1301 of the tenth embodiment, in which (a) is a perspective view of the outer appearance of the ink cartridge 1301, and (b) shows the internal structure of the ink cartridge 1301 as seen from the right-hand surface side along the X axis direction. A substrate 1303 is provided on a cut-away portion of the positional connecting the upper surface 2*a* and the front surface 2*c* substantially in parallel with the upper surface 2*c*. Electrical contacts 1304 are provided at a front surface free end of the substrate 1303, and storing element 1305 is provided behind the electrical contacts 1304, that is, in the rear side on the substrate 1303. The electrical contacts 1304 and the storing element 1305 are connected with each other through electric wiring.

With this structure of FIG. 38, the electrical contacts 1304 have areas crossing with the cartridge inserting direction (Y axis direction) and are not provided on a surface parallel with Y axis direction, and therefore, the amount of rubbing between the electrical contacts 4 and the main assembly side electrical connecting portions 55 during the inserting operation can be suppressed. Furthermore, similarly to the first embodiment, the plurality of electrical contacts 4 are arranged in the widthwise direction (X axis direction) of the ink cartridge 1301, and therefore, the same advantageous effects as with the first embodiment are provided. With this structure of FIG. 38, the substrate 1303 is provided on the cut-away portion, but the present invention is not limited to such a structure, and the substrate 1303 may be provided on the upper surface 2*a*. Even in such a case, the electrical contacts 1304 are disposed at the free end of the front side on the substrate 1303.

As is different from the substrates 3 shown in FIG. 2, FIG. 31 and FIG. 32, the substrate 1303 shown in FIG. 38 does not have (1) a surface crossing with the cartridge inserting direction (mounting direction), (2) a surface crossing with the Y axis direction, (3) a surface crossing with the cartridge depth direction, (4) a surface crossing with the direction parallel with the normal line of the tube inserting opening 8 (ink discharge opening) the formation surface, (5) a surface crossing with the direction parallel with the extending direction of the tube insertion path (ink discharging path) 22, or (6) a surface crossing with the direction parallel with the center line of the tube inserting opening (ink discharge opening) 8. However, as will be understood from FIG. 38, the electrical contacts 1304 on the substrate 1303 each have (1) a area crossing with the cartridge inserting direction (mounting direction), (2) a area crossing with the Y axis direction, (3) a area crossing with the cartridge depth direction, (4) a area crossing with the direction parallel with the normal line of the tube inserting opening 8 (ink discharge opening) formation surface, (5) a area crossing with the direction parallel with the extending direction of the tube insertion path (ink discharging path the 22, and (6) a area crossing with the direction parallel with the center line of the tube inserting opening (ink discharge opening) 8.

[Fifteenth Embodiment]

Figure 39:
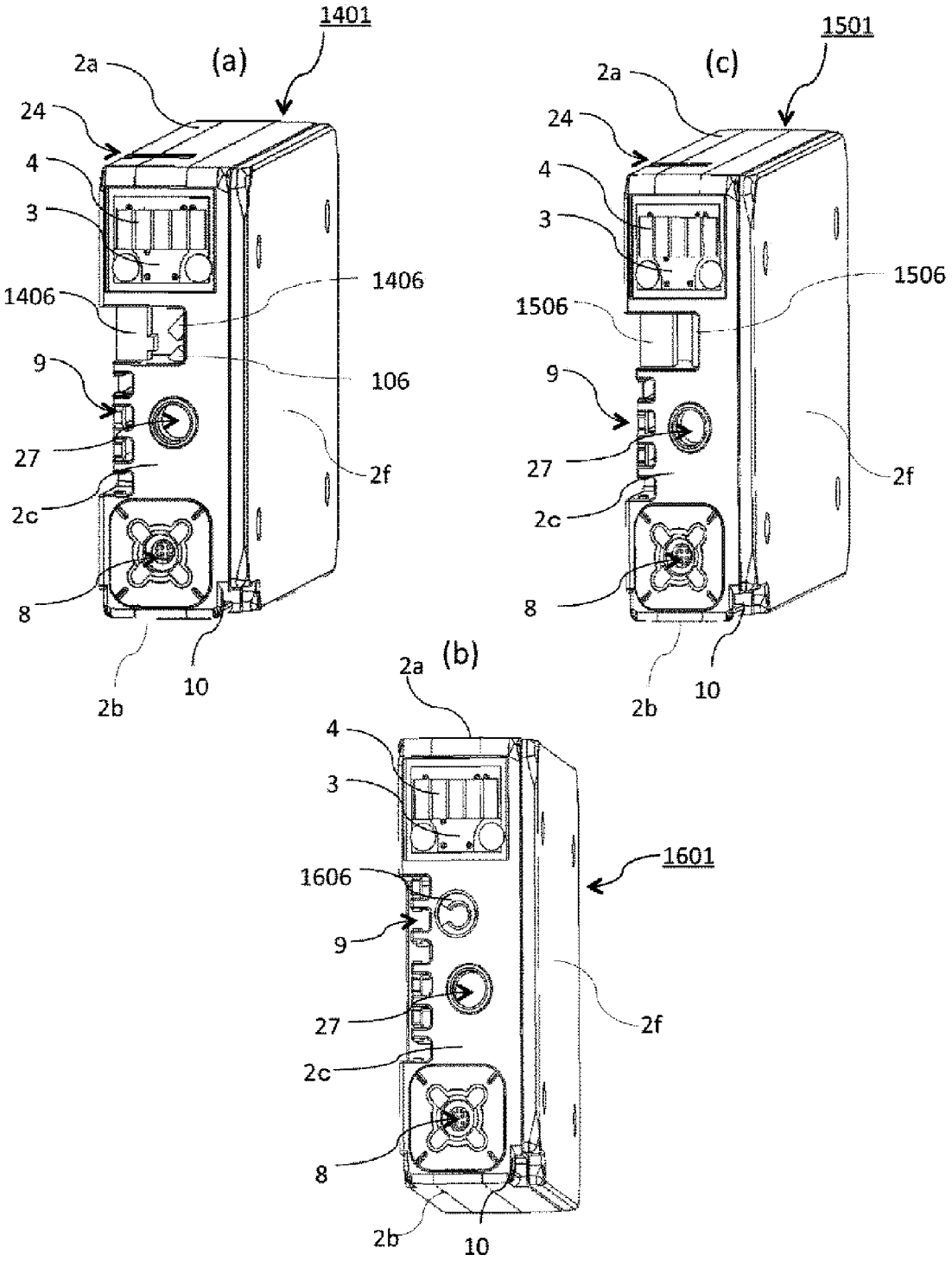
FIG. 39 illustrates a structure of a positioning portion applicable in a fifteenth embodiment.

Referring to FIG. 39, a fifteenth embodiment will be described. This embodiment is different from the first embodiment only in the structure of the positioning portion, and the major structures in the other aspects of this embodiment are substantially the same as first embodiment. Therefore, in the description of this embodiment, the same reference numerals as in the first embodiment are assigned to the elements having the corresponding functions in this embodiment, and the detailed description thereof is omitted for simplicity.

FIG. 39 shows a structure of a positioning portion used in the fifteenth embodiment. The ink cartridge 1401 shown in part (a) of FIG. 39 is provided with a plurality of projections 1406 engageable with a positioning pin 53, and the projections 1406 function as a positioning portion 1406. The plurality of projections 1406 are provided behind the front surface 2*c*. The opening surrounded by the projections 1406 are disposed below the electrical contacts 4 and above the ink discharge opening 8, more particularly in the position closer to the electrical contacts than the ink discharge opening 8. The positioning pin 53 is inserted into the opening surrounded by the plurality of projections 1406 so that the positioning pin 53 is engaged with the plurality of projections 1406, by which the movement of the cartridge in a direction (along the front surface 2*c*, for example) perpendicular to the cartridge mounting direction is limited.

In addition, an ink cartridge 1501 shown in part (b) of FIG. 39 is provided with a slit formation member 1506 defining a slit capable of receiving the positioning pin 53, and the slit formation member 1506 functions as the positioning portion. The slit formation member 1506 is provided behind the front surface 2*c*. The slit provided by the slit formation member 1506 is below the electrical contacts 4 and above the ink discharge opening 8, more particularly in a position closer to the electrical contact than the ink discharge opening 8. The positioning pin 53 is inserted into the slit and is engaged with the slit formation member 1506, so that the movement of the cartridge in the direction (along the front surface 2*c*, for example) perpendicular to the cartridge mounting direction is limited.

The ink cartridge 1601 shown in part (c) of FIG. 39 is provided with a C-shape member 1606 having an opening capable of receiving the positioning pin 53, and the C-shaped member 1606 functions as the positioning portion. The C-shaped member 1606 is provided behind the front surface 2*c*. The opening defined by the C-shaped member 1606 is disposed below the electrical contacts 4 and above the ink discharge opening 8, more particularly in the position closer to the electrical contacts 4 than to the ink discharge opening 8. The positioning pin 53 is inserted into the opening and is engaged with the C-shaped member 1606, so that the movement of the cartridge in the direction (along the front surface 2*c*, for example) perpendicular to the cartridge mounting direction.

As described above, the positioning portion of the present invention is not limited to the positioning hole 6 provided in the front surface 2*c* of the casing 2 of the first embodiment. The positioning portion 6 may be any if it can act on the positioning pin 53 to position the ink cartridge.

[Sixteenth Embodiment]

Figure 40:
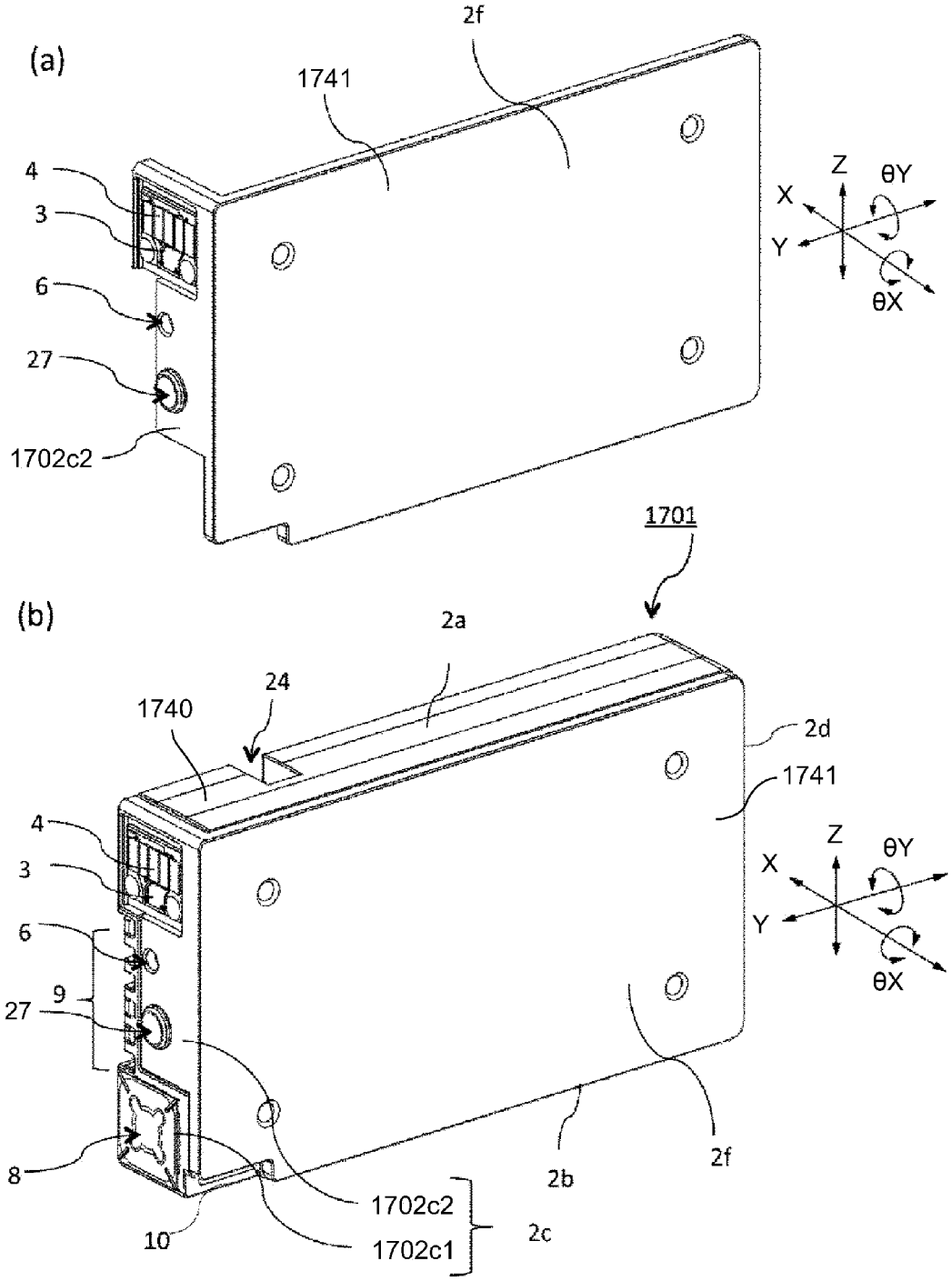
FIG. 40 illustrates a schematic structure of an ink cartridge applicable in a sixteenth embodiment, in which part (a) illustrates a second casing member 41 which is a constituent-element of a casing 2, and part (b) is a perspective view of an ink cartridge 1701 having the second casing member 41.

Referring to FIG. 40, the sixteenth embodiment will be described. In this embodiment, a substrate 3, a positioning portion 3 and a penetrated portion 27 are provided in a second casing member 1741 which is a constituent-element of the casing 2, and a tube inserting opening 8 and a discrimination portion 9 are provided in the first casing member 1740 which is another constituent-element of the casing 2. This embodiment is different from the first embodiment only in that a part of the cartridge interface portions is provided in the second casing member functioning as a closing member, and the major structures in the other aspects of this embodiment are substantially the as first embodiment. Therefore, in the description of this embodiment, the same reference numerals as in the first embodiment are assigned to the elements having the corresponding functions in this embodiment, and the detailed description thereof is omitted for simplicity.

FIG. 40 schematically shows the structure of the sixteenth embodiment, in which (a) shows the second casing member 1741 which is a constituent-element of the casing 2, and (b) as a perspective view of an ink cartridge 1701 including the first casing member 1740 and the second casing member 1741. As shown in part (a) of FIG. 40, the second casing member 1741 in this embodiment is similar to the second casing member 41 of the first embodiment shown in FIG. 4, but it is additionally provided with a second front wall forming member 1702*c*2 which is a major part of the front wall/front surface of the casing 2. The second front wall forming member 1702*c*2 is provided with the substrate 3 having the electrical contacts 4, the positioning portion 6 and the penetrated portion 27. On the other hand, the first casing member 1740 is similar to the first casing member but it is deprived of the substrate 3, the positioning portion 6 and the penetrated portion 27, and only a part of the front wall 2*c* remains as the first front wall forming member 1702*c*1. That is, the first casing member 1740 includes an upper surface 2*a* provided with an engaging portion 24, a lower surface 2*b*, a rear surface 2*d*, a left surface 2*e* (unshown) and the first front wall forming member 1702*c*1, which is provided with the tube inserting opening 8 and the discrimination portion 9. By mounting such a second casing member 1741 to the first casing member 1740, the ink cartridge 1701 shown in part (b) of FIG. 40 is provided. As will be apparent from part (b) of FIG. 40, the front wall/front surface 2*c* of the casing 2 comprises the first the front wall forming member 1702*c*1 which is a constituent-element of the first casing member 1740 and the second the front wall forming member 1702*c*2 which is a constituent-element of the second casing member 1741. As will be understood from the above, the casing of the ink cartridge of the present invention is not limited to that formed by the first casing member and the second casing member according to the first embodiment. In addition, the front wall/front surface 2*c* of the casing is not limited to that formed by a single member, but the front wall/front surface 2*c* of the casing may be formed by a plurality of members. In addition, the cartridge side interface portions to be provided on the front wall/front surface of the casing may be distributed in the members constituting the front wall/front surface of the casing.

[Seventeenth Embodiment]

Figure 41:
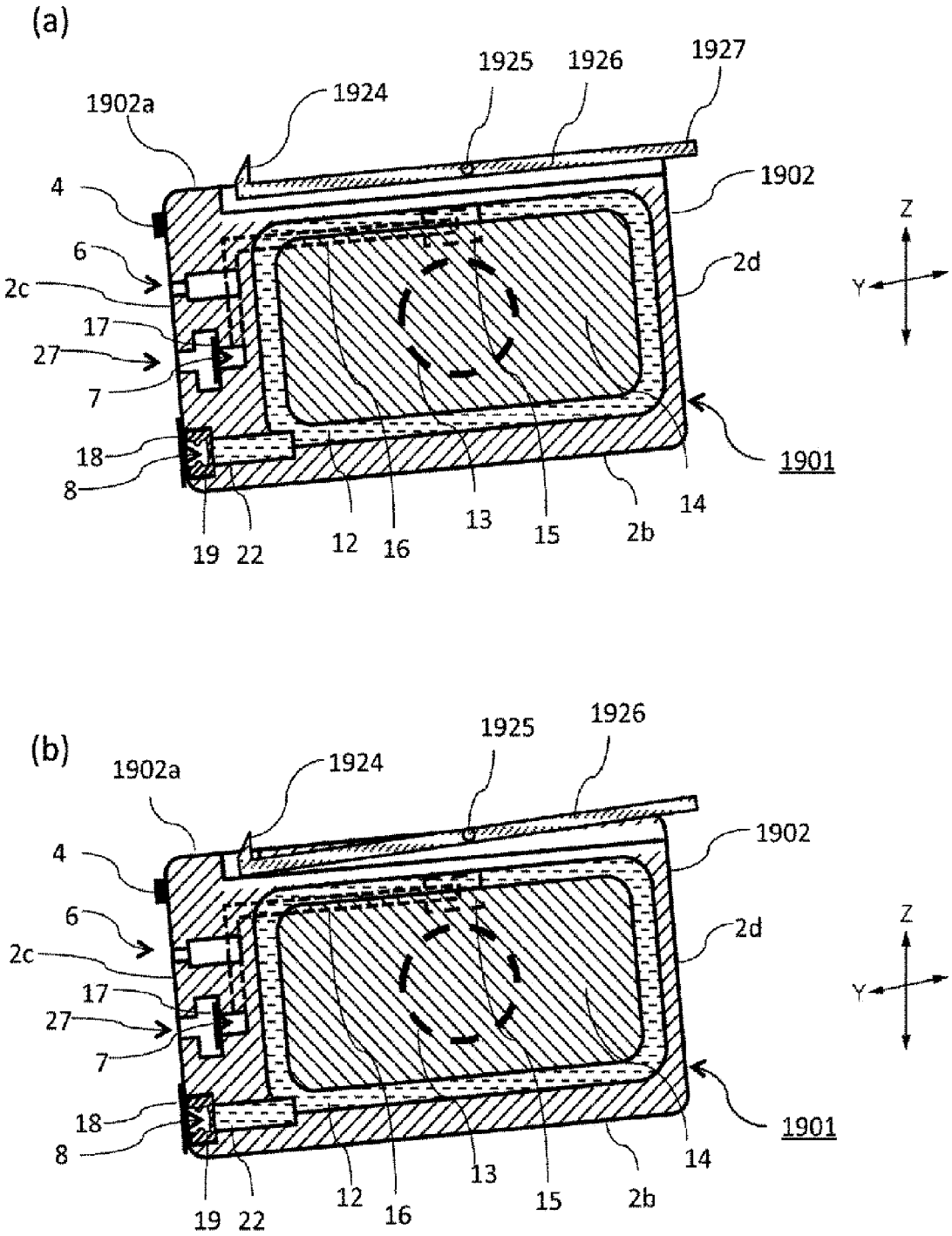
FIG. 41 illustrates a schematic structure of an ink cartridge 1901 applicable in a seventeenth embodiment and shows a movement of the engaging portion 1924 in accordance with a movement of an engagement lever 1926.
Figure 42:
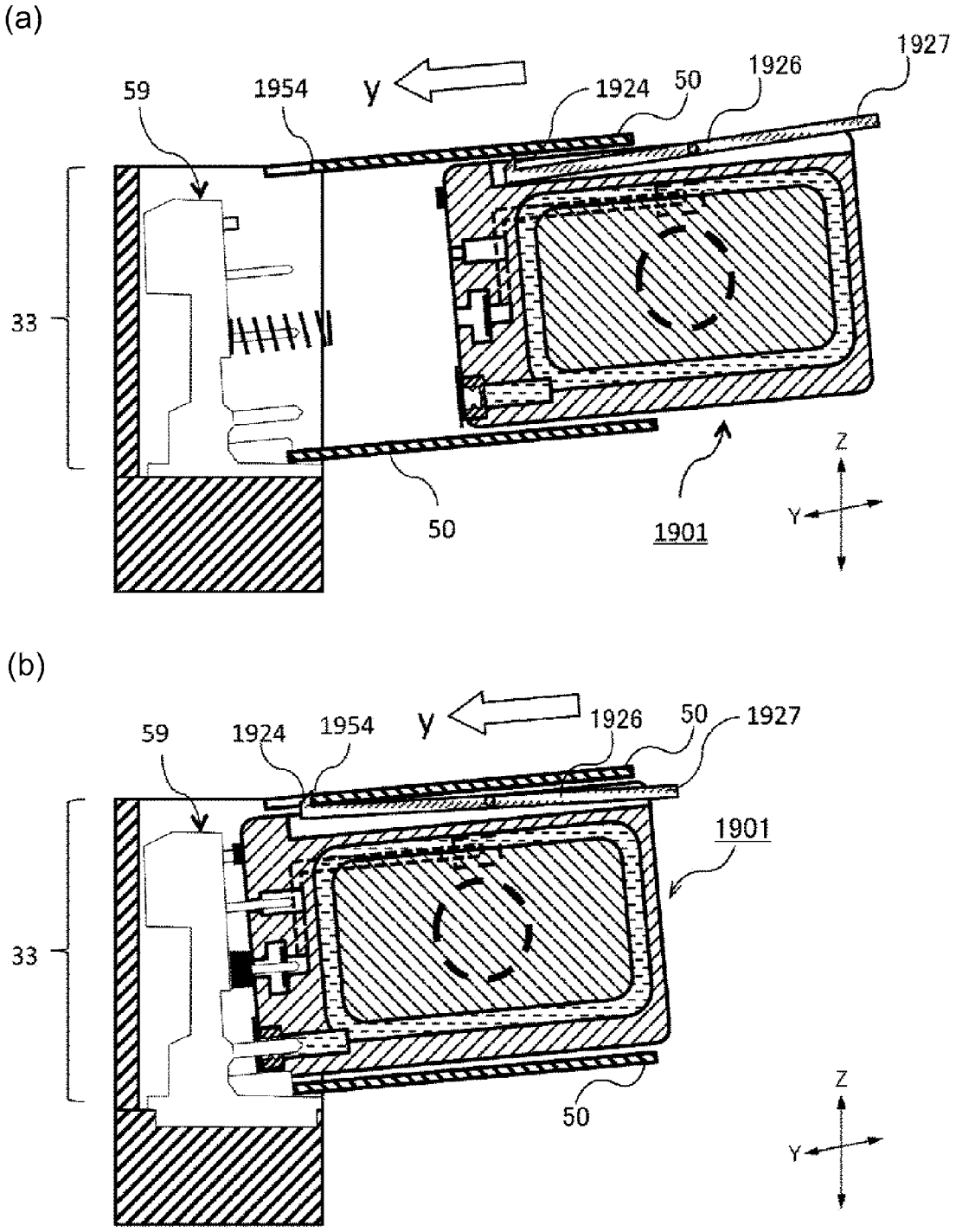
FIG. 42 illustrates a process of inserting the ink cartridge 1901 in the seventeenth embodiment, in which part (a) shows an initial state of the insertion, and part (b) shows a completed state of the insertion.

Referring to FIGS. 41-42*a* seventeenth embodiment will be described. This embodiment is different from the first embodiment only in the structure of the engaging portion of the ink cartridge and the locking portion of the cartridge mounting portion 33, and the major structures in the other aspects of this embodiment are substantially the same as first embodiment. Therefore, in the description of this embodiment, the same reference numerals as in the first embodiment are assigned to the elements having the corresponding functions in this embodiment, and the detailed description thereof is omitted for simplicity FIG. 41 schematically shows the structure of the ink cartridge 1901 of the seventeenth embodiment, in which the engaging portion 1924 moves with the movement of the engagement lever 1926. As shown in FIG. 41, the ink cartridge 1901 includes a movable engagement lever 1926 having an engaging portion 1942. The engagement lever 1926 is rotatable about a rotation shaft 1925 supported by the upper surface 2*a*, and the engaging portion 1924 is movable toward and away from the upper surface 1902*a* of the casing 1902 by the rotation of the locking lever 1926, so that the distance between the engaging portion 1924 and the upper surface 1902*a* of the casing 1902 changes. Part (a) of FIG. 41 shows the state of the engagement lever when the distance between the engaging portion 1924 and the upper surface 1902*a* of the casing 1902 is relatively large, and part (b) of FIG. 41 shows the state of the engagement lever when the distance between the engaging portion 1924 and the upper surface 1902*a* of the casing 1902 is relatively small. The engaging portion 1924 provided on the engagement lever 1926 is movable to the neighborhood of the upper surface 2*c*, and similarly to the first embodiment, it is disposed in a position closer to the electrical contact 4 than to the ink discharge opening 8. Therefore, the same advantageous effects as of the first embodiment are provided.

FIG. 42 shows of the process in which the ink cartridge 901 of the seventeenth embodiment is inserted into the mounting portion 33, in which a (a) shows an initial state of insertion, and (b) shows the insertion completed state. When the ink cartridge 1901 is inserted, the engaging portion 1924 contacts to the upper part mounting guide 50 provided in the cartridge mounting portion 33, by which the engaging portion 1924 is moved so that the engagement lever 1926 moves toward the upper surface 2*a*. Part (a) of FIG. 42 shows the state in which the engaging portion 1924 comes close to the upper surface 2*a*. When the ink cartridge 1901 is further inserted from the position shown in part (a) of FIG. 42, and the engaging portion 1924 passes an end portion of the upper part mounting guide 50, the engagement lever 1926 moves so that the engaging portion 1924 is away from the upper surface 2*a*. By this, the engaging portion 1924 is brought into engagement with the engageable member 1954 provided at the end of the upper part mounting guide 50, thus completing the mounting of the ink cartridge 1901.

When the ink cartridge 1901 is to be dismounted from the cartridge mounting portion 33, the rear side end portion 1927 of the engagement lever 1926 is raised (Z axis direction). By this, the engaged state between the engaging portion 1924 and the engageable member 1954 is released, by which the ink cartridge 1901 is moved in the dismounting direction by the urging force of the ejection spring 57, thus permitting the user to dismount the ink cartridge 1901 from the cartridge mounting portion 33. When the user operates the locking lever 1926 to disengage the engaging portion 1924 from the engageable member 1954, the ink cartridge 1901 is moved in the dismounting direction by the spring force, and at this time, a hand of the user is in the neighborhood of the dismounting position, and therefore, if the spring force is strong, the ink cartridge 1901 popped out by the spring force can be easily caught by the hand of the user, and the stronger popping out of the ink cartridge 1901 than is necessary can be suppressed.

As will be understood from the description of this embodiment, the engaging portion usable in the ink cartridge of the present invention is not limited to the structure engageable with the locking lever 58 of the cartridge mounting portion 33. The engaging portion may be replaced with any of various structures engageable with the element of the cartridge mounting portion 33.

[Eighteenth Embodiment]

Figure 43:
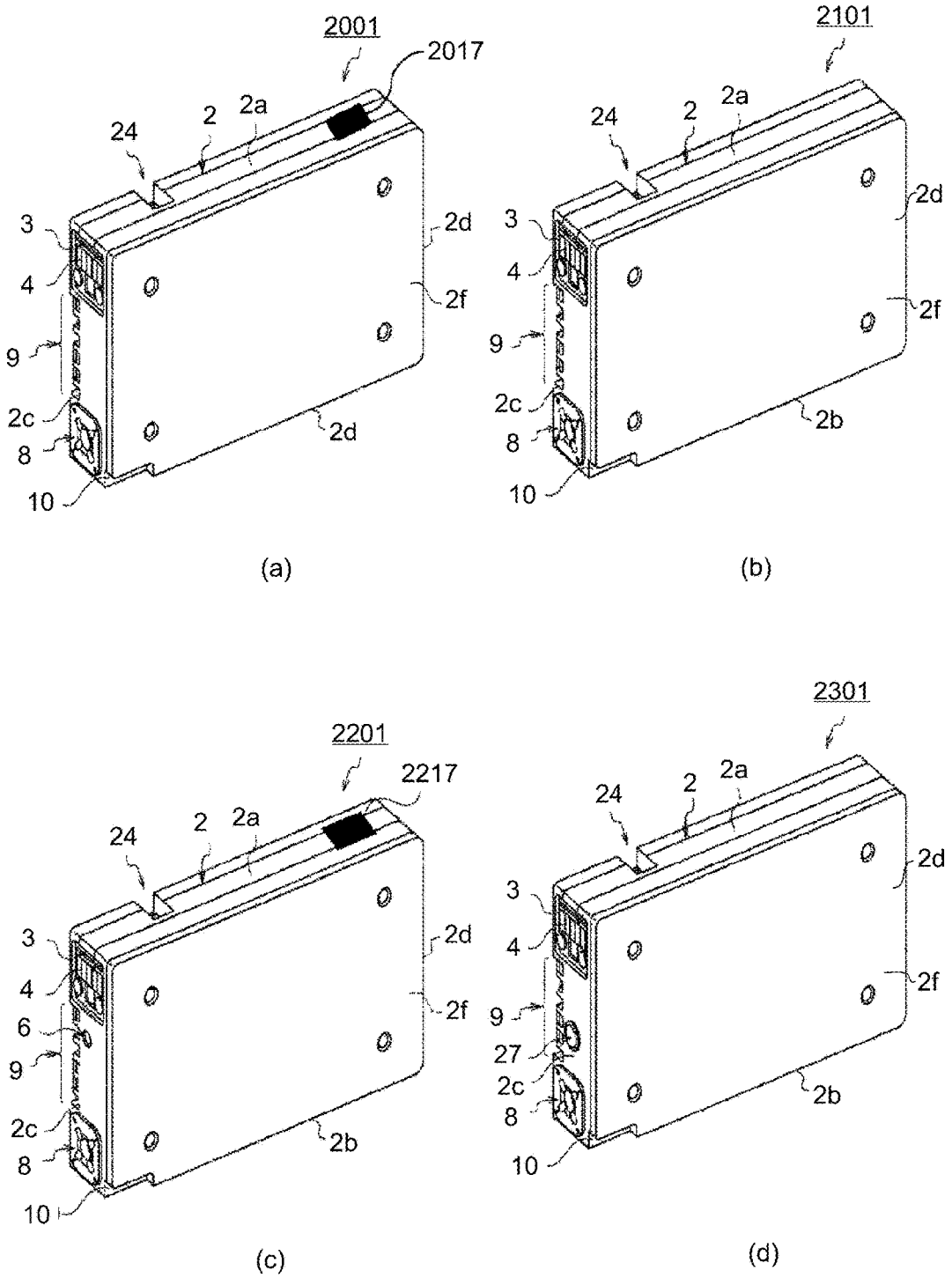
FIG. 43 illustrates a schematic structure of ink cartridges 2001, 2101, 2201, 2301 applicable in an eighteenth embodiment.

Referring to FIG. 43, an eighteenth embodiment will be described. FIG. 43 illustrates a schematic structure of ink cartridges 2001, 2101, 2201, 2301 applicable in an eighteenth embodiment. This embodiment is different from the first embodiment only in that the positioning portion 6 and/or the penetrated portion 27 is not provided on the ink cartridge, and the positioning pin 53 and/or the unsealing pin 51 is not provided in the cartridge mounting portion 33, and the major structures in the other aspects of this embodiment are substantially the same as the first embodiment. Therefore, in the description of this embodiment, the same reference numerals as in the first embodiment are assigned to the elements having the corresponding functions in this embodiment, and the detailed description thereof is omitted for simplicity.

The ink cartridge 2001 shown in part (a) of FIG. 43 is similar to the ink cartridge 1 of the first embodiment except that the positioning portion 6 and the penetrated portion 27 are not provided, and that the air vent (unshown) and the air vent sealing film 2017 are provided on the upper surface 2*a* of the casing 2. Correspondingly, the cartridge mounting portion to which the ink cartridge 2001 can be dismountably mounted is not provided with the positioning pin 53 and the unsealing pin 51, as compared with the cartridge mounting portion 33 of the first embodiment. Because of the cartridge mounting portion is not provided with the unsealing pin 51, it is necessary that the air vent sealing film is removed by the user. Therefore, the ink cartridge 2001 shown in part (a) of FIG. 43 is provided with the air vent sealing film 2017 on the upper surface 2*a* of the casing 2 where the user can easily remove the film.

With such a structure, no positioning portion 6 or positioning pin 53 is provided, and therefore, the ink cartridge 2001 is positioned by the tube inserting opening 8 and the ink receiving tube 52 and by the position regulation surface 10 and the positioning wall 56. For this reason, the accuracy of the positioning is it not as good as in the first embodiment. However, the engaging portion 24 is disposed in the position closer to the electrical contact 4 than to the tube inserting opening 8, and the engaging portion 24 is disposed in the position of the upper surface 2*c* or adjacent to the upper surface which is close to the electrical contact 4, similarly to the first embodiment, and therefore, the same advantageous effects as of the first embodiment can be provided in these respects.

With the structure of part (a) of FIG. 43, the user is required to remove the seal, and therefore, there is a likelihood that the air vent film 2017 is removed before the cartridge mounting, and the advantageous effects of the first embodiment in this respect is not provided in this embodiment. On the other hand, the air vent sealing film can be more easily stuck than in the first embodiment, and since the unsealing pin 51 is not provided, the number of parts of the printer main assembly can be reduced. In part (a) of FIG. 43, the air vent sealing film 2017 may be disposed at any position if the user can easily remove it. For example, the air vent and the air vent sealing film 2017 may be disposed on the rear surface 2*d*, the right-hand surface 2*f*, the left surface 2*e* or the like.

The ink cartridge 2101 shown in part (b) of FIG. 43 is not provided with the positioning portion 6, the penetrated portion 27, the air vent 7, the filter 15, the air vent path 16 and the air vent sealing film 17, as compared with the ink cartridge 1 of the first embodiment, and the structure of the inside ink accommodating chamber 11 is changed from that of the first embodiment.

The ink cartridge 2201 shown in part (c) of FIG. 43 is not provided with the penetrated portion 27 as compared with the ink cartridge 1 of the first embodiment, and the air vent (unshown) and the air vent sealing film 2217 is provided on the upper surface 2*a* of the casing 2. The cartridge mounting portion to which this ink cartridge 2001 can be detachably mounted is similar to the cartridge mounting portion 33 of the first embodiment but is not provided with the unsealing pin 51. The user is required to remove the seal, and therefore, there is a likelihood that the air vent film 2217 is removed before the cartridge mounting, and the advantageous effects of the first embodiment in this respect is not provided in this embodiment. Instead, however, the air vent sealing film can be more easily stuck than in the first embodiment.

The ink cartridge 2301 shown in part (d) of FIG. 43 is not provided with the positioning portion 6, as compared with the ink cartridge 1 of the first embodiment. The cartridge mounting portion to which the ink cartridge 2301 can be detachably mounted is not provided with the positioning pin 53, as compared with the cartridge mounting portion 33 of the first embodiment. With such a structure, no positioning portion 6 or positioning pin 53 is provided, and therefore, the positioning of the ink cartridge 2301 is effected by the tube inserting opening 8 in the ink receiving tube and by the position regulation surface 10 and the positioning wall 56. For this reason, the accuracy of the positioning is it not as good as in the first embodiment. However, the engaging portion 24 is disposed in the position closer to the electrical contact 4 than to the tube inserting opening 8, and the engaging portion 24 is disposed in the position of the upper surface 2*c* or adjacent to the upper surface which is close to the electrical contact 4, similarly to the first embodiment, and therefore, the same advantageous effects as of the first embodiment can be provided in these respects.

[Preferable Aspects of the Present Invention]

The preferable aspects of the ink cartridge or the ink jet printer of the embodiments having been described in the foregoing are as follows.

(Aspect 1)

An ink cartridge mountable, in a mounting direction crossing with a direction of gravity, to a cartridge mounting portion provided with an ink receiving tube and a plurality of electrical connecting portions, said ink cartridge comprising:

a casing including an ink accommodating chamber configured to accommodate ink to be supplied to said ink receiving tube, said casing having a first side surface in a position at a leading end with respect to the mounting direction, an upper surface and a bottom surface;

a tube inserting portion into which the ink receiving tube is insertable and which is provided at said first side surface in a position closer to said bottom surface than to said upper surface;

a substrate provided on said casing and having an area above said tube inserting portion, the area crossing with the mounting direction; and a plurality of electrical contacts electrically connectable with the plurality of electrical connecting portions, said electrical contacts being arranged in the area in a direction crossing with a direction of height which is from said bottom surface toward said upper surface.

(Aspect 2)

An ink cartridge according to Aspect 1, wherein said area of said substrate is parallel with said first side surface.

(Aspect 3)

An ink cartridge according to Aspect 1 or 2, wherein said substrate is provided on said first side surface.

(Aspect 4)

An ink cartridge according to Aspect 1, wherein said area of said substrate is inclined relative to said first side surface and to said upper surface.

(Aspect 5)

An ink cartridge according to Aspect 1 or 4, wherein said substrate is provided on an inclined surface between said first side surface and said upper surface.

(Aspect 6)

An ink cartridge mountable, in a mounting direction crossing with a direction of gravity, to a cartridge mounting portion provided with an ink receiving tube and a plurality of electrical connecting portions, said ink cartridge comprising:

a casing including an ink accommodating chamber configured to accommodate ink to be supplied to said ink receiving tube, said casing having a first side surface in a position at a leading end with respect to the mounting direction, an upper surface and a bottom surface;

a tube inserting portion into which the ink receiving tube is insertable and which is provided at said first side surface in a position closer to said bottom surface than to said upper surface; and a substrate provided on said upper surface; and a plurality of electrical contacts provided on said substrate and electrically connectable the plurality of electrical connecting portions, wherein each of said electrical contacts has an area crossing with the mounting direction, and the areas of said electrical contacts are arranged in a direction crossing with a direction of height which is from said bottom surface toward said upper surface.

(Aspect 7)

An ink cartridge according to Aspect 1 or 6, wherein the direction crossing with the direction of height is a horizontal direction perpendicular to the direction of height.

(Aspect 8)

An ink cartridge according to Aspect 1 or 7, wherein said casing has a second side surface at a trailing end portion with respect to the mounting direction, a third side surface connected with said first side surface, said second side surface, said upper surface and said bottom surface, a fourth side surface opposite from the third side surface across said ink accommodating chamber and connected with said first side surface, said second side surface, said upper surface and said bottom surface, and wherein the direction crossing with the direction of height is perpendicular to said third side surface and to said fourth side surface.

(Aspect 9)

An ink cartridge according to Aspect 8, wherein said third side surface has a area larger than that of any one of said first side surface, said second side surface, said upper surface and said bottom surface, and said fourth side surface has an area larger than that of any one of said first side surface, said second side surface, said upper surface and said bottom surface, and wherein said first side surface has an area smaller than that of any one of said third side surface, said fourth side surface, said upper surface and said bottom surface, and said second side surface has an area smaller than that of any one of said third side surface, said fourth side surface, said upper surface and said bottom surface.

(Aspect 10)

An ink cartridge mountable, in a mounting direction crossing with a direction of gravity, to a cartridge mounting portion provided with an ink receiving tube and a plurality of electrical connecting portions, said ink cartridge comprising:

a casing including an ink accommodating chamber configured to accommodate ink to be supplied to said ink receiving tube, said casing having a first side surface in a position at a leading end with respect to the mounting direction, a second side surface in a position at a trailing end with respect to the mounting direction, a third side surface connecting said first side surface and said second side surface with each other, a fourth side surface opposite from said third side surface across said ink accommodating chamber and connecting said first side surface and said second side surface with each other, an upper surface and a bottom surface;

a tube inserting portion into which the ink receiving tube is insertable and which is provided at said first side surface in a position closer to said bottom surface than to said upper surface;

a substrate provided on said first side surface in a position above said tube inserting portion; and a plurality of electrical contacts electrically connectable with the plurality of electrical connecting portions, said electrical contacts being arranged on said substrate in a direction perpendicular to said third side surface and to said fourth side surface.

(Aspect 11)

An ink cartridge according to Aspect 10, wherein said third side surface has a area larger than that of any one of said first side surface, said second side surface, said upper surface and said bottom surface, and said fourth side surface has an area larger than that of any one of said first side surface, said second side surface, said upper surface and said bottom surface, and wherein said first side surface has an area smaller than that of any one of said third side surface, said fourth side surface, said upper surface and said bottom surface, and said second side surface has an area smaller than that of any one of said third side surface, said fourth side surface, said upper surface and said bottom surface.

(Aspect 12)

An ink cartridge according to Aspect 1 or 10, further comprising a tube insertion path provided in said casing and connecting said tube inserting portion and said ink accommodating chamber with each other, and an elastic member provided in said tube insertion path and elastically deformable in accordance with insertion of the ink receiving tube into said tube insertion path.

(Aspect 13)

An ink cartridge according to Aspect 12, wherein said elastic member includes a rubber member contactable to an outer peripheral surface of the ink receiving tube inserted in said tube insertion path.

(Aspect 14)

An ink cartridge according to Aspect 1 or 13, further comprising an engaging portion engageable with a locking lever provided in said cartridge mounting portion to maintain an inserted state in which the ink receiving tube is inserted in said tube inserting portion and a connected state in which said electrical contacts are connected with the electrical connecting portions.

(Aspect 15)

An ink cartridge according to Aspect 14, wherein said engaging portion is disposed in the position close to said upper surface than to said bottom surface.

(Aspect 16)

An ink cartridge according to Aspect 14, wherein said engaging portion is disposed on said upper surface.

(Aspect 17)

An ink cartridge according to Aspect 14 or 16, wherein said engaging portion is a recess engageable with a projection of the locking lever.

(Aspect 18)

An ink cartridge according to Aspect 14 or 17, wherein the engaging portion is provided in the position close to said electrical contacts than to said tube inserting portion.

(Aspect 19)

An ink cartridge according to Aspect 1 or 18, further comprising a positioning portion provided in a position above said tube inserting portion and below said electrical contacts and engageable with a positioning member provided in the cartridge mounting portion to limit movement of said casing in a direction perpendicular to the mounting direction.

(Aspect 20)

An ink cartridge according to Aspect 19, wherein said positioning portion is disposed in a position closer to said electrical contacts than to said tube inserting portion.

(Aspect 21)

An ink cartridge according to Aspect 20, wherein said positioning portion includes a positioning opening into which the positioning member is inserted, and said positioning opening provided in said first side surface.

(Aspect 22)

An ink cartridge according to Aspect 19 or 21, wherein the direction perpendicular to the mounting direction is a direction of height which is from said bottom surface toward said upper surface.

(Aspect 23)

An ink cartridge according to Aspect 19 or 21, wherein the direction perpendicular to the mounting direction is along said first side surface.

(Aspect 24)

An ink cartridge comprising:

a casing including a plurality of side surfaces, an upper surface and bottom surface as defined on the basis of use state of said ink cartridge and provided with an ink accommodating chamber and the ink discharge opening configured to discharge the ink from said ink accommodating chamber to an outside, said side surface including a first side surface, said ink discharge opening being provided at said first side surface in a position closer to said bottom surface than to said upper surface;

a substrate provided on said first side surface; and a plurality of electrical contacts provided above said ink discharge opening, said electrical contacts being arranged in a direction crossing with a direction of height which is from said bottom surface toward said upper surface.

(Aspect 25)

An ink cartridge comprising:

a casing including a plurality of side surfaces, an upper surface and bottom surface as defined on the basis of use state of said ink cartridge and provided with an ink accommodating chamber and the ink discharge opening configured to discharge the ink from said ink accommodating chamber to an outside, said side surface including a first side surface, said ink discharge opening being provided at said first side surface in a position closer to said bottom surface than to said upper surface;

a substrate provided on said casing and having an area crossing with a normal line of said first side surface; and a plurality of electrical contacts provided above said ink discharge opening, said electrical contacts being arranged in the area in a direction crossing with a direction of height which is from said bottom surface toward said upper surface.

(Aspect 26)

An ink cartridge according to Aspect 24 or 25, wherein said plurality of side surfaces further include a second side surface opposite from said first side surface across said ink accommodating chamber, a third side surface connecting said first side surface and said second side surface with each other, a fourth side surface opposite from said third side surface across said ink accommodating chamber and connecting said first side surface and said second side surface with each other, and wherein the direction crossing with the direction of height is perpendicular to said third side surface and to said fourth side surface.

(Aspect 27)

An ink cartridge according to Aspect 26, wherein wherein said third side surface has a area larger than that of any one of said first side surface, said second side surface, said upper surface and said bottom surface, and said fourth side surface has an area larger than that of any one of said first side surface, said second side surface, said upper surface and said bottom surface, and wherein said first side surface has an area smaller than that of any one of said third side surface, said fourth side surface, said upper surface and said bottom surface, and said second side surface has an area smaller than that of any one of said third side surface, said fourth side surface, said upper surface and said bottom surface)

(Aspect 28)

An ink cartridge according to Aspect 24 or 27, further comprising an engaging portion provided in a position closer to said electrical contacts than to said ink discharge opening)

(Aspect 29)

An ink cartridge according to Aspect 28, wherein said engaging portion is disposed in the position close to said upper surface than to said bottom surface)

(Aspect 30)

An ink cartridge according to Aspect 28, wherein said engaging portion is disposed on said upper surface.

(Aspect 31)

An ink cartridge according to Aspect 28 or 30, wherein said engaging portion includes a recess having an area crossing with a direction parallel with a normal line of said substrate.

(Aspect 32)

An ink cartridge according to Aspect 24 or 31, further comprising a hollow path provided in said casing and connecting said ink accommodating chamber and said ink discharge opening with each other, and a rubber member provided in said hollow path.

(Aspect 33)

An ink cartridge comprising:

a casing having a substantially rectangular parallelepiped shape and including an ink accommodating chamber, said casing including (a) a first surface provided with an ink discharge opening configured to discharge ink from said ink accommodating chamber to an outside, (b) a second surface opposite from said first surface across said ink accommodating chamber, (c) a third surface crossing with said first surface and said second surface and having an area larger than those of said first surface and said second surface, (d) a fourth surface opposite from said third surface across said ink accommodating chamber and having an area larger than those of said first surface and said second surface, (e) a fifth surface crossing with said first surface, said second surface, said third surface and said fourth surface and having an area larger than those of said first surface, said second surface, said third surface and said fourth surface, (f) a sixth surface opposite from said fifth surface across said ink accommodating chamber and having an area larger than those of said first surface, said second surface, said third surface and said fourth surface, and (g) said ink discharge opening being disposed closer to said third surface than to said fourth surface;

a substrate provided on said first surface in a position above said ink discharge opening in a state that said third surface is a bottom surface; and a plurality of electrical contacts provided on said substrate, said electrical contacts and being arranged in a direction crossing with a direction from said third surface toward said fourth surface.

(Aspect 34)

An ink cartridge according to Aspect 33, wherein the direction from said third surface toward said fourth surface is perpendicular to said fifth surface and to said sixth surface.

(Aspect 35)

An ink cartridge according to Aspect 33 or 34, further comprising an engaging portion in the form of a recess having an area crossing with a direction parallel with a normal line of said substrate, said engaging portion being provided in a position closer to said electrical contacts than to said ink discharge opening.

(Aspect 36)

An ink cartridge according to Aspect 35, wherein said engaging portion is disposed on said fourth surface in the position closer to said first surface than to said second surface.

(Aspect 37)

An ink cartridge according to Aspect 24 or 36, further comprising a hollow path provided in said casing and connecting said ink accommodating chamber and said ink discharge opening with each other, and a rubber member provided in said hollow path.

(Aspect 38)

An ink cartridge comprising:

a casing including an ink accommodating chamber, an ink discharge opening configured to discharge ink from said ink accommodating chamber, a hollow path connecting said ink accommodating chamber and said ink discharge opening, said casing including a side surface provided with said ink discharge opening, an upper surface and a bottom surface, said ink discharge opening being provided in a position closer to said bottom surface than to said upper surface;

a substrate provided on said casing; and a plurality of electrical contacts provided on said substrate, said electrical contacts being arranged in a direction crossing with a direction of height which is from said bottom surface toward said upper surface, wherein each of said electrical contacts is disposed above said ink discharge opening and has an area crossing with a direction parallel with a direction in which said hollow path extends.

(Aspect 39)

An ink cartridge comprising:

a casing including a ink accommodating chamber, a side surface provided with a ink discharge opening configured to discharge ink from said ink accommodating chamber to a outside, a upper surface and a bottom surface, said ink discharge opening being disposed in a position closer to said bottom surface than to said upper surface;

a substrate provided on said casing; and a plurality of electrical contacts provided on said substrate, said electrical contacts being arranged in a direction crossing with a direction of height which is from said bottom surface toward said upper surface, wherein each of said electrical contacts is disposed above said ink discharge opening and has an area crossing with a direction parallel with a center line of said ink discharge opening.

(Aspect 40)

An ink cartridge comprising:

a casing including an ink accommodating chamber, a side surface having a formation region in which an ink discharge opening configured to discharge ink from said ink accommodating chamber to an outside, an upper surface and a bottom surface, said ink discharge opening being disposed in a position closer to said bottom surface than to said upper surface;

a substrate provided on said casing; and a plurality of electrical contacts provided on said substrate, said electrical contacts being arranged in a direction crossing with a direction of height which is from said bottom surface toward said upper surface, wherein each of said electrical contacts is disposed above said ink discharge opening and has an area crossing with a direction parallel with a normal line of said formation region.

(Aspect 41)

An ink cartridge according to Aspect 38 or 40, wherein said casing has a second side surface opposite from said first mentioned side surface across said ink accommodating chamber, a third side surface connecting said first mentioned side surface and said second side surface with each other, a fourth side surface opposite from said third side surface a cross said ink accommodating chamber and connecting said first mentioned side surface and said second side surface, and wherein the direction crossing with the direction of height is perpendicular to said third side surface and said fourth side surface.

(Aspect 42)

An ink cartridge according to Aspect 41, wherein said third side surface has a area larger than any one of said first mentioned side surface, said second side surface, said upper surface and said bottom surface, and said fourth side surface has an area larger than any one of said first mentioned side surface, said second side surface, said upper surface and said bottom surface, and wherein said first mentioned side surface has an area smaller than any one of said third side surface, said fourth side surface, said upper surface and said bottom surface, and said second side surface has an area smaller than any one of said third side surface, said fourth side surface, said upper surface and said bottom surface.

(Aspect 43)

An ink cartridge according to Aspect 38 or 42, further comprising an engaging portion provided in a position closer to said electrical contacts than to said ink discharge opening.

(Aspect 44)

An ink cartridge according to Aspect 43, wherein said engaging portion is disposed in the position close to said upper surface than to said bottom surface.

(Aspect 45)

An ink cartridge according to Aspect 43, wherein said engaging portion is disposed on said upper surface.

(Aspect 46)

An ink cartridge according to Aspect 43 or 45, wherein said engaging portion includes a recess having an area crossing with a direction parallel with a normal line of said substrate.

(Aspect 47)

An ink cartridge according to Aspect 38 or 46, further comprising a hollow path provided in said casing and connecting said ink accommodating chamber and said ink discharge opening with each other, and a rubber member provided in said hollow path.

(Aspect 48)

An ink jet printer comprising:

a cartridge mounting portion provided with an ink receiving tube and a plurality of electrical connecting portions; an ink cartridge mountable, in a mounting direction crossing with a direction of gravity, to the cartridge mounting portion;

said ink cartridge including, a casing including an ink accommodating chamber configured to accommodate ink to be supplied to said ink receiving tube, said casing including (A) a first side surface in a position at a leading end with respect to the mounting direction, a second side surface in a position at a trailing end with respect to the mounting direction, an upper surface and a bottom surface; (B) a tube inserting portion into which the ink receiving tube is insertable and which is provided at said first side surface in a position closer to said bottom surface than to said upper surface; and (C) a substrate provided on said casing and having an area crossing with the mounting direction in a position above said tube inserting portion; and (D) a plurality of electrical contacts electrically connectable with the plurality of electrical connecting portions, said electrical contacts being arranged in the area in a direction crossing with a direction of height which is from said bottom surface toward said upper surface.

(Aspect 49)

An ink jet printer according to Aspect 48, wherein the direction crossing with the direction of height is a horizontal direction perpendicular to the direction of height.

(Aspect 50)

An ink jet printer according to Aspect 48 or 49, wherein said casing has a second side surface at a trailing end portion with respect to the mounting direction, a third side surface connected with said first side surface, said second side surface, said upper surface and said bottom surface, a fourth side surface opposite from the third side surface across said ink accommodating chamber and connected with said first side surface, said second side surface, said upper surface and said bottom surface, and wherein the direction crossing with the direction of height is perpendicular to said third side surface and to said fourth side surface.

(Aspect 51)

An ink cartridge detachably mountable to a cartridge mounting portion provided with an unsealing pin, said ink cartridge comprising:

a casing including (i) an ink accommodating chamber, (ii) an air vent path connected with said ink accommodating chamber and capable of introducing ambient air into said ink accommodating chamber, (iii) a through hole formation wall provided with a through hole into which the unsealing pin is insertable, and (iv) an air vent formation wall provided between said through hole formation wall and said ink accommodating chamber and provided with an air vent disposed at an end portion of said air vent path; and a sealing film covering said air vent, said sealing film is capable of being unsealed by the unsealing pin having passed through said through hole.

(Aspect 52)

An ink cartridge detachably mountable to a cartridge mounting portion provided with an ink receiving tube and an unsealing pin said ink cartridge comprising:

a casing including (i) an ink accommodating chamber configured to accommodate ink to be supplied through said ink receiving tube, (ii) an air vent path connected with said ink accommodating chamber and capable of being producing ambient air into said ink accommodating chamber, (iii) a tube inserting opening into which said ink receiving tube is insertable, (iv) a through hole into which said unsealing pin is insertable, (v) said casing further including a side wall provided with said tube inserting opening and said through hole, an air vent formation wall provided at a position between said side wall and said ink accommodating chamber and provided with an air vent place in an end portion of said air vent path, a bottom wall and an upper wall;

a sealing film covering said air vent, said sealing film is capable of being unsealed by the unsealing pin having passed through said through hole; and a second sealing film covering said tube inserting opening, said sealing film being capable of being unsealed by said ink receiving tube.

(Aspect 53)

An ink cartridge detachably mountable to a cartridge mounting portion provided with an unsealing pin, said ink cartridge comprising:

a preparation step of preparing a casing including (i) an ink accommodating chamber, (ii) an air vent path connected with said ink accommodating chamber and capable of introducing ambient air into said ink accommodating chamber, (iii) a through hole formation wall Provided with a through hole into which said unsealing pin is insertable, (iv) an air vent formation wall provided at a position between said through hole formation wall and said ink accommodating chamber and provided with an air vent placed in an end portion of said air vent path; and a sticking step of sticking a sealing film so as to cover said air vent, said sealing film being capable of being unsealed by unsealing pin having passed through said through hole.

(Aspect 54)

An aspect according to Aspect 53 further comprising an injection step of injecting ink into said ink accommodating chamber after said sticking step.

(Aspect 55)

A manufacturing method for manufacturing an ink cartridge detachably mountable to a cartridge mounting portion provided with an ink receiving tube and an unsealing pin, said method comprising:

a preparation step of preparing a casing including (i) an ink accommodating chamber configured to accommodate ink to be supplied through said ink receiving tube, (ii) an air vent path connected with said ink accommodating chamber and capable of being producing ambient air into said ink accommodating chamber, (iii) a tube inserting opening into which said ink receiving tube is insertable, (iv) a through hole into which said unsealing pin is insertable, (v) said casing further including a side wall provided with said tube inserting opening and said through hole, an air vent formation wall provided at a position between said side wall and said ink accommodating chamber and provided with an air vent place in an end portion of said air vent path, a bottom wall and an upper wall;

a sticking step of sticking a sealing film so as to cover said air vent, said sealing film being capable of being unsealed by unsealing pin having passed through said through hole; and a second sticking step of sticking a second sealing film covering said tube inserting opening, said sealing film being capable of being unsealed by said ink receiving tube.

(Aspect 56)

An aspect according to Aspect 55 further comprising an injecting step of injecting ink into said ink accommodating chamber after said first sticking step and before said second sticking step.

(Aspect 57)

An ink cartridge mountable to a cartridge mounting portion provided with an ink receiving tube, a electrical connecting portion and a positioning member, in a mounting direction crossing with a direction of gravity, said ink cartridge comprising:

a casing including an ink accommodating chamber configured to accommodate ink to be supplied to the ink receiving tube, said casing including a front surface at a leading side with respect to the mounting direction, an upper surface and a bottom surface;

a tube inserting portion into which the ink receiving tube is insertable and which is provided at said front surface in a position closer to said bottom surface than to said upper surface;

an electrical contact electrically connectable the electrical connecting portion, said electrical contact having an area crossing with the mounting direction in a position above said tube inserting portion; and a positioning portion provided in a position closer to said electrical contact than to said tube inserting portion above said tube inserting portion and below said electrical contact and engageable with the positioning member to limit movement of said casing in a direction perpendicular to the mounting direction.

(Aspect 58)

A aspect according to Aspect 57, wherein said positioning portion includes a positioning opening into which said positioning member is insertable, said positioning opening being provided at said front side.

(Aspect 59)

An ink cartridge mountable to a cartridge mounting portion provided with an ink receiving tube, an electrical connecting portion, a positioning member, an urging spring and a locking lever, in a mounting direction crossing with a direction of gravity, said ink cartridge comprising:

a casing including an ink accommodating chamber configured to accommodate ink to be supplied to the ink receiving tube and a tube inserting opening into which said ink receiving tube is inserted, said casing including a front surface at a leading side with respect to the mounting direction, an upper surface and a bottom surface, and said tube inserting opening is disposed in a position closer to said bottom surface than to said upper surface adjacent to said front surface;

a substrate provided at said front surface in a position above said tube inserting opening;

an electrical contact provided on said substrate and electrically connectable to the electrical connecting portion; and a positioning opening into which the positioning member is capable of inserting to limit movement of said casing in a direction along said front side, said positioning opening being provided at said front surface in a position above said tube inserting opening and below said electrical contact in a position closer to said electrical contact than to said tube inserting opening.

(Aspect 60)

An ink cartridge mountable to a cartridge mounting portion provided with an ink receiving tube, an electrical connecting portion and a locking lever, in a mounting direction crossing with a direction of gravity, said ink cartridge comprising:

a casing including an ink accommodating chamber configured to accommodate ink to be supplied to the ink receiving tube, said casing including a front surface at a leading side with respect to the mounting direction, an upper surface and a bottom surface;

a tube inserting portion into which the ink receiving tube is insertable and which is provided at said front surface in a position closer to said bottom surface than to said upper surface;

an electrical contact electrically connectable the electrical connecting portion, said electrical contact having an area crossing with the mounting direction in a position above said tube inserting portion; and an engaging portion provided in a position closer to said electrical contact than to said tube inserting portion, said engaging portion being engageable with the locking lever to maintain an inserted state in which the ink receiving tube is inserted in said tube inserting portion and a connected state in which said electrical contact is connected with the electrical connecting portion.

(Aspect 61)

An ink cartridge mountable to a cartridge mounting portion provided with an ink receiving tube, an electrical connecting portion and a locking lever, in a mounting direction crossing with a direction of gravity, said ink cartridge comprising:

a casing including an ink accommodating chamber configured to accommodate ink to be supplied to the ink receiving tube and a tube inserting opening into which said ink receiving tube is inserted, said casing including a front surface at a leading side with respect to the mounting direction, an upper surface and a bottom surface, and said tube inserting opening is disposed in a position closer to said bottom surface than to said upper surface adjacent to said front surface;

a substrate provided at said front surface in a position above said tube inserting opening;

an electrical contact provided on said substrate and electrically connectable to the electrical connecting portion; and an engaging portion provided on said upper surface in a position closer to front surface than to rear surface, said engaging portion is engageable with the locking lever to maintain an inserted state in which the ink receiving tube is inserted in said tube inserting portion and a connected state in which said electrical contact is connected with the electrical connecting portion.

(Aspect 62)

An ink cartridge mountable to a cartridge mounting portion provided with an ink receiving tube, an electrical connecting portion, an urging spring and a locking lever, in a mounting direction crossing with a direction of gravity, said ink cartridge comprising:

a casing including an ink accommodating chamber configured to accommodate ink to be supplied to the ink receiving tube and a tube inserting opening into which said ink receiving tube is inserted, said casing including a front surface at a leading side with respect to the mounting direction, an upper surface and a bottom surface, and said tube inserting opening is disposed in a position closer to said bottom surface than to said upper surface adjacent to said front surface;

a substrate provided at said front surface in a position above said tube inserting opening;

an electrical contact provided on said substrate and electrically connectable to the electrical connecting portion;

a force receiving portion provided on said front surface in a position above said tube inserting opening below said electrical contact and configured to receive from the urging spring an urging force for urging said ink cartridge in a dismounting direction which is opposite the mounting direction; and an engaging portion provided on said upper surface in a position closer to front surface than to rear surface, said engaging portion is engageable with the locking lever to maintain, against the urging force, an inserted state in which the ink receiving tube is inserted in said tube inserting portion and a connected state in which said electrical contact is connected with said electrical connecting portion.

(Aspect 63)

An ink cartridge mountable to a cartridge mounting portion provided with an ink receiving tube, an electrical connecting portion, a positioning member, an urging spring and a locking lever, in a mounting direction crossing with a direction of gravity, said ink cartridge comprising:

a casing including an ink accommodating chamber configured to accommodate ink to be supplied to the ink receiving tube and a tube inserting opening into which said ink receiving tube is inserted, said casing including a front surface at a leading side with respect to the mounting direction, an upper surface and a bottom surface, and said tube inserting opening is disposed in a position closer to said bottom surface than to said upper surface adjacent to said front surface;

a substrate provided at said front surface in a position above said tube inserting opening;

an electrical contact provided on said substrate and electrically connectable to the electrical connecting portion;

a positioning opening into which the positioning member is capable of inserting to limit movement of said casing in a direction along said front side, said positioning opening being provided at said front surface in a position above said tube inserting opening and below said electrical contact in a position closer to said electrical contact than to said tube inserting opening;

a force receiving portion provided at said front surface in a position above said tube inserting opening below said electrical contact and configured to receive from the urging spring an urging force for urging said ink cartridge in a dismounting direction which is opposite the mounting direction; and an engaging portion provided on said upper surface in a position closer to front surface than to rear surface, said engaging portion is engageable with the locking lever to maintain, against the urging force, an inserted state in which the ink receiving tube is inserted in said tube inserting portion, a connected state in which said electrical contact is connected with said electrical connecting portion and an inserted state in which the positioning member is inserted in said positioning opening.

(Aspect 64)

An ink cartridge comprising:

a casing including a plurality of side surfaces, an upper surface and bottom surface as defined on the basis of use state of said ink cartridge and provided with an ink accommodating chamber and the ink discharge opening configured to discharge the ink from said ink accommodating chamber to an outside, said side surface including a first side surface and a second side surface at an opposite side from said first side surface across said ink accommodating chamber, said ink discharge opening being provided at said first side surface in a position closer to said bottom surface than to said upper surface;

an electrical contact provided in a position above said ink discharge opening;

a substrate provided at said first side surface and provided with said electrical contact; and an engaging portion provided at said upper surface in a position closer to said electrical contact than to said ink discharge opening and closer to said first side surface than to said second side surface.

(Aspect 65)

An ink cartridge comprising:

a casing including a plurality of side surfaces, an upper surface and bottom surface as defined on the basis of use state of said ink cartridge and provided with an ink accommodating chamber and the ink discharge opening configured to discharge the ink from said ink accommodating chamber to an outside, said side surface including a first side surface and a second side surface at an opposite side from said first side surface across said ink accommodating chamber, said ink discharge opening being provided at said first side surface in a position closer to said bottom surface than to said upper surface;

an electrical contact provided in a position above said ink discharge opening;

a substrate provided at said first side surface and provided with said electrical contact;

a force receiving portion provided at said first side surface in a position above said ink discharge opening and below said electrical contact and configured to receive an urging force for urging said casing in a direction away from said first side surface toward said second side surface; and an engaging portion provided at said upper surface in a position closer to said electrical contact than to said ink discharge opening and closer to said first side surface than to said second side surface and configured to receive a limiting force for limiting movement of said casing against the urging force in the direction (Aspect 66)

An ink cartridge comprising:

a casing including a plurality of side surfaces, an upper surface and bottom surface as defined on the basis of use state of said ink cartridge and provided with an ink accommodating chamber and the ink discharge opening configured to discharge the ink from said ink accommodating chamber to an outside, said side surface including a first side surface and a second side surface at an opposite side from said first side surface across said ink accommodating chamber, said ink discharge opening being provided at said first side surface in a position closer to said bottom surface than to said upper surface;

an electrical contact provided in a position above said ink discharge opening;

a substrate provided at said first side surface and provided with said electrical contact;

a positioning opening provided at said first side surface in a position above said ink discharge opening and below said electrical contact and closer to said electrical contact than to said ink discharge opening;

a force receiving portion provided at said first side surface in a position above said ink discharge opening and below said positioning opening and configured to receive an urging force for urging said casing in a direction away from said first side surface toward said second side surface; and an engaging portion provided at said upper surface in a position closer to said electrical contact than to said ink discharge opening and closer to said first side surface than to said second side surface and configured to receive a limiting force for limiting movement of said casing against the urging force in the direction.

(Aspect 67)

An ink cartridge comprising:

a casing including a plurality of side surfaces, an upper surface and bottom surface as defined on the basis of use state of said ink cartridge and provided with an ink accommodating chamber and the ink discharge opening configured to discharge the ink from said ink accommodating chamber to an outside, said side surface including a first side surface and a second side surface at an opposite side from said first side surface across said ink accommodating chamber, said ink discharge opening being provided at said first side surface in a position closer to said bottom surface than to said upper surface;

an electrical contact provided in a position above said ink discharge opening;

a substrate provided at said first side surface and provided with said electrical contact;

a positioning opening provided at said first side surface in a position above said ink discharge opening and below said electrical contact and closer to said electrical contact than to said ink discharge opening; and an engaging portion provided at said upper surface in a position closer to said electrical contact than to said ink discharge opening and closer to said first side surface than to said second side surface.

(Aspect 68)

An ink cartridge comprising:

a casing including an ink accommodating chamber and including a first surface provided with an ink discharge opening configured to discharge ink from said ink accommodating chamber to an outside, a second surface opposite from said first surface across said ink accommodating chamber, a third surface connecting said first surface and said second surface with each other and having an area larger than those of said first surface and said second surface, and a fourth surface opposite from said third surface across said ink accommodating chamber, said ink discharge opening being disposed in a position closer to said third surface than to said fourth surface;

an electrical contact disposed in a position above said ink discharge opening in the state in which said third surface is a bottom surface;

a substrate provided at said first surface and supporting said electrical contact; and an engaging portion in the form of a recess and provided at said fourth surface in a position closer to said electrical contact than to said ink discharge opening and closer to said first surface than to said second surface.

(Aspect 69)

An ink cartridge comprising:

a casing including an ink accommodating chamber and including a first surface provided with an ink discharge opening configured to discharge ink from said ink accommodating chamber to an outside, a second surface opposite from said first surface across said ink accommodating chamber, a third surface connecting said first surface and said second surface with each other and having an area larger than those of said first surface and said second surface, and a fourth surface opposite from said third surface across said ink accommodating chamber, said ink discharge opening being disposed in a position closer to said third surface than to said fourth surface;

an electrical contact disposed in a position above said ink discharge opening in the state in which said third surface is a bottom surface;

a substrate provided at said first surface and supporting said electrical contact;

a force receiving portion provided at said first surface in a position below said substrate and above said ink discharge opening in a state in which said third surface is a bottom surface and configured to receive an urging force for urging said casing in a direction away from said first surface toward said second surface in a state in which said third surface is a bottom surface; and an engaging portion in the form of a recess and provided at said fourth surface in a position closer to said electrical contact than to said ink discharge opening and closer to said first surface than to said second surface, said engaging portion being capable of receiving a limiting force for limiting movement of said casing in a direction away from said first surface toward second surface.

(Aspect 70)

An ink cartridge comprising:

a casing including an ink accommodating chamber and including a first surface provided with an ink discharge opening configured to discharge ink from said ink accommodating chamber to an outside, a second surface opposite from said first surface across said ink accommodating chamber, a third surface connecting said first surface and said second surface with each other and having an area larger than those of said first surface and said second surface, and a fourth surface opposite from said third surface across said ink accommodating chamber, said ink discharge opening being disposed in a position closer to said third surface than to said fourth surface;

an electrical contact disposed in a position above said ink discharge opening in the state in which said third surface is a bottom surface;

a substrate provided at said first surface and supporting said electrical contact;

a positioning opening provided at said first surface in a position above said ink discharge opening and below said substrate in a state in which said third surface is a bottom surface and closer to said substrate than to said ink discharge opening and configured to limit movement of said casing in a direction along the first surface;

a force receiving portion provided at said first surface in a position below said positioning opening and above said ink discharge opening in a state in which said third surface is a bottom surface and configured to receive an urging force for urging said casing in a direction away from said first surface toward said second surface in a state in which said third surface is a bottom surface; and an engaging portion in the form of a recess and provided at said fourth surface in a position closer to said electrical contact than to said ink discharge opening and closer to said first surface than to said second surface, said engaging portion being capable of receiving a limiting force for limiting movement of said casing in a direction from said first surface toward second surface.

(Aspect 71)

An ink cartridge comprising:

a casing including an ink accommodating chamber and including a first surface provided with an ink discharge opening configured to discharge ink from said ink accommodating chamber to an outside, a second surface opposite from said first surface across said ink accommodating chamber, a third surface connecting said first surface and said second surface with each other and having an area larger than those of said first surface and said second surface, and a fourth surface opposite from said third surface across said ink accommodating chamber, said ink discharge opening being disposed in a position closer to said third surface than to said fourth surface;

an electrical contact disposed in a position above said ink discharge opening in the state in which said third surface is a bottom surface;

a substrate provided at said first surface and supporting said electrical contact;

a positioning opening provided at said first surface in a position above said ink discharge opening and below said substrate in a state in which said third surface is a bottom surface and closer to said substrate than to said ink discharge opening; and an engaging portion in the form of a recess and provided at said fourth surface in a position closer to said electrical contact than to said ink discharge opening and closer to said first surface than to said second surface, said engaging portion having an area crossing with a direction parallel with a normal line of said substrate.

(Aspect 72)

An ink cartridge comprising:

a casing having a substantially rectangular parallelepiped shape and including an ink accommodating chamber, said casing including (a) a first surface provided with an ink discharge opening configured to discharge ink from said ink accommodating chamber to an outside, (b) a second surface opposite from said first surface across said ink accommodating chamber, (c) a third surface crossing with said first surface and said second surface and having an area larger than those of said first surface and said second surface, (d) a fourth surface opposite from said third surface across said ink accommodating chamber and having an area larger than those of said first surface and said second surface, (e) a fifth surface crossing with said first surface, said second surface, said third surface and said fourth surface and having an area larger than those of said first surface, said second surface, said third surface and said fourth surface, (f) a sixth surface opposite from said fifth surface across said ink accommodating chamber and having an area larger than those of said first surface, said second surface, said third surface and said fourth surface, and (g) said ink discharge opening being disposed closer to said third surface than to said fourth surface;

a substrate provided at said first surface such that said substrate is in a position above said ink discharge opening in a state in which said third surface is a bottom surface;

a plurality of electrical contacts provided on said substrate and arranged in a direction crossing with a direction away from said third surface toward said fourth surface; and an engaging portion in the form of a recess and provided at said fourth surface in a position closer to said substrate than to said ink discharge opening and closer to said first surface than to said second surface.

(Aspect 73)

An ink cartridge comprising:

an ink cartridge comprising:

a casing having a substantially rectangular parallelepiped shape and including an ink accommodating chamber, said casing including (a) a first surface provided with an ink discharge opening configured to discharge ink from said ink accommodating chamber to an outside, (b) a second surface opposite from said first surface across said ink accommodating chamber, (c) a third surface crossing with said first surface and said second surface and having an area larger than those of said first surface and said second surface, (d) a fourth surface opposite from said third surface across said ink accommodating chamber and having an area larger than those of said first surface and said second surface, (e) a fifth surface crossing with said first surface, said second surface, said third surface and said fourth surface and having an area larger than those of said first surface, said second surface, said third surface and said fourth surface, (f) a sixth surface opposite from said fifth surface across said ink accommodating chamber and having an area larger than those of said first surface, said second surface, said third surface and said fourth surface, and (g) said ink discharge opening being disposed closer to said third surface than to said fourth surface;

a substrate provided at said first surface such that said substrate is in a position above said ink discharge opening in a state in which said third surface is a bottom surface;

plurality of electrical contacts provided on said substrate and arranged in a direction crossing with a direction away from said third surface toward said fourth surface;

a force receiving portion provided at said first surface in a position above said ink discharge opening below said substrate in a state in which said third surface is a bottom surface and configured to receive an urging force for urging said casing in a direction away from said first surface toward said second surface; and an engaging portion in the form of a recess and provided at said fourth surface in a position closer to said substrate than to said ink discharge opening and closer to said first surface than to said second surface and configured to receive a regulating force for limiting movement of said casing in the direction away from said first surface toward said second surface against the urging force.

(Aspect 74)

An ink cartridge comprising:

a casing having a substantially rectangular parallelepiped shape and including an ink accommodating chamber, said casing including (a) a first surface provided with an ink discharge opening configured to discharge ink from said ink accommodating chamber to an outside, (b) a second surface opposite from said first surface across said ink accommodating chamber, (c) a third surface crossing with said first surface and said second surface and having an area larger than those of said first surface and said second surface, (d) a fourth surface opposite from said third surface across said ink accommodating chamber and having an area larger than those of said first surface and said second surface, (e) a fifth surface crossing with said first surface, said second surface, said third surface and said fourth surface and having an area larger than those of said first surface, said second surface, said third surface and said fourth surface, (f) a sixth surface opposite from said fifth surface across said ink accommodating chamber and having an area larger than those of said first surface, said second surface, said third surface and said fourth surface, and (g) said ink discharge opening being disposed closer to said third surface than to said fourth surface;

a substrate provided at said first surface such that said substrate is in a position above said ink discharge opening in a state in which said third surface is a bottom surface;

a plurality of electrical contacts provided on said substrate and arranged in a direction crossing with a direction away from said third surface toward said fourth surface;

a positioning opening provided at said first surface in a position above said ink discharge opening and below said substrate in a state in which said third surface is a bottom surface and closer to said plurality of electrical contacts than said ink discharge opening and configured to limit movement of said casing in a direction along said first surface;

a force receiving portion provided at said first surface in a position above said ink discharge opening below said positioning opening in a state in which said third surface is a bottom surface and configured to receive an urging force for urging said casing in a direction away from said first surface toward said second surface; and an engaging portion in the form of a recess and provided at said fourth surface in a position closer to said substrate than to said ink discharge opening and closer to said first surface than to said second surface and configured to receive a regulating force for limiting movement of said casing in the direction away from said first surface toward said second surface against the urging force.

(Aspect 75)

An ink cartridge comprising:

a casing having a substantially rectangular parallelepiped shape and including an ink accommodating chamber, said casing including (a) a first surface provided with an ink discharge opening configured to discharge ink from said ink accommodating chamber to an outside, (b) a second surface opposite from said first surface across said ink accommodating chamber, (c) a third surface crossing with said first surface and said second surface and having an area larger than those of said first surface and said second surface, (d) a fourth surface opposite from said third surface across said ink accommodating chamber and having an area larger than those of said first surface and said second surface, (e) a fifth surface crossing with said first surface, said second surface, said third surface and said fourth surface and having an area larger than those of said first surface, said second surface, said third surface and said fourth surface, (f) a sixth surface opposite from said fifth surface across said ink accommodating chamber and having an area larger than those of said first surface, said second surface, said third surface and said fourth surface, and (g) said ink discharge opening being disposed closer to said third surface than to said fourth surface;

a substrate provided at said first surface such that said substrate is in a position above said ink discharge opening in a state in which said third surface is a bottom surface;

plurality of electrical contacts provided on said substrate and arranged in a direction crossing with a direction away from said third surface toward said fourth surface;

a positioning opening provided at said first surface in a position above said ink discharge opening and below said substrate in a state in which said third surface is a bottom surface and closer to said plurality of electrical contacts than to said ink discharge opening; and an engaging portion in the form of a recess and provided at said fourth surface in a position closer to said substrate than to said ink discharge opening and closer to said first surface than to said second surface.

(Aspect 76)

An ink cartridge comprising:

a casing including an ink accommodating chamber, an ink discharge opening configured to discharge ink from said ink accommodating chamber, a hollow path connecting said ink accommodating chamber and said ink discharge opening, said casing including a first side surface provided with said ink discharge opening, a second side surface opposite to said first side surface across said ink accommodating chamber, an upper surface and a bottom surface, said ink discharge opening being provided in a position closer to said bottom surface than to said upper surface;

a substrate provided on said casing;

an electrical contact provided on said substrate in a position above said ink discharge opening and having an area crossing with a direction parallel with an extending direction of said hollow path; and an engaging portion provided on said casing in a position closer to said electrical contact than to said ink discharge opening and having an area crossing with a direction parallel with the extending direction.

(Aspect 77)

An ink cartridge comprising:

a casing including an ink accommodating chamber, an ink discharge opening configured to discharge ink from said ink accommodating chamber, a hollow path connecting said ink accommodating chamber and said ink discharge opening, said casing including a first side surface provided with said ink discharge opening, a second side surface opposite to said first side surface across said ink accommodating chamber, an upper surface and a bottom surface, said ink discharge opening being provided in a position closer to said bottom surface than to said upper surface;

a substrate provided on said casing;

an electrical contact provided on said substrate in a position above said ink discharge opening and having an area crossing with a direction parallel with an extending direction of said hollow path; and a force receiving portion provided at said first side surface in a position above said ink discharge opening and below said electrical contact and configured to receive an urging force for urging said casing in a depth direction which is parallel with the extending direction and which is away from said first side surface toward said second side surface; and an engaging portion provided on said casing in a position closer to said electrical contact than to said ink discharge opening and including an area crossing with a direction parallel with the extending direction and capable of receiving a limiting force for limiting movement of said casing in the depth direction and against the urging force.

(Aspect 78)

An ink cartridge comprising:

a casing including an ink accommodating chamber, an ink discharge opening configured to discharge ink from said ink accommodating chamber, a hollow path connecting said ink accommodating chamber and said ink discharge opening, said casing including a first side surface provided with said ink discharge opening, a second side surface opposite to said first side surface across said ink accommodating chamber, an upper surface and a bottom surface, said ink discharge opening being provided in a position closer to said bottom surface than to said upper surface;

a substrate provided on said casing;

an electrical contact provided on said substrate in a position above said ink discharge opening and having an area crossing with a direction parallel with an extending direction of said hollow path; and a positioning portion provided on said casing in a position above said ink discharge opening and below said substrate and configured to limit movement of said casing in a direction perpendicular to the extending direction;

a force receiving portion provided at said first side surface in a position above said ink discharge opening and below said positioning opening and configured to receive an urging force for urging said casing in a depth direction which is parallel with the extending direction and which is away from said first side surface toward said second side surface; and an engaging portion provided on said casing in a position closer to said electrical contact than to said ink discharge opening and including an area crossing with a direction parallel with the extending direction and capable of receiving a limiting force for limiting movement of said casing in the depth direction against the urging force.

(Aspect 79)

An ink cartridge comprising:

a casing including an ink accommodating chamber, an ink discharge opening configured to discharge ink from said ink accommodating chamber, a hollow path connecting said ink accommodating chamber and said ink discharge opening, said casing including a first side surface provided with said ink discharge opening, a second side surface opposite to said first side surface across said ink accommodating chamber, an upper surface and a bottom surface, said ink discharge opening being provided in a position closer to said bottom surface than to said upper surface;

a substrate provided on said casing;

an electrical contact provided on said substrate in a position above said ink discharge opening and having an area crossing with a direction parallel with an extending direction of said hollow path;

a positioning portion provided on said casing in a position above said ink discharge opening and below said substrate; and an engaging portion provided on said casing in a position closer to said electrical contact than to said ink discharge opening and including an area crossing with a direction parallel with the extending direction.

(Aspect 80)

An ink cartridge comprising:

a casing including an ink accommodating chamber, a first side surface provided with an ink discharge opening configured to discharge ink from said ink accommodating chamber to an outside, a second side surface opposite from said first side surface across said ink accommodating chamber, an upper surface and a bottom surface, said ink discharge opening being disposed in a position closer to said bottom surface than to said upper surface;

a substrate provided on said casing;

an electrical contact provided on said substrate in a position above said ink discharge opening and having an area crossing with a direction parallel with a center line of said ink discharge opening; and an engaging portion provided in a position closer to said electrical contact than to said ink discharge opening and having an area crossing with a direction parallel with the center line.

(Aspect 81)

An ink cartridge comprising:

a casing including an ink accommodating chamber, a first side surface provided with an ink discharge opening configured to discharge ink from said ink accommodating chamber to an outside, a second side surface opposite from said first side surface across said ink accommodating chamber, an upper surface and a bottom surface, said ink discharge opening being disposed in a position closer to said bottom surface than to said upper surface;

a substrate provided on said casing;

an electrical contact provided on said substrate in a position above said ink discharge opening and having an area crossing with a direction parallel with a center line of said ink discharge opening; and a force receiving portion provided at said first side surface in a position above said ink discharge opening and below said electrical contact and configured to receive an urging force for urging said casing in depth direction which is parallel with the center line and which is away from said first side surface toward second side surface; and an engaging portion provided on said casing in a position closer to said electrical contact than to said ink discharge opening and having an area crossing with a direction parallel with the center line and capable of receiving a limiting force for limiting movement of said casing in the depth direction against the urging force.

(Aspect 82)

An ink cartridge comprising:

a casing including an ink accommodating chamber, a first side surface provided with an ink discharge opening configured to discharge ink from said ink accommodating chamber to an outside, a second side surface opposite from said first side surface across said ink accommodating chamber, an upper surface and a bottom surface, said ink discharge opening being disposed in a position closer to said bottom surface than to said upper surface;

a substrate provided on said casing;

an electrical contact provided on said substrate in a position above said ink discharge opening and having an area crossing with a direction parallel with a center line of said ink discharge opening; and a positioning portion provided on said casing in a position above said ink discharge opening and below said electrical contact and configured to limit movement of said casing in a direction perpendicular to a direction parallel with the center line;

a force receiving portion provided at said first side surface in a position above said ink discharge opening and below said positioning portion and configured to receive an urging force for urging said casing in depth direction which is parallel with the center line and which is away from said first side surface toward second side surface; and an engaging portion provided on said casing in a position closer to said electrical contact than to said ink discharge opening and having an area crossing with a direction parallel with the center line and capable of receiving a limiting force for limiting movement of said casing in the depth direction against the urging force.

(Aspect 83)

An ink cartridge comprising:

a casing including an ink accommodating chamber, a first side surface provided with an ink discharge opening configured to discharge ink from said ink accommodating chamber to an outside, a second side surface opposite from said first side surface across said ink accommodating chamber, an upper surface and a bottom surface, said ink discharge opening being disposed in a position closer to said bottom surface than to said upper surface;

a substrate provided on said casing;

an electrical contact provided on said substrate in a position above said ink discharge opening and having an area crossing with a direction parallel with a center line of said ink discharge opening; and a positioning portion provided on said casing in a position above said ink discharge opening and below said electrical contact and closer to said first side surface than to said second side surface; and an engaging portion provided on said casing in a position closer to said electrical contact than to said ink discharge opening and having an area crossing with a direction parallel with the center line.

(Aspect 84)

An ink cartridge comprising:

a casing including an ink accommodating chamber, a first side surface having a formation region in which an ink discharge opening configured to discharge ink from said ink accommodating chamber to an outside, an upper surface and a bottom surface, said ink discharge opening being disposed in a position close to said bottom surface than to said upper surface;

a substrate provided on said casing;

an electrical contact provided on said substrate and including an area in a position above said ink discharge opening, the area crossing with a direction parallel with a normal line of said formation region; and an engaging portion provided in a position closer to said electrical contact than to said ink discharge opening, said engaging portion including an area crossing with a direction parallel with the normal line of said formation region.

(Aspect 85)

An ink cartridge comprising:

a casing including an ink accommodating chamber, a first side surface having a formation region in which an ink discharge opening configured to discharge ink from said ink accommodating chamber to an outside, a second side surface opposite from said first side surface across said ink accommodating chamber, an upper surface and a bottom surface, said ink discharge opening being disposed in a position close to said bottom surface than to said upper surface;

a substrate provided on said casing;

an electrical contact provided on said substrate and including an area in a position above said ink discharge opening, the area crossing with a direction parallel with a normal line of said formation region;

a force receiving portion provided at said first side surface in a position above said ink discharge opening below said electrical contact capable of receiving an urging force for urging said casing in a depth direction which is in parallel with the normal line of said formation region and away from said first side surface toward said second side surface; and an engaging portion provided on said casing in a position closer to said electrical contact than to said ink discharge opening, said engaging portion including an area crossing with a direction parallel with the normal line of said formation region and capable of receiving a limiting force for limiting movement of said casing in the depth direction against the urging force.

(Aspect 86)

An ink cartridge comprising:

a casing including an ink accommodating chamber, a first side surface having a formation region in which an ink discharge opening configured to discharge ink from said ink accommodating chamber to an outside, a second side surface opposite from said first side surface across said ink accommodating chamber, an upper surface and a bottom surface, said ink discharge opening being disposed in a position close to said bottom surface than to said upper surface;

a substrate provided on said casing;

an electrical contact provided on said substrate and including an area in a position above said ink discharge opening, the area crossing with a direction parallel with a normal line of said formation region;

a positioning portion provided on said casing above said ink discharge opening below said electrical contact and configured to limit movement of said casing in a direction perpendicular to a direction parallel with a normal line of said formation region;

a force receiving portion provided at said first side surface in a position above said ink discharge opening below said positioning portion capable of receiving an urging force for urging said casing in a depth direction which is in parallel with the normal line of said formation region and away from said first side surface toward said second side surface; and an engaging portion provided on said casing in a position closer to said electrical contact than to said ink discharge opening, said engaging portion including an area crossing with a direction parallel with the normal line of said formation region and capable of receiving a limiting force for limiting movement of said casing in the depth direction against the urging force.

(Aspect 87)

An ink cartridge comprising:

a casing including an ink accommodating chamber, a first side surface having a formation region in which an ink discharge opening configured to discharge ink from said ink accommodating chamber to an outside, an upper surface and a bottom surface, said ink discharge opening being disposed in a position close to said bottom surface than to said upper surface;

a substrate provided on said casing;

an electrical contact provided on said substrate and including an area in a position above said ink discharge opening, the area crossing with a direction parallel with a normal line of said formation region;

a positioning portion provided on said casing above said ink discharge opening below said electrical contact; and an engaging portion provided on said casing in a position closer to said electrical contact than to said ink discharge opening, said engaging portion including an area crossing with a direction parallel with the normal line of said formation region.

INDUSTRIAL APPLICABILITY

A novel ink cartridge and a novel ink jet printer with which the satisfactory connection between the ink cartridge and the cartridge mounting portion can be accomplished are provided.

REFERENCE NUMERALS

1: ink cartridge
2: casing
2*a*: upper surface
2*b*: bottom surface
2*c*: front surface
2*d*: rear surface
2*e*: left surface
2*f*: right-hand surface
3: substrate
4: electrical contact (electrode pad)
4*a*: contact position
5: storing element
6: positioning portion (positioning hole, positioning opening)
7: air vent (air vent)
8: tube inserting portion (tube inserting opening)
9: discrimination portion
10: position regulation surface
11: ink accommodating chamber
12: flexible member
13: negative pressure generation spring
14: plate member
15: filter
16: air vent path
17: air vent sealing film
18: tube inserting opening sealing film
19: sealing member

20: sealing member unit
21: outer casing
22: tube insertion path
23: ejection spring contact portion (force receiving portion)
24: engaging portion (recess)
25: label
26: ambient air opening
27: penetrated portion (through-opening)
30: printer main assembly
31: carriage
32: ink jet head
33: mounting portion (cartridge mounting portion, cartridge holder)
34: feeding means
35: controller
36: input/output portion
37: print medium
38: head unit (cartridge mounting unit)
40: first casing member
41: second casing member
46: supporting member of electrical connecting portion
47: electrical connection unit
48: plate
49: frame
50: mounting guide
51: unsealing member (unsealing pin)
52: ink receiving member (ink receiving tube)
53: positioning member (positioning pin)
54: locking portion (locking projection)
55: electrical connecting portion (electrical terminal, main assembly side electrical contact)
56: positioning wall
57: urging member (ejection spring)
58: locking lever
59: joint unit (main assembly side connecting unit)
60: discrimination member
61: electrical contact (electrode pad)
61*a*: contact position.
62: storing element.
63: substrate.
71: electrical contact (electrode pad).
71*a*: contact position.
72: storing element.
73: substrate.
74: sealing member.
75: valve.
76: spring.
77: interrelation valve.
78: supporting shaft.
81: substrate supporting member.
101: ink cartridge.
201: ink cartridge.
224: engaging portion (projection).
301: ink cartridge.
324: engaging portion (curved surface or inclined surface).
401: ink cartridge.
424: engaging portion (flat surface).
501: ink cartridge.
524: engaging portion (projection).
601: ink cartridge.
624: engaging portion.
701: ink cartridge.
724: engaging portion.
725: elastic member.
801: ink cartridge.
901: ink cartridge.
936: projection.
937: elastic member (spring).
938: projection.
1001: ink cartridge.
1003: substrate.
1004: electrical contact.
1037: rotation shaft.
1101: ink cartridge.
1103: substrate.
1104: electrical contact.
1105: storing element.
1201: ink cartridge.
1203: substrate.
1204: electrical contact.
1205: storing element.
1301: ink cartridge.
1303: substrate.
1304: electrical contact.
1305: storing element.
1401: ink cartridge.
1406: positioning portion (polarity of projections).
1501: ink cartridge.
1506: positioning portion (slit formation member).
1601: ink cartridge.
1606: positioning portion.
1701: ink cartridge.
1702*c*1: first front wall forming member.
1702*c*2: second front wall forming member.
1801: ink cartridge.
1802: casing.
1901: ink cartridge.
1902: casing.
1924: engaging portion.
1925: rotation shaft.
1926: engagement lever.
2001: ink cartridge.
2017: air vent sealing film.
2101: ink cartridge.
2201: ink cartridge.
2301: ink cartridge.

The invention claimed is:

1. An ink cartridge mountable, in a mounting direction crossing with a direction of gravity, to a cartridge mounting portion provided with an ink receiving tube and a plurality of electrical connecting portions, said ink cartridge comprising:

a casing including an ink accommodating chamber configured to accommodate ink to be supplied to said ink receiving tube, said casing having a first side surface in a position at a leading end with respect to the mounting direction, an upper surface and a bottom surface;

a tube inserting portion into which the ink receiving tube is insertable and which is provided at said first side surface in a position closer to said bottom surface than to said upper surface;

a substrate provided on said first side surface and having an area above said tube inserting portion, the area crossing with the mounting direction;

a plurality of electrical contacts electrically connectable with the plurality of electrical connecting portions, said electrical contacts being arranged in the area in a direction crossing with a direction of height which is from said bottom surface toward said upper surface;

an engaging portion engageable with a locking lever provided in said cartridge mounting portion to maintain an inserted state in which the ink receiving tube is inserted in said tube inserting portion and a connected state in which said electrical contacts are connected with the electrical connecting portions;

a positioning portion provided in a position above said tube inserting portion and below said electrical contacts and engageable with a positioning member provided in the cartridge mounting portion to limit movement of said casing in a direction perpendicular to the mounting direction; and a through-opening at a position between said tube inserting portion and said positioning portion of said first side surface, said through-opening being in fluid communication with said ink accommodating chamber to supply the air into said ink accommodating chamber, wherein said engaging portion is provided on said upper surface in the position closer to said electrical contacts than to said tube inserting portion.

2. An ink cartridge according to claim 1, wherein said area of said substrate is parallel with said first side surface.

3. An ink cartridge according to claim 1, wherein the direction crossing with the direction of height is a horizontal direction perpendicular to the direction of height.

4. An ink cartridge according to claim 1, wherein said casing has a second side surface at a trailing end portion with respect to the mounting direction, a third side surface connected with said first side surface, said second side surface, said upper surface and said bottom surface, a fourth side surface opposite from the third side surface across said ink accommodating chamber and connected with said first side surface, said second side surface, said upper surface and said bottom surface, and wherein the direction crossing with the direction of height is perpendicular to said third side surface and to said fourth side surface.

5. An ink cartridge according to claim 4, wherein said third side surface has an area larger than that of any one of said first side surface, said second side surface, said upper surface and said bottom surface, and said fourth side surface has an area larger than that of any one of said first side surface, said second side surface, said upper surface and said bottom surface, and wherein said first side surface has an area smaller than that of any one of said third side surface, said fourth side surface, said upper surface and said bottom surface, and said second side surface has an area smaller than that of any one of said third side surface, said fourth side surface, said upper surface and said bottom surface.

6. An ink cartridge mountable, in a mounting direction crossing with a direction of gravity, to a cartridge mounting portion provided with an ink receiving tube and a plurality of electrical connecting portions, said ink cartridge comprising:

a casing including an ink accommodating chamber configured to accommodate ink to be supplied to said ink receiving tube, said casing having a first side surface in a position at a leading end with respect to the mounting direction, a second side surface in a position at a trailing end with respect to the mounting direction, a third side surface connecting said first side surface and said second side surface with each other, a fourth side surface opposite from said third side surface across said ink accommodating chamber and connecting said first side surface and said second side surface with each other, an upper surface and a bottom surface;

a tube inserting portion into which the ink receiving tube is insertable and which is provided at said first side surface in a position closer to said bottom surface than to said upper surface;

a substrate provided on said first side surface in a position above said tube inserting portion;

a plurality of electrical contacts electrically connectable with the plurality of electrical connecting portions, said electrical contacts being arranged on said substrate in a direction perpendicular to said third side surface and to said fourth side surface;

an engaging portion engageable with a locking lever provided in said cartridge mounting portion to maintain an inserted state in which the ink receiving tube is inserted in said tube inserting portion and a connected state in which said electrical contacts are connected with the electrical connecting portions;

a positioning portion provided in a position above said tube inserting portion and below said electrical contacts and engageable with a positioning member provided in the cartridge mounting portion to limit movement of said casing in a direction perpendicular to the mounting direction; and a through-opening at a position between said tube inserting portion and said positioning portion of said first side surface, said through-opening being in fluid communication with said ink accommodating chamber to supply the air into said ink accommodating chamber, wherein said engaging portion is provided on said upper surface in the position closer to said electrical contacts than to said tube inserting portion.

7. An ink cartridge according to claim 6, wherein said third side surface has an area larger than that of any one of said first side surface, said second side surface, said upper surface and said bottom surface, and said fourth side surface has an area larger than that of any one of said first side surface, said second side surface, said upper surface and said bottom surface, and wherein said first side surface has an area smaller than that of any one of said third side surface, said fourth side surface, said upper surface and said bottom surface, and said second side surface has an area smaller than that of any one of said third side surface, said fourth side surface, said upper surface and said bottom surface.

8. An ink cartridge according to claim 1, further comprising a tube insertion path provided in said casing and connecting said tube inserting portion and said ink accommodating chamber with each other, and an elastic member provided in said tube insertion path and elastically deformable in accordance with insertion of the ink receiving tube into said tube insertion path.

9. An ink cartridge according to claim 8, wherein said elastic member includes a rubber member contactable to an outer peripheral surface of the ink receiving tube inserted in said tube insertion path.

10. An ink cartridge according to claim 1, wherein said engaging portion is disposed in the position closer to said upper surface than to said bottom surface.

11. An ink cartridge according to claim 1, wherein said engaging portion is disposed on said upper surface.

12. An ink cartridge according to claim 1, wherein said engaging portion is a recess engageable with a projection of the locking lever.

13. An ink cartridge according to claim 1, wherein said positioning portion is disposed in a position closer to said electrical contacts than to said tube inserting portion.

14. An ink cartridge according to claim 13, wherein said positioning portion includes a positioning opening into which the positioning member is inserted, and said positioning opening provided in said first side surface.

15. An ink cartridge according to claim 1, wherein the direction perpendicular to the mounting direction is a direction of height which is from said bottom surface toward said upper surface.

16. An ink cartridge according to claim 1, wherein the direction perpendicular to the mounting direction is along said first side surface.

* * * * *